US008512139B2

(12) United States Patent
Williams et al.

(10) Patent No.: US 8,512,139 B2
(45) Date of Patent: Aug. 20, 2013

(54) MULTI-LAYER DISPLAY 3D SERVER BASED PORTALS

(75) Inventors: David C. Williams, Carson City, NV (US); Kurt M. Larsen, Reno, NV (US); Jae Man Yi, Reno, NV (US); Steven G. LeMay, Reno, NV (US)

(73) Assignee: IGT, Reno, NV (US)

( * ) Notice: Subject to any disclaimer, the term of this patent is extended or adjusted under 35 U.S.C. 154(b) by 1428 days.

(21) Appl. No.: 11/983,770

(22) Filed: Nov. 9, 2007

(65) Prior Publication Data

US 2008/0125219 A1 May 29, 2008

Related U.S. Application Data

(63) Continuation-in-part of application No. 11/595,774, filed on Oct. 10, 2006.

(60) Provisional application No. 60/858,741, filed on Nov. 13, 2006, provisional application No. 60/792,082, filed on Apr. 13, 2006, provisional application No. 60/822,859, filed on Aug. 18, 2006.

(51) Int. Cl.
*A63F 9/24* (2006.01)

(52) U.S. Cl.
USPC ..... 463/32; 463/16; 463/17; 463/18; 463/19; 463/20; 463/30; 463/31; 463/33

(58) Field of Classification Search
USPC ..... 463/16–20, 30–34
See application file for complete search history.

(56) References Cited

U.S. PATENT DOCUMENTS 3,708,219 A 1/1973 Forlini et al.
3,931,504 A 1/1976 Jacoby (Continued)

FOREIGN PATENT DOCUMENTS

AU 1996 0050576 4/1997
AU 704691 4/1997

(Continued)

OTHER PUBLICATIONS

International Search Report dated Jun. 2, 2005 from PCT Application No. PCT/US2005/000950, 5 pages.

(Continued)

*Primary Examiner* — Arthur O. Hall
*Assistant Examiner* — Steve Rowland
(74) *Attorney, Agent, or Firm* — Neal, Gerber & Eisenberg LLP

(57) ABSTRACT

A gaming system including a number of host devices each coupled to one or more gaming machines, wherein content provided by the host device is output on the gaming machine. To output the content provided by the remote host, a host-controlled process that is authenticated by the gaming machine and executed in a secure memory location such that it is isolated from other processes executing on the gaming machine may be utilized. The host-controlled processes can be executed on a processor-based gaming machine with layered displays. The layered displays may include a front screen and back screen that provide actual physical separation between visual representations on the front and back screens. The downloaded content from a host to a gaming machine with layered displays may be monitored to ensure that content needed for each of the display layers is received prior to instantiating the display of the downloaded content via the host-controlled process.

25 Claims, 27 Drawing Sheets

(56) References Cited

U.S. PATENT DOCUMENTS 4,333,715 A 6/1982 Brooks
4,430,728 A 2/1984 Beitel et al.
4,454,594 A 6/1984 Heffron et al.
4,517,558 A 5/1985 Davids
4,607,844 A 8/1986 Fullerton
4,621,814 A 11/1986 Stepan et al.
4,659,182 A 4/1987 Aizawa
4,718,672 A 1/1988 Okada
4,856,787 A 8/1989 Itkis
4,911,449 A 3/1990 Dickinson et al.
4,912,548 A 3/1990 Shanker et al.
5,086,354 A 2/1992 Bass et al.
5,113,272 A 5/1992 Reamey
5,132,839 A 7/1992 Travis
5,319,491 A 6/1994 Selbrede
5,342,047 A 8/1994 Heidel et al.
5,364,100 A 11/1994 Ludlow et al.
5,375,830 A 12/1994 Takemoto et al.
5,376,587 A 12/1994 Buchmann et al.
5,393,061 A 2/1995 Manship et al.
5,467,893 A 11/1995 Landis, II et al.
5,539,547 A 7/1996 Ishii et al.
5,580,055 A 12/1996 Hagiwara
5,585,821 A 12/1996 Ishikura et al.
5,589,980 A 12/1996 Bass et al.
5,643,086 A 7/1997 Alcorn et al.
5,655,961 A 8/1997 Acres et al.
5,745,197 A 4/1998 Leung et al.
5,752,881 A 5/1998 Inoue
5,761,647 A 6/1998 Boushy
5,764,317 A 6/1998 Sadovnik et al.
5,851,149 A 12/1998 Xidos et al.
5,910,046 A 6/1999 Wada et al.
5,923,307 A * 7/1999 Hogle, IV ..... 345/4
5,951,397 A 9/1999 Dickinson
5,956,180 A * 9/1999 Bass et al. ..... 359/479
5,967,893 A 10/1999 Lawrence et al.
6,001,016 A 12/1999 Walker et al.
6,015,346 A 1/2000 Bennett
6,027,115 A 2/2000 Griswold et al.
6,050,895 A 4/2000 Luciano et al.
6,054,969 A * 4/2000 Haisma ..... 345/7
6,059,658 A 5/2000 Mangano et al.
6,068,552 A 5/2000 Walker et al.
6,099,408 A 8/2000 Schneier et al.
6,104,815 A 8/2000 Alcorn et al.
6,106,396 A 8/2000 Alcorn et al.
6,110,041 A 8/2000 Walker et al.
6,113,495 A 9/2000 Walker et al.
6,135,884 A 10/2000 Hedrick et al.
6,149,522 A 11/2000 Alcorn et al.
6,159,098 A 12/2000 Slomiany et al.
6,190,256 B1 2/2001 Walker et al.
6,213,875 B1 4/2001 Suzuki
6,244,596 B1 6/2001 Kondratjuk
6,251,014 B1 6/2001 Stockdale et al.
6,252,707 B1 6/2001 Kleinberger et al.
6,253,374 B1 6/2001 Dresevic et al.
6,254,481 B1 7/2001 Jaffe
6,293,866 B1 9/2001 Walker et al.
6,315,666 B1 11/2001 Mastera et al.
6,337,513 B1 1/2002 Clevenger et al.
6,347,996 B1 2/2002 Gilmore et al.
6,368,216 B1 4/2002 Hedrick et al.
6,379,244 B1 4/2002 Sagawa et al.
6,398,220 B1 6/2002 Inoue
6,416,827 B1 7/2002 Chakrapani et al.
6,444,496 B1 9/2002 Edwards et al.
6,445,185 B1 9/2002 Damadian et al.
6,446,257 B1 9/2002 Pradhan et al.
6,449,687 B1 9/2002 Moriya
6,452,710 B1 9/2002 Hiraga et al.
6,454,648 B1 9/2002 Kelly et al.
6,491,583 B1 12/2002 Gauselmann
6,503,147 B1 1/2003 Stockdale et al.
6,511,375 B1 1/2003 Kaminkow
6,512,559 B1 1/2003 Hashimoto et al.
6,514,141 B1 2/2003 Kaminkow et al.
6,517,433 B2 2/2003 Loose et al.
6,517,437 B1 2/2003 Wells et al.
6,547,664 B2 4/2003 Sauders
6,575,541 B1 6/2003 Hedrick et al.
6,585,591 B1 7/2003 Baerlocher et al.
6,620,047 B1 9/2003 Alcorn et al.
D480,961 S 10/2003 Deadman
6,645,077 B2 11/2003 Rowe
6,646,695 B1 11/2003 Gauselmann
6,652,378 B2 11/2003 Cannon et al.
6,659,864 B2 12/2003 McGahn et al.
6,661,425 B1 * 12/2003 Hiroaki ..... 345/629
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.
6,802,777 B2 10/2004 Seelig et al.
6,804,763 B1 10/2004 Stockdale et al.
6,811,486 B1 11/2004 Luciano, Jr. et al.
6,817,945 B2 11/2004 Seelig et al.
6,817,946 B2 11/2004 Motegi et al.
6,887,157 B2 5/2005 LeMay et al.
6,890,259 B2 5/2005 Breckner et al.
6,906,762 B1 6/2005 Witehira et al.
6,937,298 B2 8/2005 Okada
6,969,319 B2 11/2005 Rowe et al.
7,022,017 B1 4/2006 Halbritter et al.
7,095,180 B2 8/2006 Emslie et al.
7,097,560 B2 8/2006 Okada
7,128,647 B2 10/2006 Muir et al.
7,159,865 B2 1/2007 Okada
7,160,187 B2 1/2007 Loose et al.
7,198,571 B2 4/2007 LeMay et al.
7,204,753 B2 4/2007 Ozaki et al.
7,207,883 B2 4/2007 Nozaki et al.
7,220,181 B2 5/2007 Okada
7,252,288 B2 8/2007 Seelig et al.
7,255,643 B2 8/2007 Ozaki et al.
7,309,284 B2 12/2007 Griswold et al.
7,322,884 B2 1/2008 Emori et al.
7,329,181 B2 2/2008 Hoshino et al.
7,619,585 B2 * 11/2009 Bell et al. ..... 345/9
7,730,413 B1 * 6/2010 Engel et al. ..... 715/764
7,819,747 B2 10/2010 Kane et al.
7,959,502 B2 6/2011 Kane et al.
2001/0013681 A1 8/2001 Bruzzese et al.
2002/0045472 A1 4/2002 Adams
2002/0111815 A1 8/2002 Smith
2002/0142825 A1 10/2002 Lark et al.
2002/0142846 A1 10/2002 Paulsen
2002/0173354 A1 11/2002 Winans et al.
2002/0183105 A1 12/2002 Cannon et al.
2002/0194505 A1 12/2002 Muschenborn
2003/0018403 A1 1/2003 Braun et al.
2003/0027624 A1 2/2003 Gilmore et al.
2003/0032478 A1 2/2003 Takahama et al.
2003/0032479 A1 2/2003 LeMay et al.
2003/0064771 A1 4/2003 Morrow et al.
2003/0064801 A1 4/2003 Breckner et al.
2003/0069074 A1 4/2003 Jackson
2003/0078103 A1 4/2003 LeMay et al.
2003/0083943 A1 5/2003 Adams et al.
2003/0130028 A1 7/2003 Aida et al.
2003/0176214 A1 * 9/2003 Burak et al. ..... 463/20
2003/0176218 A1 9/2003 LeMay et al.
2003/0216961 A1 11/2003 Barry
2003/0222876 A1 12/2003 Giemborek et al.
2003/0236114 A1 12/2003 Griswold et al.
2004/0009813 A1 1/2004 Wind
2004/0023714 A1 2/2004 Asdale
2004/0029636 A1 * 2/2004 Wells ..... 463/32
2004/0048671 A1 3/2004 Rowe
2004/0063490 A1 4/2004 Okada
2004/0066475 A1 4/2004 Searle 2004/0103444 A1 5/2004 Weinberg et al.
2004/0110557 A1 6/2004 Rowe
2004/0116178 A1 6/2004 Okada
2004/0117484 A1 6/2004 Singer et al.
2004/0127284 A1 7/2004 Walker et al.
2004/0147303 A1 7/2004 Imura et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0180712 A1 9/2004 Forman et al.
2004/0180721 A1 9/2004 Rowe
2004/0183972 A1 9/2004 Bell
2004/0192430 A1 9/2004 Burak et al.
2004/0198485 A1 10/2004 Loose et al.
2004/0207154 A1 10/2004 Okada
2004/0209666 A1 10/2004 Okada
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0214622 A1 10/2004 Atkinson
2004/0214635 A1 10/2004 Okada
2004/0214637 A1 10/2004 Nonaka
2004/0224747 A1 11/2004 Okada
2004/0233663 A1 11/2004 Emslie et al.
2004/0239582 A1 12/2004 Seymour
2004/0254010 A1 12/2004 Fine
2005/0020348 A1* 1/2005 Thomas et al. ..... 463/20
2005/0020358 A1 1/2005 Cram
2005/0032571 A1 2/2005 Asonuma
2005/0037843 A1 2/2005 Wells et al.
2005/0043086 A1 2/2005 Schneider
2005/0049032 A1 3/2005 Kobayashi
2005/0049046 A1 3/2005 Kobayashi
2005/0059494 A1 3/2005 Kammler
2005/0062410 A1 3/2005 Bell et al.
2005/0063055 A1 3/2005 Engel
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0153776 A1 7/2005 LeMay et al.
2005/0164762 A1 7/2005 Smith et al.
2005/0192090 A1 9/2005 Muir et al.
2005/0206582 A1 9/2005 Bell et al.
2005/0208994 A1 9/2005 Berman
2005/0233799 A1 10/2005 LeMay et al.
2005/0239539 A1 10/2005 Inamura
2005/0266912 A1 12/2005 Sekiguchi
2005/0282638 A1 12/2005 Rowe
2005/0285337 A1 12/2005 Durham et al.
2006/0009273 A2 1/2006 Moshal
2006/0041586 A1 2/2006 Nassef, Jr.
2006/0063581 A1 3/2006 Harris et al.
2006/0068898 A1 3/2006 Maya
2006/0079333 A1 4/2006 Morrow et al.
2006/0089194 A1 4/2006 Joshi et al.
2006/0094508 A1 5/2006 D'Amico et al.
2006/0100014 A1 5/2006 Griswold et al.
2006/0103951 A1 5/2006 Bell et al.
2006/0105837 A1 5/2006 Walker et al.
2006/0105841 A1 5/2006 Rom et al.
2006/0125745 A1 6/2006 Evanicky
2006/0143085 A1 6/2006 Adams et al.
2006/0154729 A1 7/2006 LeMay et al.
2006/0166727 A1 7/2006 Burak
2006/0184626 A1 8/2006 Agapi et al.
2006/0190482 A1 8/2006 Kishan et al.
2006/0191177 A1 8/2006 Engel
2006/0217202 A1 9/2006 Burke et al.
2006/0264256 A1 11/2006 Gagner et al.
2006/0264257 A1 11/2006 Jaffe et al.
2006/0282855 A1 12/2006 Margulis
2006/0284574 A1 12/2006 Emslie et al.
2006/0290594 A1 12/2006 Engel et al.
2007/0004510 A1 1/2007 Underdahl et al.
2007/0004513 A1 1/2007 Wells et al.
2007/0010315 A1 1/2007 Hein
2007/0015569 A1 1/2007 Norton et al.
2007/0032288 A1 2/2007 Nelson et al.
2007/0043616 A1 2/2007 Kutaragi et al.
2007/0060317 A1 3/2007 Martin
2007/0180400 A1 8/2007 Zotov et al.
2007/0243925 A1 10/2007 LeMay et al.
2007/0243928 A1 10/2007 Iddings
2007/0243934 A1 10/2007 Little et al.
2008/0009344 A1 1/2008 Graham et al.
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0076574 A1 3/2008 Okada
2008/0096655 A1* 4/2008 Rasmussen et al. ..... 463/31
2008/0113747 A1 5/2008 Williams et al.
2008/0200233 A1 8/2008 Aida
2008/0318655 A1 12/2008 Davies
2009/0098943 A1 4/2009 Weber et al.
2009/0104954 A1 4/2009 Weber et al.
2009/0156303 A1 6/2009 Kiely et al.
2009/0197684 A1 8/2009 Arezina et al.
2009/0233705 A1 9/2009 LeMay et al.
2010/0105454 A1 4/2010 Weber et al.

FOREIGN PATENT DOCUMENTS

EP 0 454 423 10/1991
EP 0 484 103 5/1992
EP 0 769 769 4/1997
EP 0 997 857 10/1999
EP 1 195 184 4/2002
EP 1 255 234 11/2002
EP 1 260 928 11/2002
EP 1 282 088 2/2003
EP 1 462 152 A2 9/2004
EP 1492063 12/2004
EP 1 524 617 4/2005
GB 1 464 896 2/1977
GB 2 120 506 11/1983
JP 04-220276 8/1992
JP 06-043425 2/1994
JP 07-124290 5/1995
JP 2000-300729 10/2000
JP 00-350805 12/2000
JP 01-062032 3/2001
JP 01-238995 9/2001
JP 01-252393 9/2001
JP 01-252394 9/2001
JP 02-085624 3/2002
JP 2004-089707 3/2004
JP 2004-105616 4/2004
JP 04-166879 6/2004
JP 2005-253561 9/2005
JP 2005-266387 9/2005
JP 2005-266388 9/2005
JP 2005-274906 10/2005
JP 2005-274907 10/2005
JP 2005-283864 10/2005
JP 2006-346226 12/2006
WO WO 98/52665 11/1998
WO 99/42889 8/1999
WO 99/44095 9/1999
WO 01/15127 3/2001
WO 01/15128 3/2001
WO 01/15132 3/2001
WO 01/09664 8/2001
WO 02/073501 9/2002
WO WO 03/023647 3/2003
WO 03/039699 5/2003
WO 2004/001486 12/2003
WO 2004/102520 11/2004
WO 2006/033986 3/2006
WO 2006/034192 3/2006
WO 2006/038819 4/2006
WO WO 2006/039132 4/2006
WO WO 2007/032916 3/2007
WO WO 2007/040413 4/2007
WO WO 2007/120444 10/2007

| | | |
|---|---|---|
| WO | WO 2007/120450 | 10/2007 |
| WO | WO 2008/056844 | 5/2008 |
| WO | WO 2008/061068 | 5/2008 |
| WO | WO 2009/009269 | 1/2009 |
| WO | WO 2009/036445 | 3/2009 |
| WO | WO 2009/140096 | 11/2009 |
| WO | WO 2009/143274 | 11/2009 |
| WO | WO 2010/056418 | 5/2010 |
| WO | WO 2010/120451 | 10/2010 |

OTHER PUBLICATIONS

Written Opinion of the International Searching Authority dated Jun. 2, 2005 from PCT Application No. PCT/US2005/000950.
"Light Valve". Retrieved from the internet URL http://www.meko.co.uk/lightvalve.shtml [retrieved on Nov. 15, 2005, 1 page.
"Liquid Crystal Display". Retrieved from the internet URL http://en.wikipedia.org/wiki/LCD [retrieved on Nov. 16, 2005, 6 pages.
Bonsor, Kevin, "How Smart Windows Will Work," Howstuffworks, Inc. 1998-2002, http://www.howstuffworks.com/smart-window.htm/printable Printed Nov. 25, 2002 (5 pages).
"What is SPD?" SPD Systems, Inc. 2002, http://www.spd-systems.com/spdq.htm. Printed Dec. 4, 2002 (2 pages).
"Debut of Let's Make a Deal Slot Machine," Let's Make a Deal 1999-2002, http://www.letsmakeadeal.com/pr01.htm. Printed Dec. 3, 2002 (2 pages).
Living in a flat world? Advertisement written by Deep Video Imaging Ltd., published 2000.
Novel 3-D Video Display Technology Developed, News release: Aug. 30, 1996, www.eurekalert.org/summaries/1199.html, printed from Internet Archive using date Sep. 2, 2000.
Time Multiplexed Optical Shutter (TMOS): A Revolutionary Flat Screen Display Technology, www.vea.com/TMOS.html, Apr. 8, 1999, printed from Internet Archive using date Oct. 6, 1999.
Time Multiplexed Optical Shutter (TMOS): A Revolutionary Flat Screen Display Technology, www.tralas.com/TMOS.html, Apr. 5, 2001, printed from Internet Archive using date Apr. 11, 2001.
Written Opinion of the International Searching Authority dated May 25, 2005 from PCT Application No. PCT/US2005/000597.
Bosner, "How Smart Windows Work," HowStuffWorks, Inc., www.howstuffworks.com, 1998-2004, 9 pages.
Saxe et al., "Suspended-Particle Devices," pp. www.refr-spd.com, Apr./May 1996, 5 pages.
"SPD," Malvino Inc., www.malvino.com, Jul. 19, 1999, 10 pages.
European Exam Report dated Sep. 13, 2007 from related EP Application No. 05 705 315.9.
International Search Report dated Sep. 21, 2007 from related PCT Application No. PCT/US2007/007617, 5 pages.
Written Opinion of the International Searching Authority dated Sep. 21, 2007 from related PCT Application No. PCT/US2007/007617, 8 pages.
International Search Report mailed Sep. 21, 2007 from related International Application No. PCT/US2007/007857, 5 pages.
Written Opinion of the International Searching Authority dated Sep. 21, 2007 from related PCT Application No. PCT/US2007/007857, 7 pages.
International Search Report and Written Opinion, dated May 2, 2008, for PCT/US2007/084459.
U.S. Office Action dated Feb. 10, 2009 issued in U.S. Appl. No. 11/595,774.
U.S. Examiner Interview Summary dated May 22, 2009 issued in U.S. Appl. No. 11/595,774.
U.S. Office Action Final dated Aug. 26, 2009 issued in U.S. Appl. No. 11/595,774.
U.S. Office Action—Supplemental Final dated Sep. 16, 2009 issued in U.S. Appl. No. 11/595,774.
U.S. Office Action dated Apr. 15, 2011 issued in U.S. Appl. No. 11/595,774.
U.S. Office Action dated Aug. 3, 2011 issued in U.S. Appl. No. 12/426,165.
U.S. Office Action dated Jun. 19, 2009 issued in U.S. Appl. No. 11/682,253.
U.S. Examiner Interview Summary dated Aug. 14, 2009 issued in U.S. Appl. No. 11/682,253.
U.S. Office Action Final dated Nov. 30, 2009 issued in U.S. Appl. No. 11/682,253.
U.S. Office Action dated Jun. 24, 2011 issued in U.S. Appl. No. 12/209,608.
U.S. Office Action dated Jul. 26, 2011 issued in U.S. Appl. No. 12/271,884.
U.S. Office Action dated Feb. 12, 2009 issued in U.S. Appl. No. 11/595,798.
U.S. Examiner Interview Summary dated May 22, 2009 issued in U.S. Appl. No. 11/595,798.
U.S. Office Action Final dated Sep. 24, 2009 issued in U.S. Appl. No. 11/595,798.
U.S. Office Action Final dated Apr. 14, 2011 issued in U.S. Appl. No. 11/595,798.
U.S. Office Action Supplemental dated Apr. 29, 2011 issued in U.S. Appl. No. 11/595,798.
PCT International Preliminary Report on Patentability and Written Opinion dated Oct. 14, 2008 issued in PCT/US2007/007617.
Australian Examiner's First Report dated May 25, 2011 issued in AU 2007239023.
Chinese First Office Action dated May 18, 2010 issued in CN 200780021740.1.
European Examination Report dated Apr. 20, 2009 issued in EP 07 754 175.3-1238.
PCT International Search Report dated Aug. 3, 2010 issued in PCT/US2010/028368 (WO 2010/120451).
PCT International Search Report and Written Opinion dated Dec. 11, 2008 issued in PCT/US2008/076428 (WO 2009/036445).
PCT International Preliminary Report on Patentability and Written Opinion dated Mar. 16, 2010 issued in PCT/US2008/076428 (WO 2009/036445).
PCT International Search Report and Written Opinion dated Dec. 4, 2009 issued in PCT/US2009/057551.
PCT International Preliminary Report on Patentability and Written Opinion dated May 17, 2011 issued in PCT/US2009/057551.
PCT International Preliminary Report on Patentability and Written Opinion dated May 12, 2009 issued in PCT/US2007/084459 (WO 2008/061068).
Australian Examiner's first report dated Jul. 7, 2011 issued in AU 2007319331.
European Examination Report dated Oct. 28, 2009 issued in EP 07 845 059.0-1238.
PCT International Search Report and Written Opinion dated Sep. 8, 2009 issued in PCT/US2009/042741.
PCT International Preliminary Report on Patentability and Written Opinion dated Nov. 25, 2010 issued in PCT/US2009/042741.
PCT International Search Report dated Jul. 24, 2009 issued in PCT/US2009/044716.
PCT International Preliminary Report on Patentability and Written Opinion dated Dec. 2, 2010 issued in PCT/US2009/044716.
PCT International Preliminary Report on Patentability and Written Opinion dated Oct. 14, 2008 issued in PCT/US2007/007857 (WO 2007/120450).
Australian Examiner's first report dated May 25, 2011 issued in AU 2007239029.
Chinese First Office Action dated Mar. 25, 2010 issued in CN 200780021699.8.
Chinese Second Office Action dated Aug. 24, 2010 issued in CN 200780021699.8.
Chinese Third Office Action dated Dec. 3, 2010 issued in CN 200780021699.8.
Chinese Fourth Office Action dated Feb. 23, 2011 issued in CN 200780021699.8.
Chinese Fifth Office Action dated May 25, 2011 issued in CN 200780021699.8.
European Examination Report dated Apr. 20, 2009 from EP 07 754 383.3-1238.
PCT International Search Report and Written Opinion dated Sep. 26, 2008 issued in PCT/US2008/067543.
PCT International Preliminary Report on Patentability and Written Opinion dated Jan. 12, 2010 issued in PCT/US2008/067543.

Miser, Brad, "Using Mac OS 8.5," (Nov. 1998) Que Publishing accessed at <http://www.netlibrary.com/nlreader.dll?bookid=8218&filename=Page_ii.html>.
U.S. Office Action Final dated Oct. 14, 2011 issued in U.S. Appl. No. 11/595,774.
U.S. Office Action Final dated Feb. 17, 2012 issued in U.S. Appl. No. 12/426,165.
U.S. Office Action dated Jan. 26, 2012 issued in U.S. Appl. No. 11/682,253.
U.S. Office Action dated Feb. 15, 2012 issued in U.S. Appl. No. 12/120,191.
U.S. Office Action dated Sep. 30, 2011 issued in U.S. Appl. No. 12/435,962.
U.S. Office Action Final dated Oct. 14, 2011 issued in U.S. Appl. No. 11/595,798.
U.S. Office Action dated Oct. 27, 2011 issued in U.S. Appl. No. 11/827,060.
Chinese Second Office Action dated Nov. 16, 2011 issued in CN 200780021740.1.
Great Britain Examination report dated Feb. 15, 2012 issued in GB1020135.8.
Chinese Sixth Office Action dated Dec. 7, 2011 issued in CN 200780021699.8.
Regulation 14 of Regulations of the Nevada Gaming Commission and State Gaming Control Board, Regulation 14.230 adopted Jul. 1989.

* cited by examiner

616

618

MULTI-LAYER DISPLAY 3D SERVER BASED PORTALS

CROSS REFERENCE TO RELATED APPLICATION

This application claims priority to U.S. Provisional Patent Application No. 60/858,741, filed on Nov. 13, 2006, which is incorporated herein by reference in its entirety and for all purposes.

This application claims priority and is a continuation-in-part of U.S. patent application Ser. No. 11/595,774, entitled "Method and Apparatus for Integrating Remotely-Hosted and Locally Rendered Content on a Gaming Device" and filed on Nov. 10, 2006, which claims priority under 35 U.S.C. §119(e) from U.S. Provisional Patent Application No. 60/792,082, filed Apr. 13, 2006, naming Little, et al., as inventors, and titled "Remote Content Management and Resource Sharing on a Gaming Machine," and from U.S. Provisional Patent Application No. 60/822,859, filed Aug. 18, 2006, naming Little, et al., as inventors, and titled "Remote Content Management and Resource Sharing on a Gaming Machine and Method of Implementing same," each of which is incorporated herein by reference in their entirety and for all purposes.

This application is related to U.S. application Ser. No. 11/858,700, entitled, "MECHANICAL REEL HARDWARE SIMULATION USING MULTIPLE LAYER DISPLAYS," filed Sep. 20, 2007, by Williams, et al., which is incorporated herein in its entirety and for all purposes.

A portion of the invention of this patent document contains or may contain material which is subject to copyright protection. The copyright owner has no objection to the photocopy reproduction by anyone of the patent document or the patent invention in exactly the form it appears in the Patent and Trademark Office patent file or records, but otherwise reserves all copyright rights whatsoever.

TECHNICAL FIELD

The present invention relates generally to wager based gaming machines, and more specifically to the multimedia emulation of physical reel hardware on processor-based gaming machines including remote content management on a gaming machine with layered displays.

BACKGROUND

Traditional mechanical and electromechanical reel gaming machines, often referred to as "stepper" machines, arrange a number of rotating mechanical reels behind a fixed glass layer. As technology in the gaming industry progresses, the traditional mechanically driven reel slot machines are being replaced by electronic machines having an LCD video display or the like. Processor-based gaming machines are becoming the norm. One reason for their increased popularity is the nearly endless variety of games that can be implemented using processor-based technology. The processor-based gaming machines permit the operation of more complex games, incorporate player tracking, improve security, permit wireless communications, and add a host of digital features that are not possible on mechanical-driven gaming machines. The increasing cost of designing, manufacturing, and maintaining complex mechanical gaming machines has also motivated casinos and the gaming industry to abandon these older machines.

While existing designs and systems for providing realistic reel games on processor-based gaming machines, and particularly the presentation of spinning reels on the video displays thereof, have been adequate in the past, improvements are usually welcomed and encouraged. For instance, gaming entity may provide gaming services to tens of thousands of users. For instance, a single land-based casino may include thousands of gaming machines. Player's gaming interests are constantly changing and the effort associated with providing fresh content to users is quite costly. The ability of a casino operator to maximize their operating profits and keep their customers happy is directly linked to their ability to provide new and desirable gaming content. In view of the above, it would be desirable to provide gaming apparatus and method that reduce the costs associated with providing new gaming content on gaming devices.

SUMMARY

The present invention provides a processor-based gaming machine with layered displays. The layered displays include a front screen and back screen that provide actual physical separation between visual representations on the front and back screens; the separation mimics the actual distance seen between a glass layer and mechanical reels in a traditional mechanical stepper gaming machine. This distance between video screens also provides parallax and increases the ability of a processor-based gaming machine to realistically emulate older mechanical reel gaming machines.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

DESCRIPTION OF THE PREFERRED EMBODIMENTS

Figure 1A:
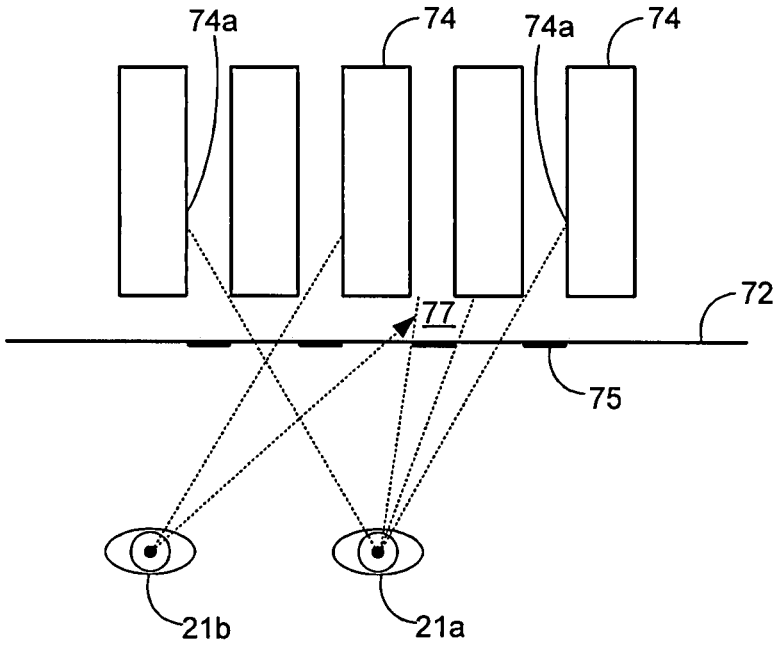
FIG. 1A shows a simple depiction of perspective viewing of a gaming machine with mechanical reels.

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Gaming machine manufacturers highly regard customer preference information. When the assignee introduced CRT-based slot machines in 1975, the reaction of some players was less than enthusiastic. The CRT screens jolted players from a gaming activity based on a complex mechanical apparatus to a single, flat, video screen. The technology of 1975 pales in comparison to that of today. And yet, amongst casino patrons and other players, the perceived value of mechanically driven reel slot machines remains high.

Customer preference information belonging to the assignee shows that players trust the old mechanical machines. Some players feel that a lack of mechanically driven reels causes a slot game to be cheapened—and somehow less random. Many players believe that it is impossible to externally tamper with or (to player detriment) control outcomes for a mechanically driven machine. These people also commonly believe that manipulating outcomes portrayed on a video screen is both easily accomplished and undetectable to a player. Others simply prefer the feel and appearance of an electromechanical apparatus as they pull a handle, hear and feel solenoid and latches as they engage and disengage, and watch as spinning reels click into position to display an outcome. A loyal base of players still favors the traditional mechanical stepper machines, even today. The gradual disappearance of mechanical gaming machines, however, has left admirers of mechanical steppers scrambling to find their preferred machines.

Described herein are processor-based gaming machines that emulate a mechanical reel machine using one or more physical adaptations. The physical adaptations may include the use of layered video displays with a set distance between the displays. Traditional mechanical reel gaming machines arranged the mechanical reels behind a glass layer, which included screen printing or printed decals attached to the glass. The printing indicated rules for the game, pay tables, and various game graphics. In this multiple video display embodiment, a proximate video display device, such as an LCD, includes video data that mimics the glass layer and information typically printed on the glass layer. To increase realism, video data sent to the proximate video display device may also include video data for glare lines and other depictions of interaction of the stickers with an environment around a gaming machine. Video data emulating the stickers may also include video fraying and video discoloration (e.g., dirt that simulates age) to add the realistic simulation of aged and actual stickers. A second video display device, behind the first, which may also be an LCD, then includes video data that simulates the mechanical reels. Physical separation of the two video displays mimics the same separation seen between the glass and reels in a tradition mechanical gaming machines and significantly adds to the illusion of a real mechanical system. For example, this adds parallax, an actual three dimensional (3D) effect of real reel gaming machines, where a person variably sees portions of the distal display, through windows on the proximate display, based on their position relative to the gaming machine. FIGS. 1A, 1B, 2A-2C and 4A-4C describe the use of layered video displays to simulate this mechanical arrangement. Other physical adaptations may be used.

Figure 3A:
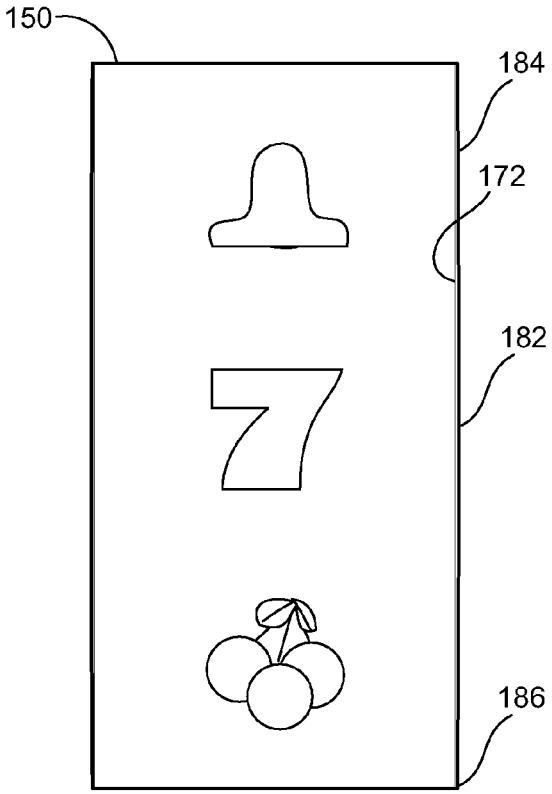
FIG. 3A shows a video reel strip with slight curvature on its lateral sides in accordance with one embodiment.
Figure 3B:
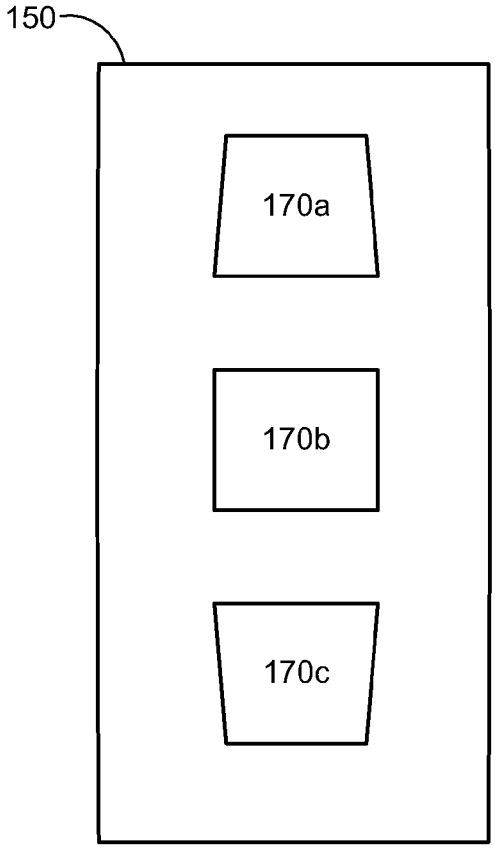
FIG. 3B shows a graphical simplification of perspective video adaptions applied to reel symbols sides in accordance with one embodiment.
Figure 3C:
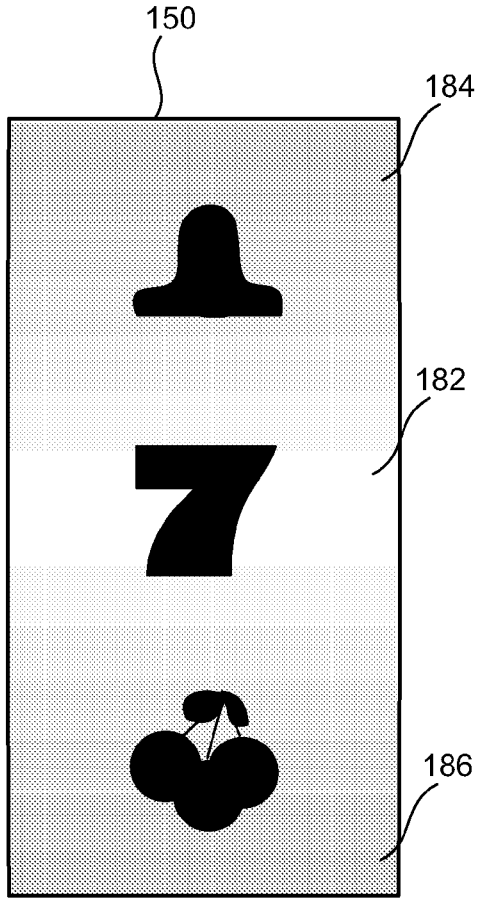
FIG. 3C shows a simplified version of simulated preferential lighting of a reel strip in accordance with one embodiment.
Figure 4A:
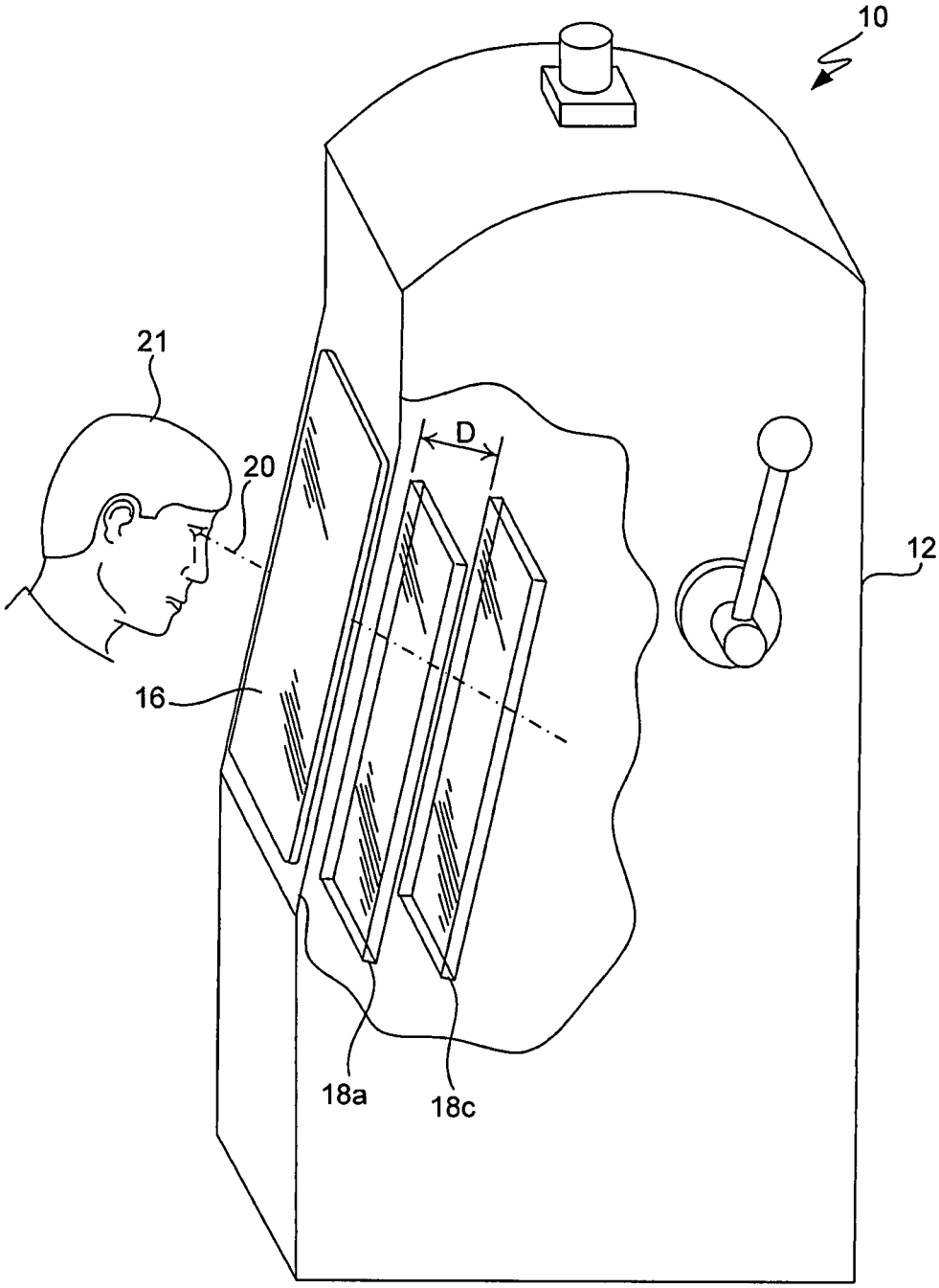
FIG. 4A shows layered displays in a gaming machine in accordance with one embodiment.
Figure 4B:
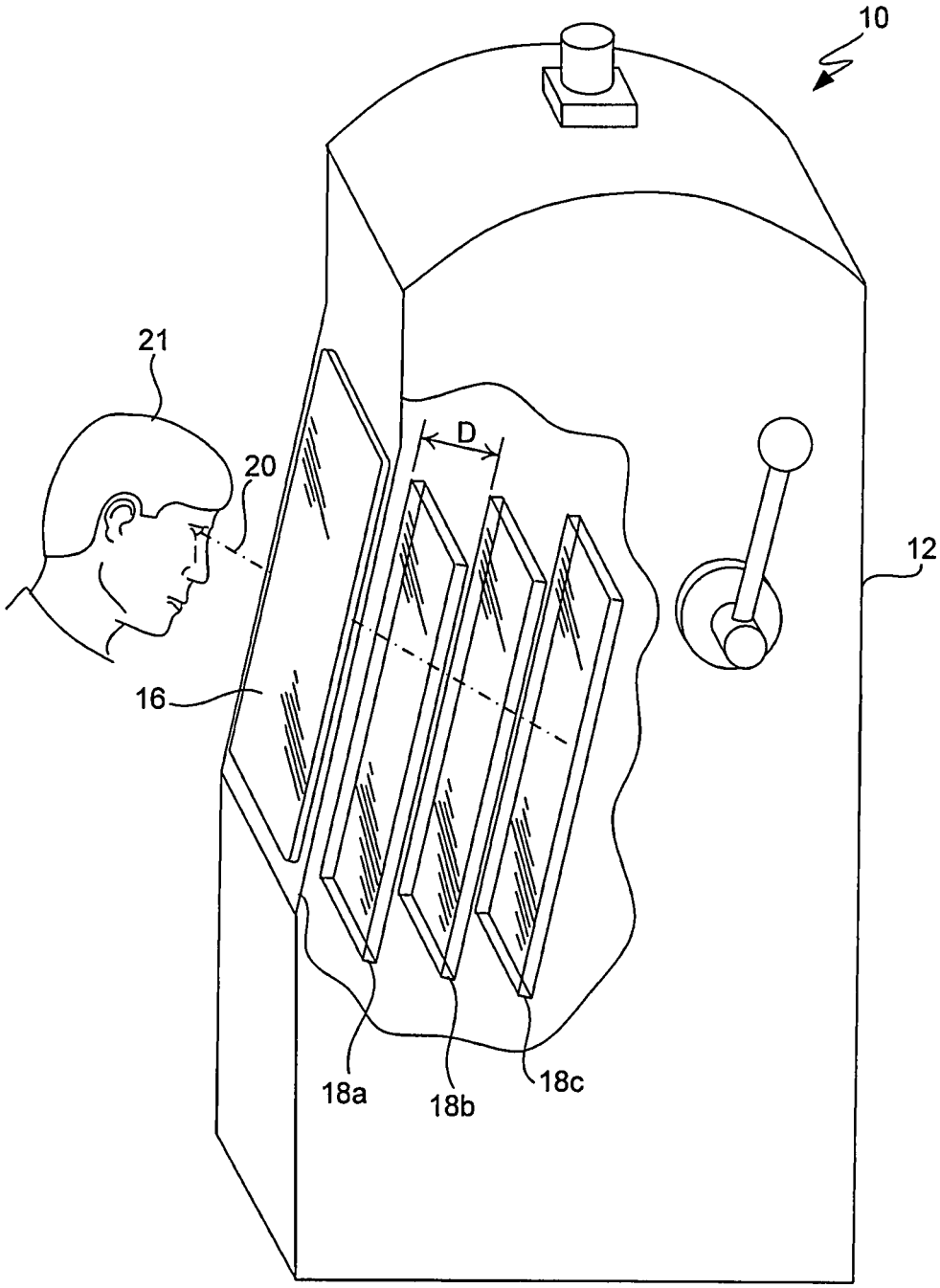
FIG. 4B shows layered displays in a gaming machine in accordance with another embodiment.
Figure 4C:
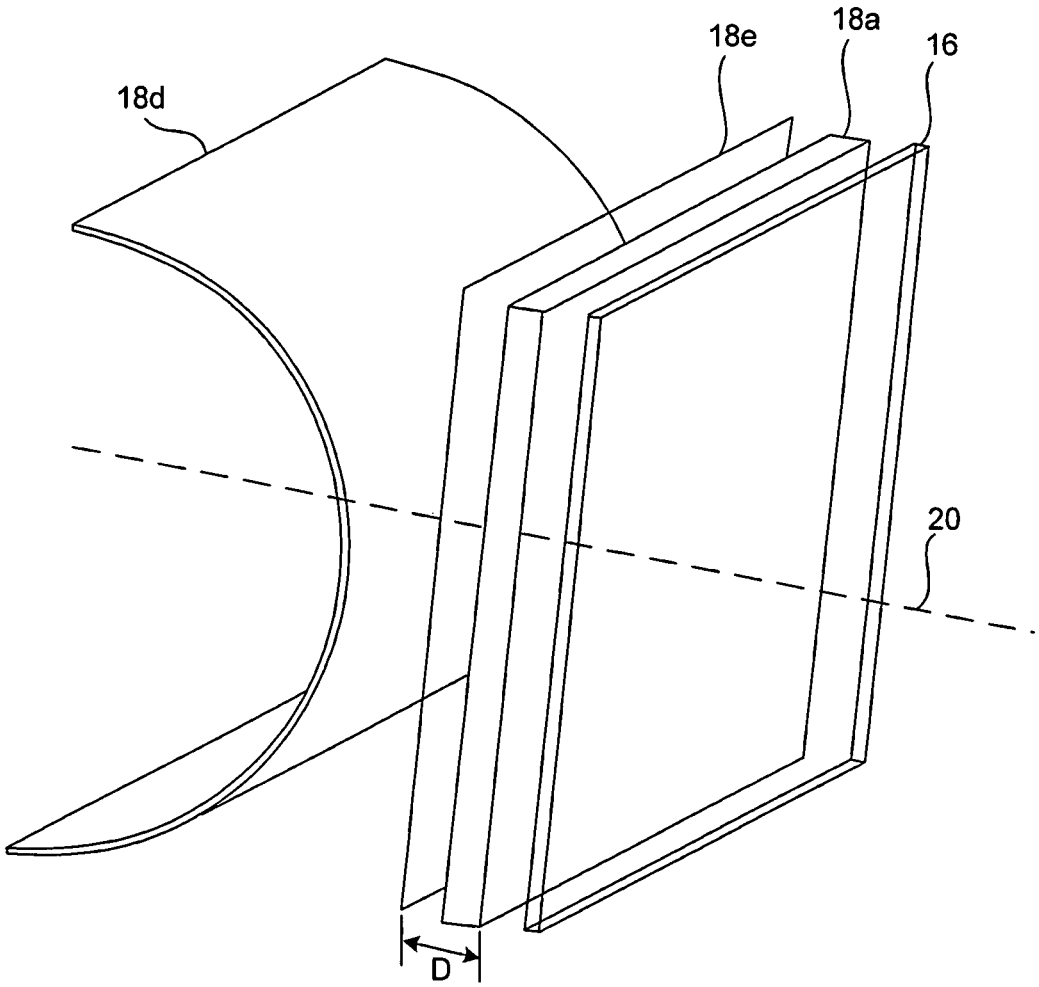
FIG. 4C shows another layered video display device arrangement in accordance with a specific embodiment.
Figure 5A:
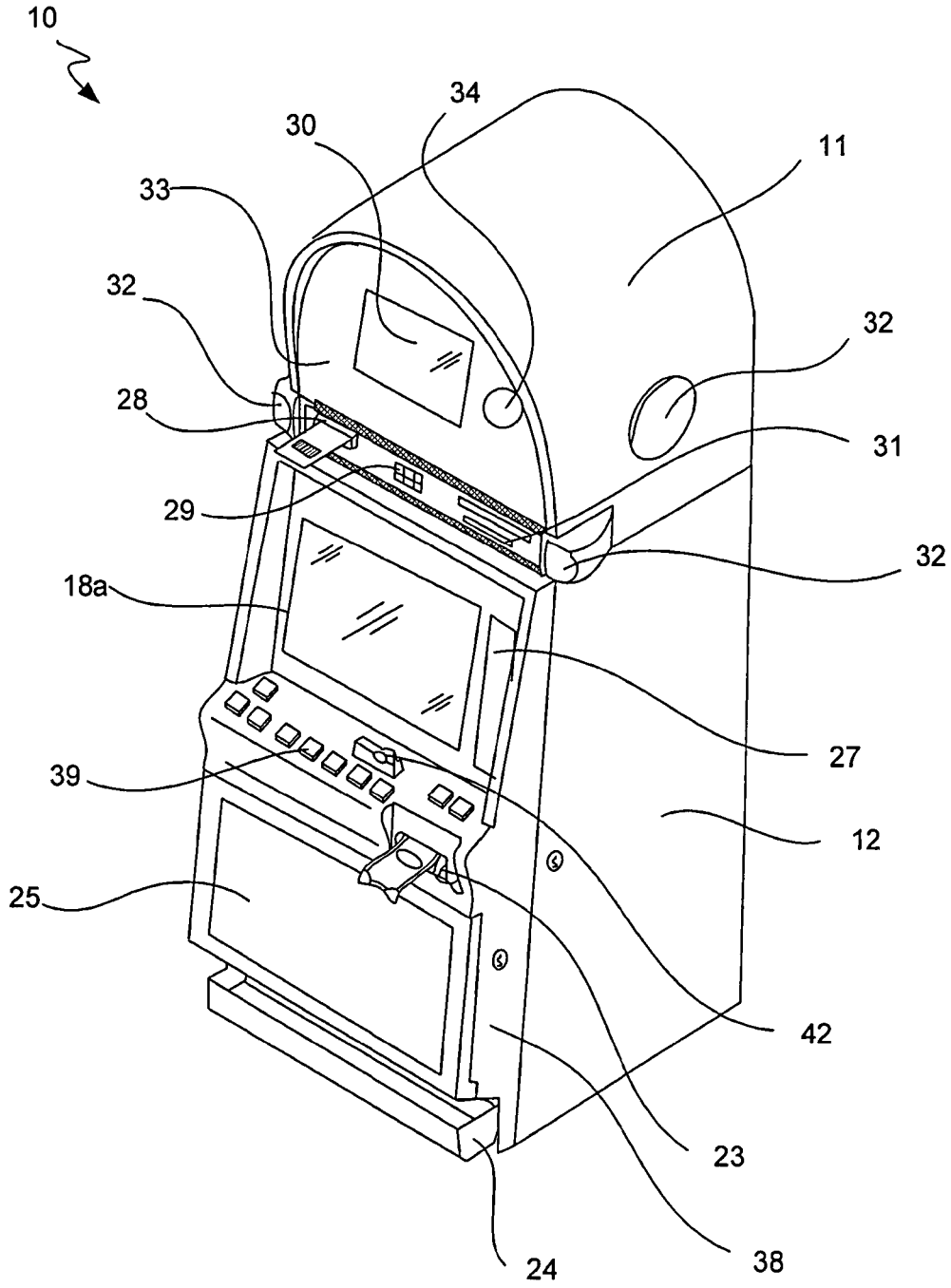
FIGS. 5A and 5B illustrate a gaming machine in accordance with a specific embodiment.
Figure 5B:
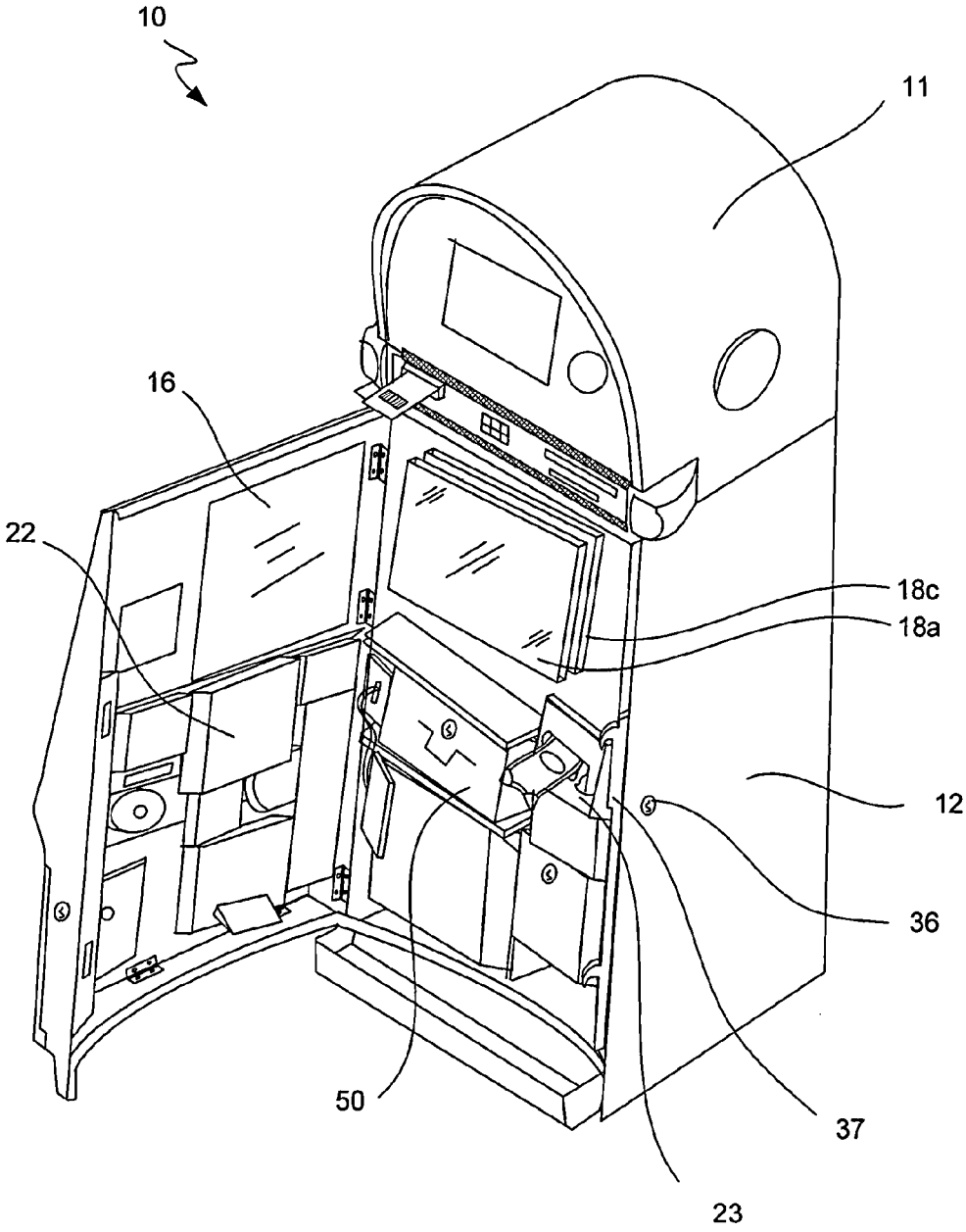
Figure 6:
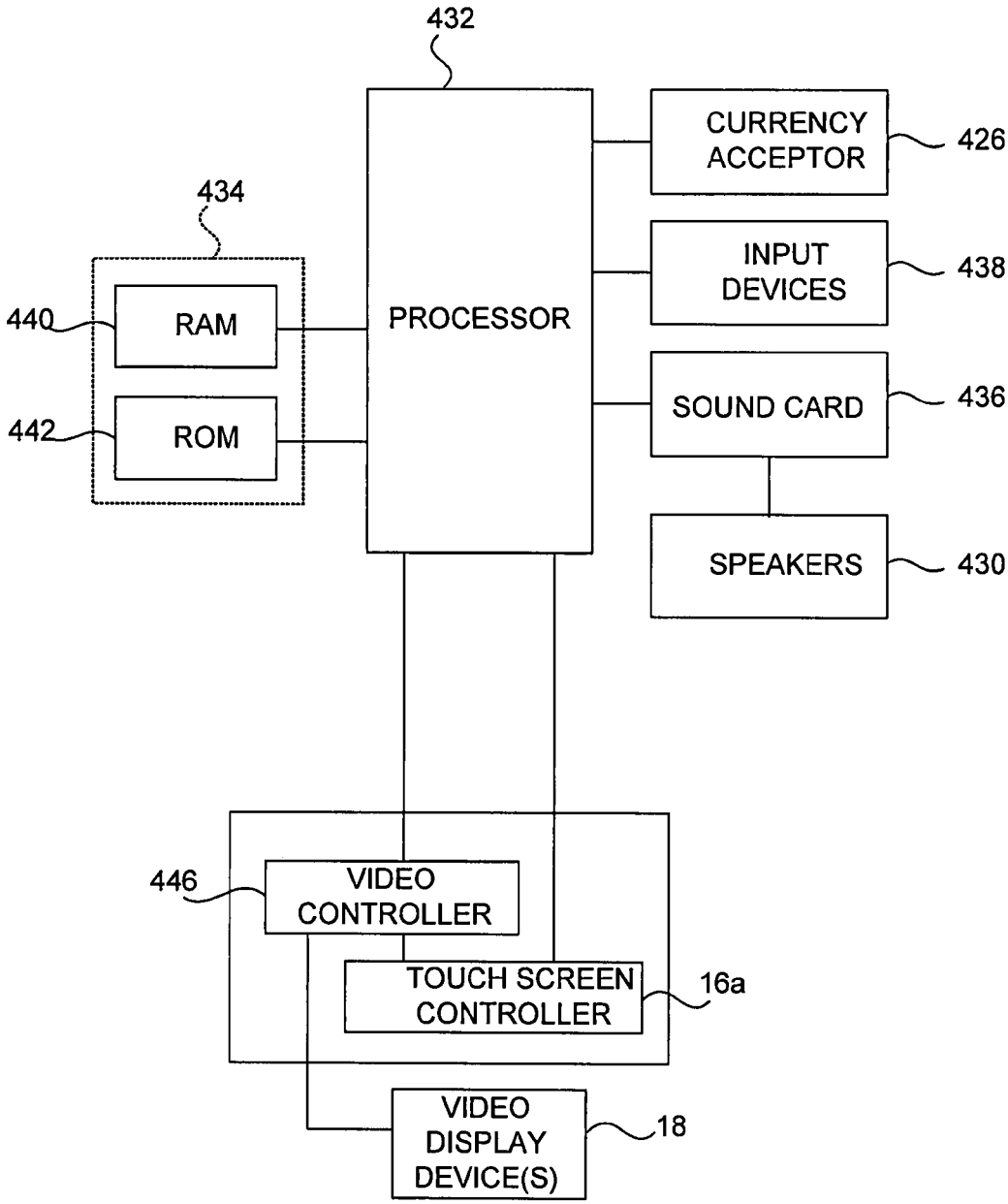
FIG. 6 illustrates a control configuration for use in a gaming machine in accordance with another specific embodiment.

FIGS. 5A, 5B and 6 describe gaming machines, gaming methods and associated gaming devices that may be utilized with the layered video displays described with respect to FIGS. 1A-4C. The gaming devices on a processor-based gaming machine, such as layered video displays, may be controlled by software executed by a master gaming controller, which includes the processor (see at least FIG. 6), in conjunction with software executed by a remote logic device (e.g., a remote host, a central server or a central controller) in communication with the gaming machine. For example, the remote host may provide commands, instructions and data that control a display of video content on a multi-layered display. The remote host may be operable control the display of video content on the multi-layered display utilizing an externally controlled interface process (ECI) executed by the master gaming controller. FIGS. 8, 9 and 9A-N describe the use of ECIs on a gaming machine including a gaming machine with a multi-layered display.

Before describing these physical adaptation embodiments in further detail, it is useful to differentiate between three types of reels in a gaming machine: mechanical reels, two-dimensional (2-D) video reels, and realistic video simulation of mechanical reels as described herein.

Mechanical reels refer to the traditional hardware reels, with their associated latches and various mechanical parts. A mechanical reel usually has a set number of symbols disposed about a circumference of a reel strip attached to a wheel. A motor, spring, or other mechanical system physically spins the wheel until it stops at a rotational position and a particular symbol rests in view of a player to indicate an outcome for the reel game. In many older machines, the reels and symbols were spun by potential energy first stored in a spring-loaded mechanism wound and actuated by the pull of a traditional pull-arm handle. A mechanical device stopped each reel at a random position. The gaming machine senses an outcome, along a central payline, by sensing the position of each reel.

2-D video reels refer to the use of cartoonish animations that caricature reels on a single 2-D video device. The cartoonish animations do not intend to realistically portray actual mechanical reels, nor do they. Realistic simulation of mechanical reels, using embodiments described herein, refers to 2-D and/or 3-D hardware and/or software attempts to emulate actual mechanical reels. Their goal is to have a player perceive a real mechanical reel, at least partially. In particular, embodiments described herein contribute to the perception of a mechanically driven reel slot machine by emulating perceivable hardware features in a gaming machine. Briefly, one such hardware feature is the space between a silkscreen glass and the mechanical reels disposed behind the glass. Another optional hardware emulation includes actual lighting found in a mechanically driven reel slot machine. These and other embodiments will be described in further detail below.

The embodiments described herein use hardware and/or software to increase the perception that a processor-based gaming machine includes real mechanical reels. Old mechanical reel-based gaming machines have numerous mechanical attributes—such as mechanical parts and components, 3-D features, and imperfections—that are visibly perceivable and convey their identity. The inventor discovered that emulating many of these mechanical attributes can lead to the perception of real mechanical machine by a person who is near a processor-based machine.

In one embodiment, physical adaptation embodiments described herein add parallax and perspective to the visual display of video reels. This is described with respect to FIGS. 1A, 1B, and 2A-2C. In addition to physical adaptations, a gaming machine as described herein attempting to emulate a mechanically driven reel slot machine may also include contributions from other sources, such as audio and/or video adaptations, where each adaptation adds to the perception of a mechanically driven reel slot machine.

Audio adaptations may include: stereo audio that varies output audio based on video reel position in the gaming machine (e.g., audio for a left video reel is output and increasingly heard on a left side of a digital machine, while audio for a right video reel is increasingly heard on the right side of the machine), stereo recording and playback of actual mechanical sounds in a real mechanical reel machine, randomization of the actual mechanical sounds to avoid repetition of the same sounds, etc. Other audio adaptations are also suitable for use.

Video data may also be used to add to the perception of real reels. The video data embodiments simulate one or more perceived realistic visual attributes of a real mechanical reel in a gaming machine. Briefly, these perceived realistic visual attributes may include one or more of: outward bowing of video reel edges to simulate perceived curvature of an actual circular mechanical reel, variable lighting of video reel displays to simulate perceived reel curvature and out of plane dimensions of an actual curved reel, the inclusion of video simulations of mechanical components between the reel strips (e.g., latches and other mechanisms that a person can see in a mechanical reel gaming machine), backlight blinking of video reel symbols to simulate lighting used in old-fashioned mechanical systems, etc.

In another specific embodiment, video data provided to the distal video display device simulates a visible mechanical imperfection of a mechanical reel in a gaming machine. The visible mechanical imperfection refers to visible actions, attributes or behavior of a mechanical reel or one or more parts in a mechanical reel or gaming machine. The visible mechanical imperfection may be dynamic, meaning that the mechanical reel is moving when it displays the visible imperfection. Genesis of the visible imperfections often stem from peculiarities, realities, or imperfections in the mechanical device or system, such as loose machining tolerances, random variations which are characteristic of real systems, etc. For example, a simulated video reel may wobble or show lateral jitter in a direction orthogonal to the direction of spin to emulate this common occurrence in a real mechanical reel system. In another specific embodiment, the visible mechanical imperfection includes video reel kick-back, which emulates the dynamic bounce that a real mechanical reel commonly produces when stopped. Video reels may also spin at slightly different speeds to emulate their imperfect mechanical counterparts. Other video adaptations are also suitable for use.

Individually, each of these physical, audio and video adaptations may not create a full illusion of a mechanical reel machine. Cumulatively, however, when multiple of these adaptations are provided in a processor-based gaming machine, senses for a person near the gaming machine process numerous indications of a real mechanical reel machine, and the person may be at least partially or temporarily fooled into perceiving a real mechanical reel machine.

While embodiments described herein are not an exact replacement for a truly mechanical machine, they are believed to be a reasonable match that preserves some or most of the "look and feel" of mechanical reel-based machines. These digital machines may satisfy many players looking for a mechanical reel-based machine, while avoiding the associated costs and complexities of old mechanical machines, and permitting the benefits of digital machines. For example, processor-based video display devices permit easy reconfiguration of video output, including remote reconfiguration. The digital nature of the video display devices permits the reel game on a gaming machine to be changed using digital techniques. This allows symbols on the video reels to be changed to present a different reel game, if desired, or enables the number of reels depicted on the video display devices to be changed. Wireless or wired connection to the gaming machine also permits remote changes to games by downloading instructions for the changes.

Parallax refers to the effect whereby the positions of objects relative to each other appear to shift due to changes in the relative angular position of the observer attributable to motion of the observer. In other words, it is a perceived shift of an object relative to another object caused by a change in observer position. If there is no parallax between the two objects, then a person typically perceives them as side by side at the same depth. This addition of parallax helps the processor-based gaming machine better emulate the three dimensional nature of mechanical counterparts.

FIG. 1A illustrates parallax for a gaming machine with actual mechanical reels. A change in position from 21*a* to 21*b* changes the view of mechanical reels 74 due to parallax. Glass plate 72 includes screen printing or printed decals 75 attached to glass 72. Transparent windows in the screen printing were bordered by opaque sections 75 that partially blocked view of reels 74. A blind spot 77 spot results from an opaque section 75 blocking a portion of the person's field of view while in position 21*a*. A change in viewing position to 21*b* also changes obstruction based on the relative position between person 21, the opaque sections 75, and reels 74, thus hiding formerly visible portions of the mechanical apparatus—and revealing other portions (e.g., blind spot 77) blocked from view in the previous position.

In one embodiment, a gaming machine described herein adds 3D parallax to the visual display of video reels on a gaming machine. The gaming machine uses multiple layers of video display devices, and video data displayed on each device, to provide parallax. FIGS. 4A-4C show layered video display devices suitable for use herein. Hardware suitable for use in the layered displays will be discussed in further detail below with respect to FIGS. 4A-4C.

Figure 2A:
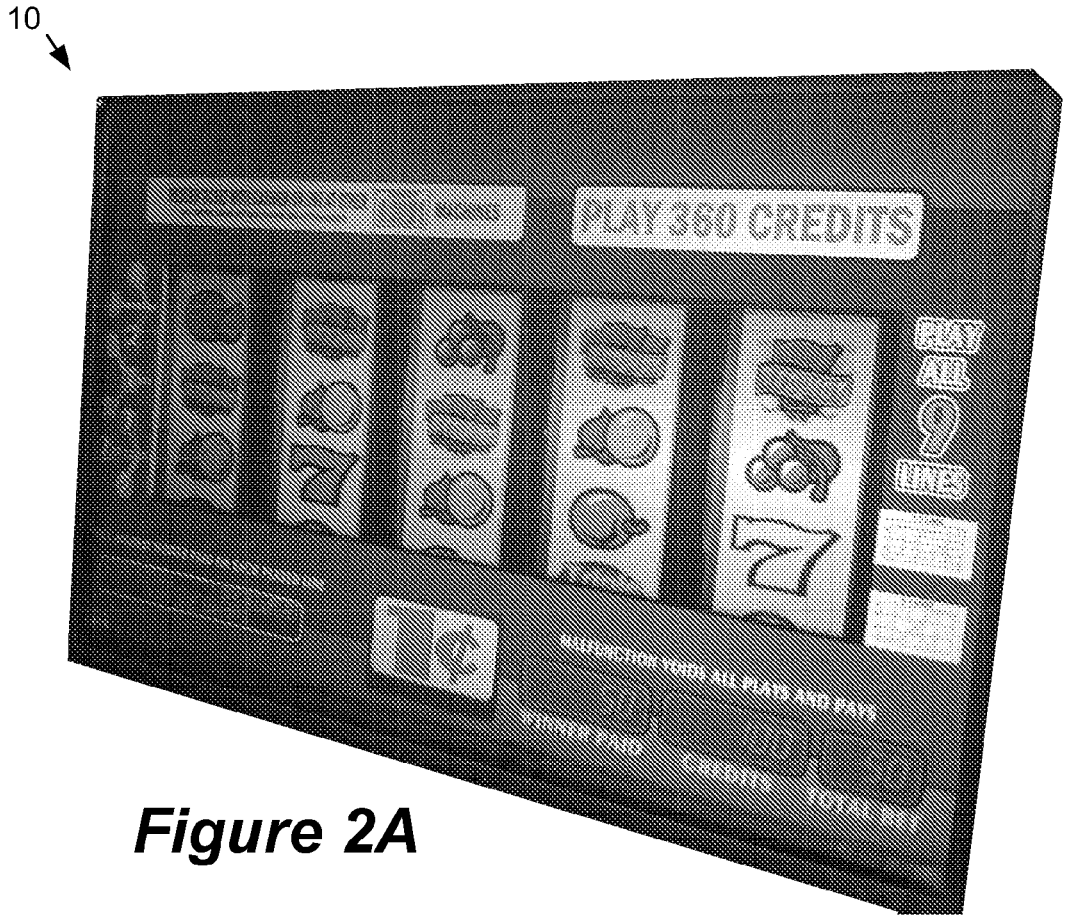
FIG. 2A shows video output on layered displays and configured to realistically simulate mechanical reels in accordance with one embodiment.
Figure 2B:
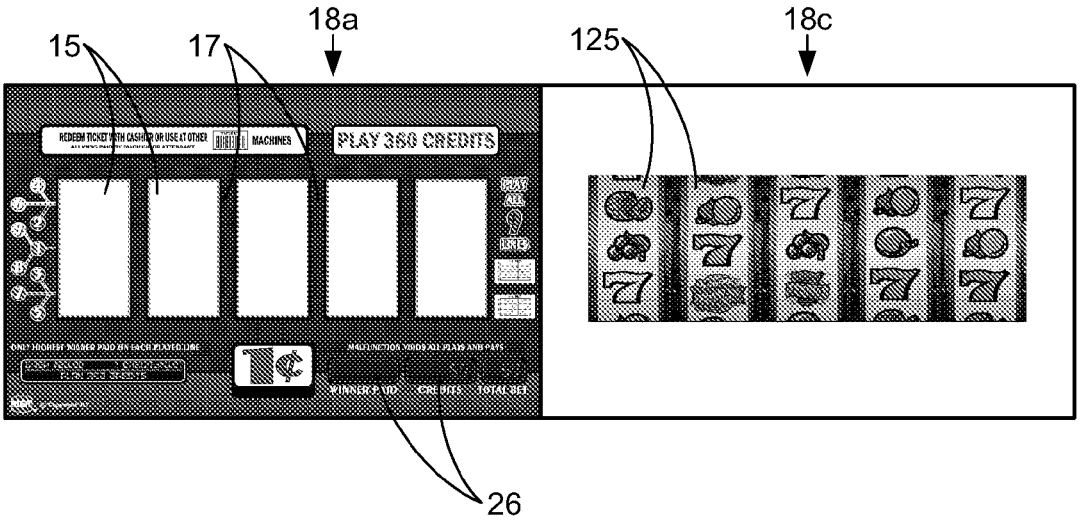
FIG. 2B shows the video output of FIG. 5A separated into front and back video for display on front and back displays, respectively, in accordance with one embodiment.

The layered display devices output video data that simulates a mechanical reel game. FIG. 2A shows video output on layered displays and configured to realistically simulate mechanical reels in accordance with one embodiment. FIG. 2B shows the video output of FIG. 2A separated into front and back video output, and for provision to front and back layered displays, in accordance with one embodiment. The front display device is referred to herein as proximate since it is nearer to a person in front of the gaming machine; the back display device is referred to herein as distal since it is farther from the person. While the present invention will now be shown as graphics for display on a video device, those of skill in the art will appreciate that the following discussion and Figures also refer to methods and systems for providing a game of chance and providing video data on a gaming machine.

As shown in FIGS. 2A and 2B, the layered displays (and video data presented on the layered displays) are configured to resemble a traditional mechanical slot machine—both a) spatially and b) using video provided to proximate display device 18*a* and video provided to distal display device 18*c*. In this case, as shown in FIG. 2B, proximate display device 18*a* outputs silkscreen video data that resembles a silk-screened glass, while distal display device 18*c* displays five video reels 125 that simulate and resemble traditional mechanical reels. Reels 125 "spin" during game play using changing video data provided to distal video display device 18*c*.

In this case, proximate display device 18*a* displays video graphics that mimics information printed or otherwise disposed (e.g., silkscreened) on a glass layer disposed in front of mechanical reels in a traditional mechanical machine. These video graphics may include any information shown a tradition silkscreen. To increase realism, the video information may also include glare lines and other depictions interaction of the silkscreen with an environment around a gaming machine. Additionally, heat, airborne contaminants including dust and smoke residue, and natural aging effects causes discoloration of portions of a traditional glass panel display, particularly to silkscreens or stickers placed on its inside surface. These effects may also be simulated in video. Video graphics for the stickers may also include video fraying and video discoloration (e.g., dirt that simulates age) to enhance the realistic simulation of a gaming machine with a traditional glass panel display. Unlike a traditional glass layer embodiment, however, video display device 18*a* permits displayed graphics to be changed by a gaming establishment, e.g., as desired to update, modify, or even animate the information.

Proximate video display device 18*a* may include other video data 26 that resembles one or more secondary displays located within or about the glass layer of a traditional mechanical gaming machine. The secondary displays often include one or more electronic displays, e.g., multi-segment LED, LCD, "Nixie tube", or other devices that provide numeric display. The video data on display device 18*a* may then simulate these devices, and convey the information typically displayed with them such as: a number of credits on account, a number of credits wagered on in a particular reel spin, a number of credits won on the previous reel spin, etc.

Proximate display device 18*a* includes transparent video window portions 15 that permit viewing of the virtual slot reels 125 that are shown on the distal video display device 18*c*. Transparent video window portions 15 may include portions of a transmissive LCD driven to indicate the color white (maximum available intensity of all colors). Video data provided to displays 18*a* and 18*c* is spatially configured such that a common line of sight passes through each video window portion 15 of proximate display device 18*a* to a video reel 125 of distal display device 18*c*. Typically, as shown in FIG. 2B, each video reel 125 is positioned on rear display device 18*c* such that it is centered within a transparent video window portion 15. This essentially duplicates the transparent windows present in a traditional fixed glass layer through which mechanical reels are viewed.

While a fixed glass is essentially transparent and attenuates only a negligible amount of the light passing through, the transmissive window portions 15 created in video display device 18*a* device reduce the intensity of light passing therethrough to a greater degree due to the optical composition and constraints of transmissive displays. This effect may be reduced by increasing the intensity of light incident upon the rear surface of the panel for video display device 18*a* so that the transmissive window portions 15 are perceived to be essentially transparent to a person.

Other peripheral portions of the exterior video display device 18*a* show a pay table, credit information, and other game relevant information, such as whether a bonus game or progressive game is available. Unlike a traditional mechanical machine where the silkscreened information is relatively permanent, this game relevant information may be changed by simply changing the video data provided to proximate video display device 18*a*.

Briefly referring to FIGS. 4A and 4B, a predetermined spatial distance "D" separates display screens for the layered video display devices 18*a* and 18*c*. As shown in FIG. 4A or 4B, the predetermined distance, D, represents the distance from the display surface of video display device 18*a* to display surface of video display device 18*b* (FIG. 4B) or video display device 18*c* (FIG. 4A). This distance may be adapted as desired by a gaming machine manufacturer. In one embodiment, the display screens are positioned adjacent to each other such that only a thickness of the display screens separates the display surfaces. In this case, the distance D depends on the thickness of the exterior display screen. In a specific embodiment, distance "D" is selected to minimize spatial perception of interference patterns between the screens. In one embodiment, D is greater than about 1 millimeter and less than about 10 centimeters. In a specific embodiment, D is less than about 1 centimeter. In another specific embodiment, D is between about 4 millimeters and about 1 centimeter. Other set distances may be used. The actual distance used between layered video displays may vary with a number of factors, such as the hardware used for the layered displays, the size of the gaming machine in the layered displays, video device technology type (e.g., LCD type) and other hardware attributes of the game machine such as door geometry.

This set distance improves perception of a three-dimensional device. First, spatially separating the devices 18*a* and 18*c* allows a person to perceive actual depth between video output on video display device 18*a* and video output on rear video display device 18*c*. The output of FIG. 2A shows a silkscreen on video display device 18*a* that is physically separated from the reels on rear video display device 18*c*, which emulates a real mechanical reel machine. This depth is as realistic and perceivable for a gaming machine of the present invention as it is for a traditional mechanically driven reel slot machine.

The layered displays add parallax to the processor-based gaming machine. More specifically, video portions 17 (FIG. 2B) permit an observer 21 to vary which portions of video display device 18*c* they see behind the portions 17 (FIGS. 1B and 2A)—based on a current position and viewing angle for the person. Video portions 17 include non-transparent video output for proximate video display device 18*a*. Non-transparent in this sense generally refers to opaque or translucent video output. Often, as mentioned above, video portions 17 resemble portions of a silkscreen sticker, which may be translucent depending on the amount of light inside the gaming machine and behind the silkscreen. When a person moves relative to video portions 17 and the gaming machine, lines of sight though window portions 15 change, which changes the portions of video display device 18*c* (FIG. 1B or 2B) that are visible. This grants true parallax and three-dimensional depth perception. Again, this helps the processor-based gaming machine emulate a traditional mechanically driven reel slot machine.

Figure 1B:
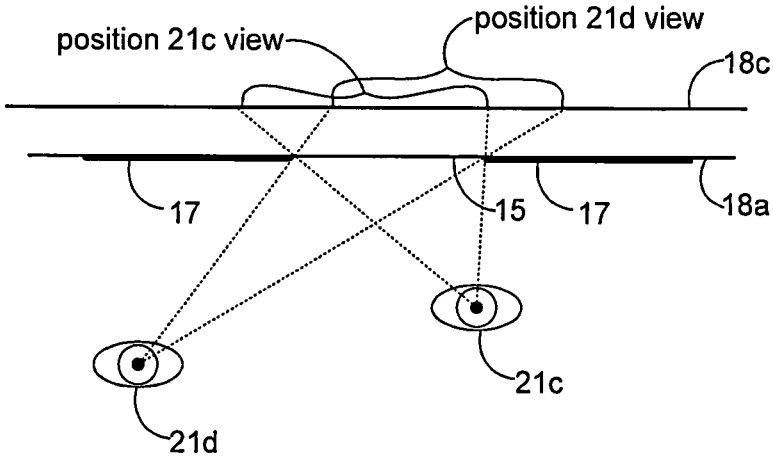
FIG. 1B shows a simple depiction of changing position in front of a mechanical reel gaming machine with windows on a front panel and the effect of changing position on visibility of a rear video display device.

As with a traditional mechanical reel apparatus, changes in player position will change the visible portions of video data shown on rear video display device 18*c* when viewed through a transparent window 15 on front video display device 18*a*. FIG. 1B shows a simple depiction of changing position between position 21*c* to position 21*d* in front of a video reel gaming machine with transparent video windows 15 on a front panel 18*a* and the effect of changing position on visibility of rear video display device 18*c*. This provides a degree of parallax which is unavailable with only one video display device. For example, the physical separation of video display devices 18*a* and 18*c* provides a degree of parallax which, among other things, allows an observer to peek underneath the edges of the windows 15 and bars 17, as one might do in a traditional mechanical machine.

Figure 2C:
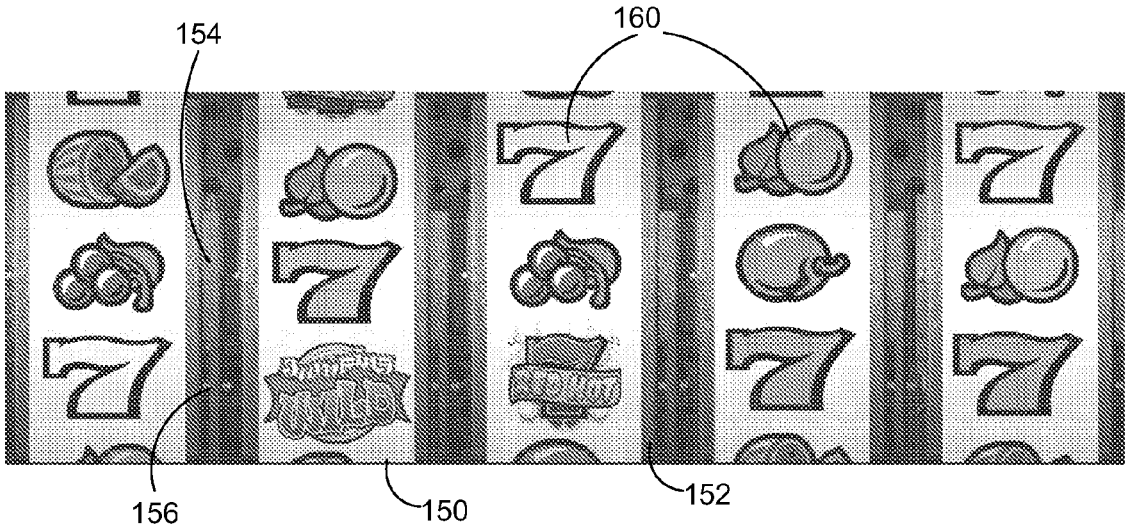
FIG. 2C illustrates the video data output on rear video display device of FIG. 2B in greater detail in accordance with a specific embodiment.

Realistic video data provided to the layered displays enhances the parallax and improves the emulation of a real reel gaming machine. FIG. 2C shows the video data output on rear video display device 18*c* in greater detail. The video data includes multiple video data adaptations to the video reels that each simulates a realistic visual attribute of a real mechanical reel in a gaming machine. Depending on the current position of a person standing in front of gaming machine 10, a person may see video data that simulates: a hardware reel 152 that each reel strip 150 appears to attach to, a rotary axis 154 that each hardware reel 152 appears to rotate about, a latching mechanism 156 that appears to stop each hardware reel 152 from rotating, along with other simulated internal mechanical components often found in a real mechanical reel gaming machine.

Thus, owing to the parallax resulting from the layered video display devices 18 and the ability for a person to see between and outside of the specific reel strips 150, video data provided to distal video display device 18*c* may include additional video data other than reel strips 150 and symbols on the reel strips to further promote the realistic depiction of an actual stepper machine. The video data adaptations may include, but are not limited to, edges of the reel 152 assemblies not covered by reel strips 150, portions of the mechanical apparatus supporting the rotating reels 152, background components (including, but not limited to, plates, covers, switches, levers, solenoids, latches, handles, and other similar items), stickers, labels, wires, and anything else that may normally be found inside a traditional reel gaming machine and that may be incidentally viewed by an observer peering through a transparent window on a fixed glass plate. Other mechanical components may be simulated in the video data adaptations provided to distal video display device 18*c*.

Lighting is another physical adaptation that may be emulated by a processor-based gaming machine.

First, the lighting affects perception of information on the outer glass layer. In one embodiment, the video data provided to the proximate video display device illuminates and enhances the simulated silkscreen image to include glare lines and other lighting artifacts for a smooth and shiny emulated surface. For example, glare lines and non-uniform illumination intensity of the artwork silkscreened upon a glass layer, which results from internal reflections and uneven internal lighting, may be deliberately incorporated into video artwork displayed by the proximate video display device.

Second, when a person stands in front of a mechanical reel gaming machine, light that strikes mechanical reels differentially illuminates the reels based on their outward dimensions.

In one embodiment, video data provided to the distal video display device illuminates and shades the video reels to simulate lighting of their mechanical counterparts. FIG. 3C shows simulated video preferential lighting of a reel strip in accordance with a specific embodiment. FIG. 2C shows an actual picture of simulated preferential lighting of video reels 152 and video reel strips 150 on a distal video display device 18*c* in accordance with a specific embodiment.

Reels in a mechanical stepper gaming machine may be illuminated by a variety of light sources that produce different lighting effects. In one embodiment, the video data emulates "back-lighting", which is a traditional mechanical reel lighting technique that uses incandescent, fluorescent, LED, or other light sources disposed within a circumference of the reel behind the reel strip. Back-lighting produces light that passes through translucent and transparent portions of a physical reel strip, including the gaps and white spaces between adjacent symbols. Older mechanical gaming machines often used a light bulb for this effect; newer machines may use one or more LEDs. The light is commonly focused in the direction of a player/observer, which creates a region of maximum brightness near the center of the strip, and tapers to a lesser brightness at the upper and lower edges. Reel angles also contribute to this effect: light passing through the center of the strip transmits through the reel strip material essentially normal to its surface, while light at the upper and lower portions passes through at an angle where the light propagation path length includes more reel strip material. As the normal path through the reel strip material involves less material than does the angled path, the light is attenuated less along the normal path and that region appears brighter. Circular geometry of the mechanical reels thus geometrically affects the light levels, and thus the back-lighting effect lends to the perception of curvature for a mechanical reel. FIG. 3C shows simulated video back-lighting of a reel strip in accordance with this embodiment.

In another specific embodiment, back-lighting gradually alters the luminance in reel strip 150 to resemble the geometrically effects of a circular reel. As shown in FIG. 3C, gradual reduction in reel strip luminance from the center 182 toward each of the upper and lower portions 184 and 186 simulates the effect of backlighting on a curved reel strip and conveys a degree of curvature. In this specific embodiment, the desired degree of luminance graduation depends upon a number of factors, including the overall brightness of the rest of the game images and video data, the radius of the reels 152 being simulated, the density and coloration of the symbols on the reel strips 150, the set distance between screens (D), the ambient illumination level to which the gaming machine will be subjected, and other factors that one of skill in the art will appreciate.

Thus, by artistically altering video data for the color, hue, luminance, brightness, or intensity of reel strip 150 of images provided to rear display device 18*c* to mimic the backlighting of an actual reel, a flat image on rear display device 18*c* produces a perceived curved appearance.

The back-lighting may occur at a variety of times during game play. When a winning outcome is displayed on a traditional machine, it commonplace to highlight the winning payline. This helps a player readily identify the winning outcome. One common technique involves blinking or flashing the symbols on the winning payline. In the all-video simulation, this effect may be replicated with a high degree of accuracy by varying or alternating the brightness, color balance, hue, saturation, gamma correction, or other characteristic of a video image to emulate mechanical performance.

Other simulated reel lighting techniques may be used. For example, light sources from above, such as ceiling lights, favorably illuminate outer (or protruding) and upper portions of a mechanical reel. Suitable simulated traditional reel lighting techniques may use: a single simulated light source for multiple reels 152 or reel strip 150, separate simulated light sources for each reel 152, separate simulated light sources for each symbol on a reel strip 150, or a combination of these techniques.

Figure 1C:
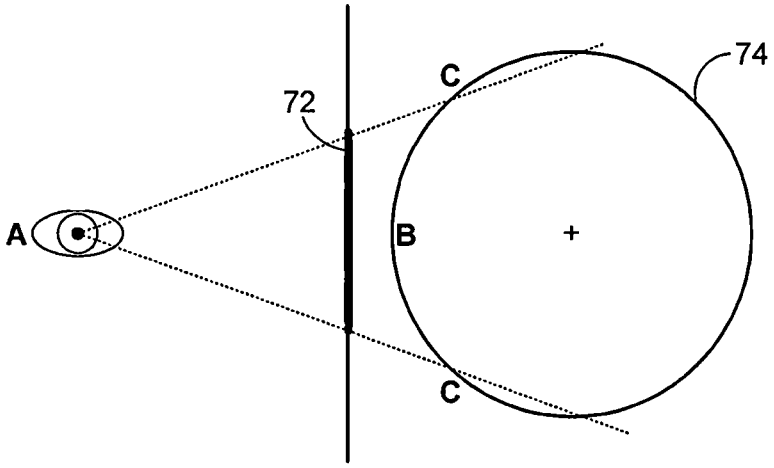
FIG. 1C shows a simple depiction of perspective for curved mechanical reels when viewing from in front of a mechanical reel gaming machine.
Figure 1D:
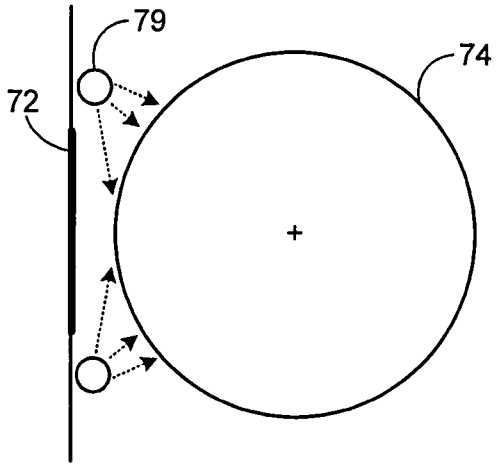
FIG. 1D shows a fore-lighting technique used in some mechanical reel gaming machines with opaque reel strips.

Other methods of highlighting reel strips are also contemplated. Some mechanical reel strips are generally opaque and use lighting applied to a front surface of the reels, in lieu of back-lighting. This is referred to as fore-lighting. FIG. 1D shows a fore-lighting technique used in some gaming machines with opaque reel strips. A common traditional way to achieve fore-lighting uses of fluorescent tubes 79 disposed between the fixed glass panel 72 and reels 74; each tube 79 runs above and parallel to the reels 74 and behind the transparent reel windows in the fixed glass plate 72. This provides strong illumination for reel 74 surfaces closest to the top and bottom window edges, which are also close to the fluorescent tubes 79. However, since the central portion of reel 74 is disposed farther from each light source 79, the intensity at that greater distance is less than at the reel surfaces disposed closer to the light. In addition, the curvature of the reel 74 surface effectively produces a shadowing effect for each of the two light sources on an opposite side of the reel 74 to the light source, which may also be simulated in video to increase mechanical emulation. FIG. 1D shows that the light from each source 79 approaches a "grazing" path at the center of reel 74 before its curvature results in shadowing. This results in a lower level of illumination for the center of reel 74 than for its upper and lower portions, creating a gradient opposite that of the backlit reel scenario. While back-lighting exhibits a relatively brighter region near the center of a reel, front-lighting results in a darker area around the reel center.

In a specific embodiment, the simulated reel video data assumes that illumination of uses light sources above or in front of the video reels 152. This preferentially illuminates top and bottom portions of the video reel and reduces luminance for a central portion of the reel and reel strip. In this case, the simulation adds shading to a central portion of reel strip 150, while the simulation adds illumination to top and bottom portions and, respectively, relative to an average luminance for the video data on the reel strip 150. More specifically, a central portion 182 includes relatively less luminance than the average luminance for reel strip 150. Upper and lower portions 184 and 186 each include a higher luminance than the average luminance for reel strip 150. The amount of additional luminance for top and bottom portions will vary with a number of factors such as: how much a designer wants this effect to be perceived, size of the reel being mimicked, etc.

Fore-lighting creates another differential lighting effect that may be simulated in video. This front-lighting effect can be simulated by altering the color, hue, luminance, brightness, or intensity of the reel strip images on display device 18*c*. The brightness settings at the reel center and edges depend upon a number of factors, including the overall brightness of the rest of the game images, the radius of the reels being simulated, the ratio of the reel radius to the size of the transparent reel window, the reflectivity of the reel strip material being simulated, the density and coloration of the symbols on the reel strips, the ambient illumination level to which the gaming machine will be subjected, etc.

Other lighting techniques may be employed to convey a sense of curvature to the video reels 152. In general, this may include adapting the color, hue, luminance, brightness, and/or intensity of the video data in a reel strip image.

Video lighting also provides visual enhancement possibilities that have not been implemented in traditional gaming machines. The ability to manipulate images in video empowers a video simulation in unpractical ways for a traditional machine. For example, a traditional apparatus has difficulty highlighting a particular symbol with a particular color of light so as to temporarily change the overall color scheme of that symbol. The presence of white light illuminating adjacent symbols tends to bleed into the highlighted symbols and wash out any specially intended color, which diminishes the effect. While possible, reducing the undesired bleed requires a more intricate backlighting system, which increases machine cost and complexity. In a video simulation, however, the game designer can easily alter the color of any portion or portions of the symbol, so alternating between the original and altered images will create a blinking effect based on color in lieu of, or in addition to, blinking based on luminance intensity. Even though this is difficult to achieve in the actual mechanical stepper, the effect can be artistically manipulated in video to appear very mechanical and realistic so that the player's illusion of playing a traditional machine is not contradicted by this effect.

Other methods of highlighting reel strips are also contemplated. Some mechanical reel strips are generally opaque and use lighting applied to a front surface of the reels, in lieu of back-lighting. FIG. 1D shows a fore-lighting technique used in some gaming machines with opaque reel strips. A common way to achieve this fore-lighting uses of fluorescent tubes 79 disposed between the fixed glass panel 72 and reels 74; each tube 79 runs above and parallel to the reels 74 and behind the transparent reel windows in the fixed glass plate 72. This provides strong illumination for reel 74 surfaces closest to the top and bottom window edges, which are also close to the fluorescent tubes 79. However, since the central portion of reel 74 is disposed farther from each light source 79, the intensity at that greater distance is less than at the reel surfaces disposed closer to the light. In addition, the curvature of the reel 74 surface effectively produces a shadowing effect for each of the two light sources on an opposite side of the reel 74 to the light source, which may also be simulated in video to increase mechanical emulation. FIG. 1D shows that the light from each source 79 approaches a "grazing" path at the center of reel 74 before its curvature results in shadowing. This results in a lower level of illumination for the center of reel 74 than for its upper and lower portions, creating a gradient opposite that of the backlit reel scenario. While back-lighting exhibits a relatively brighter region near the center of a reel, front-lighting results in a darker area around the reel center.

A processor-based gaming machine as described herein may also provide video data that adds perspective. Perspective, in the context of vision and visual perception, is the way in which objects appear to the eye based on their spatial attributes or their dimensions and the position of the eye relative to the objects. Perspective is a function of the position of a person relative to a gaming machine and affects what the person sees. Two common examples of perspective include: 1) objects appear smaller as their distance from the observer increases; and 2) objects appear distorted when viewed at an angle (spatial foreshortening). Other characteristics of perspective are also suitable for exploitation in an accurate video simulation of a mechanical gaming machine.

FIG. 1A also shows a change in perspective for a real gaming machine with reels. When a person stands or sits in front of the gaming machine and laterally central to the horizontal width in position 21*a*, inner sides 74*a* of the outer reels 74 are visible. When person 21 moves laterally in front of the gaming machine to a position 21*b* that is not centrally perpendicular to the axis of rotation for reels 74, side portions of different reels 74 become visible.

In one embodiment, a gaming machine adds perspective by displaying video data that includes perspective. The perspective video data provides an approximate representation, on a flat surface (such as a video screen for video display device 18*c*), of an image as it is perceived by the eye in three dimensions. The perspective video data may then be augmented by the parallax gained by the layered displays 18.

A person standing in front of a gaming machine and looking at a traditional mechanical reel benefits from depth perception of the three dimensional curved reel. As a result, an actual mechanical reel is often perceived with a slight biconcave shape on its lateral edges. In a specific embodiment, a video reel includes a slight outward bowing of the lateral sides of the video reel to better simulate its mechanical counterpart. This outward bowing is only slightly done; this effect is also included in the video data of reels 125 of FIGS. 2A-2C, and shown for video reel 150 in FIG. 3A.

In general, objects that subtend a greater angle at the human eye are perceived to be closer than objects that subtend a smaller angle. Referring to FIG. 1C, since the center B of reel 74 is closer to an observation point A than are the upper and lower edges C of viewable portion of reel 74, the human visual processing subconsciously expects a uniform-width reel strip to appear wider at the closest point B than at the edge points C. This apparent variation in width depends on the distance difference between the observer and the center and edge viewing points. The absence of this bowing and slight curvature will be noticeable to observers if they are attempting to ascertain whether the reel strip is genuine or merely an image, or it may just create enough of a visual inconsistency that the observer senses that "something just isn't right" without being able to identify the specific anomaly. By providing a suitable degree of bowing or convexity to the lateral edges of video reel strip 150 video data on video display device 18*c*, a person's visual expectation may be fulfilled.

For video reel 150, an excessive amount of curvature 172 is undesirable. Too much curvature 172 is typically immediately recognizable as unrealistic and destroys the illusion of a real reel. In some cases, too much curvature 172 tends to make the video reel seem balloon-like and cartoonish. Experimentally, an un upper bound on curvature 172 was determined when the bowing and outward curvature transitioned from barely noticeable to excessive, at which point the reel strip 150 images appeared cartoonish. In one embodiment, the upper limit of reel width curvature (after which the reels transition in perception from quasi-realistic to cartoon-like) is such that a reel strip width at a central portion 182 is greater than a width for bottom and top portions 184 and 186 by less than about 5 percent. For example, if reel strip 150 includes a center width of 160 millimeters wide, then reel strip 150 width at the top and bottom edges may be no less than about 152 millimeters. In a specific embodiment, a reel strip width at a central portion 182 is greater than a width for bottom and top portions 184 and 186 by less than about 2 percent to about 3 percent. Thus, the amount of curvature 172 is slight: enough to create the perceived effect, but not too much.

The video data may also include simulated perspective in the reel symbols. In a specific embodiment, shape of a symbol 160 on a reel strip 150 depends on its position on reel 152. FIG. 3B shows a graphical simplification of this simulated perspective (the effect is amplified for discussion); the symbols in FIG. 2C also includes this effect to a more realistic effect.

The same perceived 'size-versus-viewing distance' phenomenon discussed above with respect to FIG. 1C also affects symbols printed on a reel strip. Referring back to FIG. 1C, reel 74 curvature affects the difference in distance at the extreme edges C of the visible portion of the reel. Symbol B, located at the center of the reel, is unaffected by this phenomenon because its upper and lower edges are approximately equidistant from the observer.

Referring to FIG. 3B, the lower edge of a symbol 170*a*, located at the uppermost portion of reel strip 150 (and a transparent reel window 15 of video display device 18*a*, but not shown), is closer to a person standing in front of the gaming machine and more normal to the person's view than the upper edge of the symbol 170*a*. Correspondingly, the lower edge of symbol 170*a* appears slightly larger to the player than the upper edge, which is farther away.

Re-creating this perspective effect in the all-video simulation may be accomplished by introducing a measure of "keystoning" to the symbols. As shown in FIG. 3B, upper symbol 170*a* and lower symbol 170*c* have been given a slight trapezoidal shape, as compared with the non-keystoned middle symbol 170*b*, that conveys the sensation that the extreme edges are farther away than are the edges disposed closer to the center of the reel. This adds to the perceived sensation of curvature of video reel 152 by altering the shape of each symbol 170, depending on the position of each symbol 170 on the reel. The amount of keystoning may use the width ratios used for video reel strip 150 described above. More specifically, the width of each symbol 170 at a particular position on strip 150 may be reduced by the ratio of the width of its current position to the maximum lateral width at central portion 182. In one specific embodiment, implementation of this technique uses multiple versions of each reel symbol 170 in game memory, where a slightly different version with appropriate geometric modification is used for each different reel rotational position. For example, in a game with three horizontal paylines, a distinct version of each symbol may be used for the upper, center, and lower paylines, respectively. In another specific embodiment, symbol 170 is resized in real time by altering physical dimensions of symbol 170 using a scalar based on rotational position for symbol 170 on the reel 152.

In one embodiment, the realistic video adaptations described above are output on a gaming machine having a single video display device that outputs video information for a game. As the term is used herein, a video display device refers to any device configured to output a visual image in response to a control signal. In one embodiment, the video display device includes a screen of a finite thickness, also referred to herein as a display screen. For example, LCD video display devices often include a flat panel that includes a series of layers, one of which includes a layer of pixilated light transmission elements for selectively filtering red, green and blue data from a white light source. Each video display device is adapted to receive signals from a processor, video processor or controller included in the gaming machine and to generate and display graphics and images to a person near the gaming machine. The format of the signal will depend on the device. In one embodiment, all the video display devices in a layered arrangement respond to digital signals. For example, the red, green and blue pixilated light transmission elements for an LCD device typically respond to digital control signals to generate colored light, as desired.

In another embodiment, the gaming machine includes multiple video display devices arranged in a common line of sight relative to a person near the gaming machine. Multiple video display devices disposed along a common line of sight are referred to herein as 'layered' displays. In one embodiment, the gaming machine includes two video display devices, including a first, foremost or exterior video display device and a second, underlying or interior video display device. For example, the exterior video display device may include a transparent LCD panel while the interior video display device includes a second LCD panel.

Referring primarily now to FIGS. 4A and 4B, a gaming machine 10 of a specific embodiment with layered displays includes a cabinet or housing 12 that houses exterior video display device 18*a*, intermediate video display device 18*b* (FIG. 4B only), interior video display device 18*c* and a touchscreen 16.

Layered display devices may be described according to their position along a common line of sight relative to a viewer. As mentioned before, 'proximate' refers to a display device that is closer to a person, along a common line of sight (such as 20 in FIG. 4A), than another display device, while 'distal' refers to a display device that is farther from a person, along the common line of sight, than another. While the layered displays of FIGS. 4A and 4B are shown set back from touchscreen 16; this is for illustrative purposes and the exterior display device 18*a* may be closer to touchscreen 16.

The video display devices, however, permit digital output and all its benefits. For example, the digital domain permits external loading and changing of simulated reel games. This permits a casino or gaming establishment to change video on each of the layered video display devices, and their transparency, without physically altering the gaming machine or requiring maintenance. Thus, the number of virtual slot reels 125 may be changed from 3 to 5 to 9, or some other number. In this case, the intermediate and exterior video display devices change the position of their transparent window portions 15 for viewing of the different number of virtual slot reels. Symbols on each virtual slot reel 125 may also be changed. Also, a pay table shown on video display device 18*a* may be changed at will, in addition to changing whether a bonus or progressive game is shown on the intermediate video display device. This permits the same gaming machine to play new games simply by downloading a data onto the machine. For a mechanical machine, this game change traditionally required manual and mechanical reconfiguration of a gaming machine, e.g., to change the number of reels for new reel game that requires five reels instead of three.

Referring to FIGS. 4A, 4B and 6, layered displays and their operation will be further described. Processor 432 controls the operation of components in gaming machine 10 to present one or more games, receive player inputs using the touchscreen 16, and control other gaming interactions between the gaming machine and a person 21. Under the control of processor 432, video display devices 18 generate visual information for game play by a person 21. As shown in FIG. 4A, there are two layered video display devices 18: a first, exterior or frontmost video display device 18*a*, and a backmost video display screen 18*c*. As shown in FIG. 4B, there are three layered video display devices 18: frontmost video display device 18*a*, a second or intermediate video display device 18*b*, and a backmost video display screen 18*c*. The video display devices 18*a*, 18*b* and 18*c* are mounted and oriented within the cabinet 12 in such a manner that a straight and common line of sight 20 intersects the display screens of all three video display devices 18*a*, 18*b* and 18*c*. In addition, video display devices 18*a*, 18*b* and 18*c* are all relatively flat and aligned about in parallel to provide a plurality of common lines of sight that intersect screens for all three.

The gaming machine may also include one or more light sources. In one embodiment, video display devices 18 include LCD panels and at least one light source that provides light, such as white light, to the pixilated filter elements on each LCD panel. For example, a back lighting source (not shown) may be positioned behind video display device 18*c*. The pixilated panel for each parallel video display device 18*a*, 18*b* and 18*c* then filters white light from the backmost backlight to controllably output color images on each screen.

Other light sources may be used to illuminate a reflective or transmissive light filter. For example, each video display device 18 may be individually illuminated using a white light source attached near the sides (top, bottom, left, and/or right) of each pixelating panel; the side light source may include a mini-fluorescence source and light guide that transmits light from the side light source, down the flat panel, and to all the pixilated filter elements in the planar LCD panel for pixilated image production. Other suitable light sources may include cold cathode fluorescent light sources (CCFLs) and/or light emitting diodes, for example.

In another embodiment, a distal and emissive video display device is arranged behind a proximate and non-emissive video display device and provides light to the proximate video display device, which then filters the light to create an image. For example, a flat OLED or plasma video display device 18*c* may be used to a) produce an image and b) to emit light that is filtered by LCD panels 18*a* and 18*b*. In this case, the distal and emissive video display device emits at least some white light. For example, video output of one or more reels may include significant white light that is also used to illuminate one or more LCD panels for pixilated filtering. In another embodiment, the proximate LCD panels use reflective light where the light comes from in front of the gaming machine, e.g., from the ambient room.

The proximate video display devices 18*a* and 18*b* each have the capacity to be partially or completely transparent or translucent. In a specific embodiment, the relatively flat and thin video display devices 18*a* and 18*b* are liquid crystal video display devices (LCDs). Other display technologies are also suitable for use. Various companies have developed relatively flat video display devices that have the capacity to be transparent or translucent. One such company is Uni-Pixel Displays, Inc., Inc. of houston TX, which sells display screens that employ time multiplex optical shutter (TMOS) technology. This TMOS display technology includes: (a) selectively controlled pixels that shutter light out of a light guidance substrate by violating the light guidance conditions of the substrate and (b) a system for repeatedly causing such violation in a time multiplex fashion. The display screens that embody T MOS technology are inherently transparent and they can be switched to display colors in any pixel area. A transparent OLED may also be used. An electroluminescent display is also suitable for use with proximate video display devices 18*a* and 18*b*. Also, Planar Systems Inc. of Beaverton Oreg. and Samsung of Korea, both produce several video display devices that are suitable for use herein and that can be translucent or transparent. Kent Displays Inc. of Kent Ohio also produces Cholesteric LCD video display devices that operate as a light valve and/or a monochrome LCD panel.

FIG. 4C shows another layered video display device arrangement in accordance with a specific embodiment. In this arrangement, a touchscreen 16 is arranged in front of an exterior LCD panel 18*a*, an intermediate light valve 18*e* and a curved video display device 18*d*.

A common line of sight 20 passes through all four layered devices. As the term is used herein, a common line of sight refers to a straight line that intersects a portion of each video display device. The line of sight is a geometric construct used herein for describing a spatial arrangement of video display devices. If all the proximate video display devices are transparent along the line of sight, then a person should be able see through all the video display devices along the line of sight. Multiple lines of sight may also be present in many instances.

Light valve 18*e* selectively permits light to pass therethrough in response to a control signal. Various devices may be utilized for the light valve 18*e*, including, but not limited to, suspended particle devices (SPD), Cholesteric LCD devices, electrochromic devices, polymer dispersed liquid crystal (PDLC) devices, etc. Light valve 18*e* switches between being transparent, and being opaque (or translucent), depending on a received control signal. For example, SPDs and PDLC devices become transparent when a current is applied and become opaque or translucent when little or no current is applied. On the other hand, electrochromic devices become opaque when a current is applied and transparent when little or no current is applied. Additionally, light valve 18*e* may attain varying levels of translucency and opaqueness. For example, while a PDLC device is generally either transparent or opaque, suspended particle devices and electrochromic devices allow for varying degrees of transparency, opaqueness or translucency, depending on the applied current level.

In one embodiment, the gaming machine includes a touchscreen 16 disposed outside the exterior video display device 18*a*. Touchscreen 16 detects and senses pressure, and in some cases varying degrees of pressure, applied by a person to the touchscreen 16. Touchscreen 16 may include a capacitive, resistive, acoustic or other pressure sensitive technology. Electrical communication between touchscreen 16 and the gaming machine processor enable the processor to detect a player pressing on an area of the display screen (and, for some touchscreens, how hard a player is pushing on a particular area of the display screen). Using one or more programs stored within memory of the gaming machine, the processor enables a player to activate game elements or functions by applying pressure to certain portions of touchscreen 16. Several vendors known to those of skill in the art produce a touchscreen suitable for use with a gaming machine. Additionally, touchscreen technology which uses infrared or other optical sensing methods to detect screen contact in lieu of pressure sensing may be employed, such as the proprietary technology developed by NextWindow Ltd. of Aukland, New Zealand.

Rear video display device 18*d* includes a digital video display device with a curved surface. A digital video display device refers to a video display device that is configured to receive and respond to a digital communication, e.g., from a processor or video card. Thus, OLED, LCD and projection type (LCD or DMD) devices are all examples of suitable digital video display devices. E Ink Corporation of Cambridge Mass. produces electronic ink displays that are suitable for use in rear video display device 18*d*. Microscale container video display devices, such as those produced SiPix of Fremont Calif., are also suitable for use in rear video display device 18*d*. Several other suitable digital video display devices are provided below.

Referring to FIGS. 2A and 2B, window portions 15 of proximate video display device 18*a* are significantly transparent or translucent. The window portions 15 may be any suitable shape and size and are not limited to the sizes and arrangements shown. Pixilated element panels on many non-emissive displays such as LCD panels are largely invisible to a viewer. More specifically, many display technologies, such as electroluminescent displays and LCD panels, include portions that are transparent when no video images are displayed thereon. For example, an electroluminescent display may utilize non-organic phosphors that are both transparent and emissive (such as a tOLED), and addressed through transparent row and column drivers. Pixilated element panels on LCD panels are also available in significantly transparent or translucent designs that permit a person to see through the pixilated panels when not locally displaying an image.

If used, corresponding portions of touchscreen 16 and light valve 18*e* along the lines of sight for portions 15 are also translucent or transparent, or alternatively have the capacity to be translucent or transparent in response to control signals from a processor included in the gaming machine. When portions (or all) of the screens for touchscreen 16, video display devices 18*a* and 18*b*, and light valve 18*e* are transparent or translucent, a player can simultaneously see images displayed on the display screen 18*a* (and/or 18*b*)—as well as the images displayed on the interior video display devices 18*c*—by looking through the transparent portions 15 of proximate video display devices.

In another embodiment, the layered displays in a gaming machine include a design or commercially available unit from Pure Depth of Redwood City, Calif. The Pure Depth technology incorporates two or more LCD displays into a physical unit, where each LCD display is separately addressable to provide separate or coordinated images between the LCDs. Many Pure Depth display systems include a high-brightened backlight, a rear image panel, such an active matrix color LCD, a diffuser, a refractor, and a front image plane; these devices are arranged to form a stack. The LCDs in these units are stacked at set distances.

Additional planar elements may be interposed between the proximate and distal video display devices. These elements may consist of various films and/or filters that alter the optical characteristics of light, after passing through the distal transmissive video display device, and before it reaches a rear surface of the proximate transmissive video display device. The digital nature of a display panel decomposes an analog image into a series of discrete colored picture elements, known as "pixels", which normally combine seamlessly and are interpreted by the eye as equivalent of their analog original format. However, when more than one digital image is disposed along a common line of sight, undesired visual artifacts may result from the alignment of the pixels in the digital images—since one panel is essentially viewed through the other. A change in either of the images or in the viewing position may create an interference pattern which may appear as a moving or strobing effect on the images and, in many cases, may degrade them. One such effect, known as moiré, is very similar to the interference effects produced by multiple transmissive digital video display devices.

To reduce visual effects attributable to multiple transmissive digital video display devices, interstitial elements may be placed between the devices to diminish the digital nature of the image output by a distal display. By partially obscuring the individual pixels and blending them into a more analog-like visual image, the potential for undesired visual interference patterns may be reduced to an imperceptible level. Further, other optical properties, including but not limited to the polarization and color balance of the light passing between the transmissive digital video display devices, may be controlled using a film or panel disposed within the gap between video display devices.

The layered video display devices 18 may be used in a variety of manners to output games on a gaming machine. In some cases, video data and images displayed on the video display devices 18*a* and 18*c* are positioned such that the images do not overlap (that is, the images are not superimposed). In other instances, the images overlap. It should also be appreciated that the images displayed on the display screen can fade-in fade out, pulsate, move between screens, and perform other inter-screen graphics to create additional affects, if desired.

In a specific embodiment, video display devices 18 display co-acting or overlapping images to a person. For example, front video display device 18*a* (or 18*b*) may display paylines in transparent portions 15 that illuminate winning combinations of reels 125 disposed on video display devices 18*c*.

In another specific embodiment, layered video display devices 18 provide 3D effects. A gaming machine may use a combination of virtual 3D graphics on any one of the video display devices—in addition to 3D graphics obtained using the different depths of the layered video display devices. Virtual 3D graphics on a single screen typically involve shading, highlighting and perspective techniques that selectively position graphics in an image to create the perception of depth. These virtual 3D image techniques cause the human eye to perceive depth in an image even though there is no real depth (the images are physically displayed on a single display screen, which is relatively thin). Also, the predetermined distance, D (between display screens for the layered video display devices) facilitates the creation of 3D effects having a real depth between the layered video display devices. 3D presentation of graphic components may then use a combination of: a) virtual 3D graphics techniques on one or more of the multiple screens; b) the depths between the layered video display devices; and c) combinations thereof. The multiple video display devices may each display their own graphics and images, or cooperate to provide coordinated visual output. Objects and graphics in a game may then appear on any one or multiple of the video display devices, where reels and other graphics on the proximate screen(s) block the view objects on the distal screen(s), depending on the position of the viewer relative to the screens. This provides actual perspective between the graphics objects, which represents a real-life component of 3D visualization (and not just perspective virtually created on a single screen).

In another specific embodiment, the multiple video display devices output video for different games or purposes. For example, the interior video display device may output a reel game, while the intermediate video display device outputs a bonus game or pay table associated with the interior display, while the exterior and foremost video display device provides a progressive game or is reserved for player interaction and video output with the touchscreen. Other combinations may be used.

Reel games output by the video display devices may include any video game that portrays one or more reels. Typically, the gaming machines simulates 'spinning' of the video reels using motion graphics for the symbols on the reel strips and motion graphics for the mechanical components.

Controlling transparency of the outer one or two video display devices also provides game presentation versatility on a single gaming machine. In one embodiment, an outer or intermediate video display device acts as a light valve that controls whether the interior video display device is visible, or what portions of the interior video display device are visible. For example, window portions of the intermediate video display device may be left transparent to permit viewing of a select number video reels arranged behind the light valve.

In another embodiment, the outer video display device completely blocks out the interior video display device, where the outermost video display device is now solely visible and used for game presentation. The gaming machine now resembles a conventional gaming machine that only includes a single LCD panel. The gaming machine may then respond to digital controls to switch between a reel game, a multi-layer/multi-display game, and a simple one-panel LCD game. Other uses of the layered displays are possible and contemplated.

Gaming machine 10 uses the layered video display devices 18 to show visual information on the different screens that a player can simultaneously see. Additional sample game presentations and uses of the layered video display devices will now be discussed.

In another specific example, the gaming machine generates a game image on a distal video display device and a flashing translucent image on a proximate video display device. The game could for example, be reels or one or more wheels, and a flashing image on the proximate display could be a translucent line that indicates the payline(s) on the reels. Since some games permit multiple paylines based on the person's wager, this permits the game to show multiple paylines responsive to the person's actions. Alternatively, the proximate display may show a symbol or message that provides a player with helpful information such as a hint for playing the game. Notably, each of these examples allows the person to play the game while viewing the flashing image without having to change his or her line of sight or having to independently find such information from another portion of the gaming machine.

In one embodiment, the gaming machine presents different game types on the layered video display devices. For example, the interior and backmost video display device may output a main game with reels 125 while a proximate video display device shows a bonus game or progressive game. The bonus game or progressive game may result from playing the main game. Again, this permits the player to play the game while viewing a flashing bonus image without having to change his or her line of sight or having to independently find such information from another portion of the gaming machine.

Visual information on each of the distal screens remains visible as long as there are transparent or semi-transparent portions on the proximate screens that permit a user to see through these portions. Transparent portions may be selectively designed and timely activated according to game design, and changed according to game play. For example, if a game designer wants a person to focus on a bonus game on the front screen, they can use an intermediate light valve to black out a distal reel game.

In one embodiment, the layered video display devices are all-digital and permit reconfiguration in real time. This permits new or different games to be downloaded onto a gaming machine, and reconfiguration of the three video display devices to present a new or different game using any combination of the video display devices. Game aspects changed in this manner may include: reel symbols, the paytable, the game theme, wager denominations, glass plate video data, reel strips, etc. For a casino, or other gaming establishment, this permits a single gaming machine to offer multiple games without the need for gaming machine maintenance or replacement when a new game is desired by casino management or customer demand. On one day, the gaming machine may offer games using all the layered video display devices. The next day, the same gaming machine may offer a game that only uses an outer LCD panel and touchscreen, where a shutter (or other technology on front display) blocks out the back video display devices. Some other subset of the layered displays may also be used. This permits dual-dynamic video display device reconfiguration and/or game reconfiguration, at will, by downloading commands to the gaming machine that determine a) what game(s) is played, and b) what video display device(s) is used. For example, this allows the same gaming machine to run a reel game one day and a video poker game another day that uses some subset of the video display devices.

This reconfiguration of video display devices used and games also enables new uses for gaming machines. Traditionally, a casino or other gaming establishment purchased a gaming machine and offered games only according to its display capabilities. If a casino purchased 250 gaming machines that only had LCD panels, and then later decided they wanted to implement reel games or other games that required more than an LCD panel, they were forced to purchase new gaming machines. Gaming machine 10, however, solves this problem for a casino. Accordingly, gaming machines as described herein permit a gaming establishment to switch the number of video display devices used by a gaming machine to display a game.

One business advantage of this dual-dynamic display device reconfiguration and/or game reconfiguration is navigating gaming regulations imposed by different jurisdictions, which often change over time. First, each jurisdiction imposes its own set of rules on what games are locally permissible. Second, gaming regulators in each jurisdiction often change the local rules. This is particularly common for new gaming regulators and jurisdictions allowing casinos for the first time. The new gaming regulators may only permit class 2 games at first (e.g., bingo) and later permit class 3 games (video poker and reel games, one year later). Gaming machine 10 allows a casino in this jurisdiction to adapt, instantly, to a regulations change with a) new games and b) new display device arrangements that were already on gaming machine 10 but not previously used. Thus, when some jurisdictions limit the number and types of games that can be played, gaming machines described herein allow a casino to switch games—on the fly without significant gaming machine maintenance or downtime in the casino—when jurisdiction rules change.

Additionally, the enhanced utility and regulatory acceptance of a viable stepper simulation using video in lieu of mechanical reels permits mechanical-simulated games in new environments. Some jurisdictions do not permit the use of actual mechanical reel machines but do allow all forms of video-based gaming machines, which permits embodiments described herein to service mechanical reel customers in these jurisdictions.

One of the video display devices in a layered arrangement may also output live video such as television or a movie (or parts of either). For example, the television or movie video may be output on a rear display while a game is played on a proximate display. This permits a person to watch television or a movie while playing a game at a gaming machine, without changing position or line of sight to switch between the game and live video. The live video may also be related to the game being played to enhance enjoyment of that game, e.g., a science fiction movie related to a science fiction game being played or a 1960's television show related to a 1960's television game. The video may also play commercials for the gaming establishment, such as advertisements and infomercials for businesses related to a casino or businesses that pay for the advertising opportunity. Advertisements may include those for a local restaurant, local shows, -house offers and promotions currently offered, menus for food, etc.

Embodiments described herein may be implemented on a wide variety of gaming machines. For example, the video reels may be output by a gaming machine as provided by IGT of Reno, Nev. Gaming machines from other manufacturers may also employ embodiments described herein. FIGS. 5A and 5B illustrate a sample gaming machine 10 in accordance with a specific embodiment. Gaming machine 10 is suitable for providing a game of chance and includes hardware adaptations as described herein.

Gaming machine 10 includes a top box 11 and a main cabinet 12, which defines an interior region of the gaming machine. The cabinet includes one or more rigid materials to separate the machine interior from the external environment, is adapted to house a plurality of gaming machine components within or about the machine interior, and generally forms the outer appearance of the gaming machine. Main cabinet 12 includes a main door 38 on the front of the machine, which opens to provide access to the interior of the machine. The interior may include any number of internal compartments, e.g., for cooling and security purposes. Attached to the main door or cabinet are typically one or more player-input switches or buttons 39; one or more money or credit acceptors, such as a coin acceptor 42, and a bill or ticket scanner 23; a coin tray 24; and a belly glass 25. Viewable through main door 38 is the exterior video display monitor 18*a* and one or more information panels 27.

Top box 11, which typically rests atop of the main cabinet 12, may also contain a ticket printer 28, a keypad 29, one or more additional displays 30, a card reader 31, one or more speakers 32, a top glass 33 and a camera 34. Other components and combinations are also possible, as is the ability of the top box to contain one or more items traditionally reserved for main cabinet locations, and vice versa.

It will be readily understood that gaming machine 10 can be adapted for presenting and playing any of a number of games and gaming events, particularly games of chance involving a player wager and potential monetary payout, such as, for example, a digital slot machine game and/or any other video reel game, among others. While gaming machine 10 is usually adapted for live game play with a physically present player, it is also contemplated that such a gaming machine may also be adapted for remote game play with a player at a remote gaming terminal. Such an adaptation involves communication from the gaming machine to at least one outside location, such as a remote gaming terminal itself, as well as the incorporation of a gaming network that is capable of supporting a system of remote gaming with multiple gaming machines and/or multiple remote gaming terminals.

Gaming machine 10 may also be a "dummy" machine, kiosk or gaming terminal, in that all processing may be done at a remote server, with only the external housing, displays, and pertinent inputs and outputs being available to a player. Further, it is also worth noting that the term "gaming machine" may also refer to a wide variety of gaming machines in addition to traditional free standing gaming machines. Such other gaming machines can include kiosks, set-top boxes for use with televisions in hotel rooms and elsewhere, and many server based systems that permit players to log in and play remotely, such as at a personal computer or PDA. All such gaming machines can be considered "gaming machines" for embodiments described herein.

With reference to FIG. 5B, the gaming machine of FIG. 5A is illustrated in perspective view with its main door opened. In additional to the various exterior items described above, such as top box 11, main cabinet 12 and primary video displays 18, gaming machine 10 also comprises a variety of internal components. As will be readily understood by those skilled in the art, gaming machine 10 contains a variety of locks and mechanisms, such as main door lock 36 and latch 37. Internal portions of coin acceptor 22 and bill or ticket scanner 23 can also be seen, along with the physical meters associated with these peripheral devices. Processing system 50 includes computer architecture, as will be discussed in further detail below.

When a person wishes to play a gaming machine 10, he or she provides coins, cash or a credit device to a scanner included in the gaming machine. The scanner may comprise a bill scanner or a similar device configured to read printed information on a credit device such as a paper ticket or magnetic scanner that reads information from a plastic card. The credit device may be stored in the interior of the gaming machine. During interaction with the gaming machine, the person views game information using a video display. Usually, during the course of a game, a player is required to make a number of decisions that affect the outcome of the game. The player makes these choices using a set of player-input switches.

After the player has completed interaction with the gaming machine, the player may receive a portable credit device from the machine that includes any credit resulting from interaction with the gaming machine. By way of example, the portable credit device may be a ticket having a dollar value produced by a printer within the gaming machine. A record of the credit value of the device may be stored in a memory device provided on a gaming machine network (e.g., a memory device associated with validation terminal and/or processing system in the network). Any credit on some devices may be used for further games on other gaming machines 10. Alternatively, the player may redeem the device at a designated change booth or pay machine.

Gaming machine 10 can be used to play any primary game, bonus game, progressive or other type of game. Other wagering games can enable a player to cause different events to occur based upon how hard the player pushes on a touch screen. For example, a player could cause reels or objects to move faster by pressing harder on the exterior touch screen. In these types of games, the gaming machine can enable the player to interact in the 3D by varying the amount of pressure the player applies to a touchscreen.

As indicated above, gaming machine 10 also enables a person to view information and graphics generated on one display screen while playing a game that is generated on another display screen. Such information and graphics can include game paytables, game-related information, entertaining graphics, background, history or game theme-related information or information not related to the game, such as advertisements. The gaming machine can display this information and graphics adjacent to a game, underneath or behind a game or on top of a game. For example, a gaming machine could display paylines on a proximate display screen and also display a reel game on a distal display screen, and the paylines could fade in and fade out periodically.

A gaming machine includes one or more processors and memory that cooperate to output games and gaming interaction functions from stored memory. Such a gaming machine can include an exterior housing arranged to contain various internal gaming machine components therein and a master gaming controller in communication with various internal gaming machine components. The master gaming controller may comprise the one or more processors and memory. FIG. 6 illustrates a control configuration for use in a gaming machine in accordance with another specific embodiment.

Processor 432 is a microprocessor or microcontroller-based platform that is capable of causing a display system 18 to output video data such as symbols, cards, images of people, characters, places, and objects which function in the gaming device. Processor 432 may include a commercially available microprocessor provided by a variety of vendors known to those of skill in the art. Gaming machine 10 may also include one or more application-specific integrated circuits (ASICs) or other hardwired devices. Furthermore, although the processor 432 and memory device 434 reside on each gaming machine, it is possible to provide some or all of their functions at a central location such as a network server for communication to a playing station such as over a local area network (LAN), wide area network (WAN), Internet connection, microwave link, and the like.

Memory 434 may include one or more memory modules, flash memory or another type of conventional memory that stores executable programs that are used by the processing system to control components in a layered display system and to perform steps and methods as described herein. Memory 434 can include any suitable software and/or hardware structure for storing data, including a tape, CD-ROM, floppy disk, hard disk or any other optical or magnetic storage media. Memory 434 may also include a) random access memory (RAM) 440 for storing event data or other data generated or used during a particular game and b) read only memory (ROM) 442 for storing program code that controls functions on the gaming machine such as playing a game.

A player uses one or more input devices 438, such as a pull arm, play button, bet button or cash out button to input signals into the gaming machine. One or more of these functions could also be employed on a touchscreen. In such embodiments, the gaming machine includes a touch screen controller 16*a* that communicates with a video controller 446 or processor 432. A player can input signals into the gaming machine by touching the appropriate locations on the touchscreen.

Processor 432 communicates with and/or controls other elements of gaming machine 10. For example, this includes providing audio data to sound card 436, which then provides audio signals to speakers 430 for audio output. Any commercially available sound card and speakers are suitable for use with gaming machine 10. Processor 432 is also connected to a currency acceptor 426 such as the coin slot or bill acceptor. Processor 432 can operate instructions that require a player to deposit a certain amount of money in order to start the game.

Although the processing system shown in FIG. 6 is one specific processing system, it is by no means the only processing system architecture on which embodiments described herein can be implemented. Regardless of the processing system configuration, it may employ one or more memories or memory modules configured to store program instructions for gaming machine network operations and operations associated with layered display systems described herein. Such memory or memories may also be configured to store player interactions, player interaction information, and other instructions related to steps described herein, instructions for one or more games played on the gaming machine, etc.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks;

magneto-optical media such as floptical disks; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

The processing system may offer any type of primary game, bonus round game or other game. In one embodiment, a gaming machine permits a player to play two or more games on two or more display screens at the same time or at different times. For example, a player can play two related games on two of the display screens simultaneously. In another example, once a player deposits currency to initiate the gaming device, the gaming machine allows a person to choose from one or more games to play on different display screens. In yet another example, the gaming device can include a multi-level bonus scheme that allows a player to advance to different bonus rounds that are displayed and played on different display screens.

Externally-Controlled Interface Processes

In particular embodiments, the gaming devices on the gaming machine may be controlled by software executed by a master gaming controller 46 (see at least FIG. 6) on the gaming machine in conjunction with software executed by a remote logic device (e.g., a remote host, a central server or a central controller) in communication with the gaming machine. The master gaming controller may execute externally-controlled interface (ECI) processes, described in more detail below, that enable content generated and managed on the remote host to be output on the gaming machine including gaming machines with multi-layered displays as previously described. The gaming machine may receive and send events to the remote host that may affect the content output by one or more ECI processes as well as enable an ECI process to be initiated on the gaming machine.

The master gaming controller may be configured to limit the resources that can be utilized by the ECI processes executing on the gaming machine. Specific resource limitations may be predetermined, negotiated with a host device controlling an ECI prior to the execution of the ECI on the gaming machine or combinations thereof. To enforce any established resource limitations, the master gaming controller may constantly monitor resources utilized by the ECI processes and other gaming processes executing on the gaming machine.

The ECIs may be executed while a gaming machine is operable to provide a play wager-based game of chance (During operation, one or more games and one or more executed simultaneously, one or more games may be executed without execution of an ECI or one or more ECIs may be executed while a game is not being played). Therefore, the resources may be limited to ensure that a gaming experience on the gaming machine is optimal while access to gaming resources is granted to a remote host. The resources allocated to ECIs may be limited for many reasons, such as ensuring the game play experience is adequate or for security purposes, and the examples described herein, which are provided for illustrative purposes only. For instance, the CPU cycles provided to executing ECI processes may be limited to ensure a minimal graphically rendered frame rate is maintained on the gaming machine. As another example, the ECI processes may not be allowed to directly control or access certain devices, such as money handling devices, to prevent the ECI from allowing cash or an indicia of credit to be input or output from the gaming machine.

It should be appreciated that the gaming device resources utilized by the ECI processes include, but are not limited to: graphic resources of the gaming machine (i.e., what graphical real estate is available on the display device without interfering with the graphics of the primary game), audio resources of the gaming machine (i.e., what audio content may be provided by the gaming machine without interfering with the audio of the primary game), timing resources available (i.e., has the primary game ended or is the primary game beginning), and/or CPU processing resources of the gaming machine. In one embodiment, access to such resources may be based on a priority system configured to maximize an optimal gaming experience for each player.

In particular embodiments, the host-controlled ECI processes may be decoupled from the processes used to generate the game of chance played on the gaming machine such that the content output by the host-controlled ECI processes doesn't alter the play of game of chance. Thus, the logic for the game processes may be designed such that information regarding the state or content generated by the ECI processes is not needed to generate the game of chance and/or the game and related processes may not recognize any information produced by the ECIs. The ECI processes may be designed in a similar manner.

An advantage of ECI software and game software decoupled in this manner may be that content may be provided from a remote host that enhances the functionality and features available on the gaming machine. The content can be easily varied with little or no modification to the gaming software resident on the gaming machine. For instance, many features and services on a gaming machine can be provided using a generic ECI that enables access to a display and a touch screen on the gaming machine. Externally controlled interfaces, the interaction between a remote host and a gaming machine, embodiments of hardware and software architectures on a gaming machine related to ECIs are described with respect to the following FIGS. 7 and 8

Figure 7:
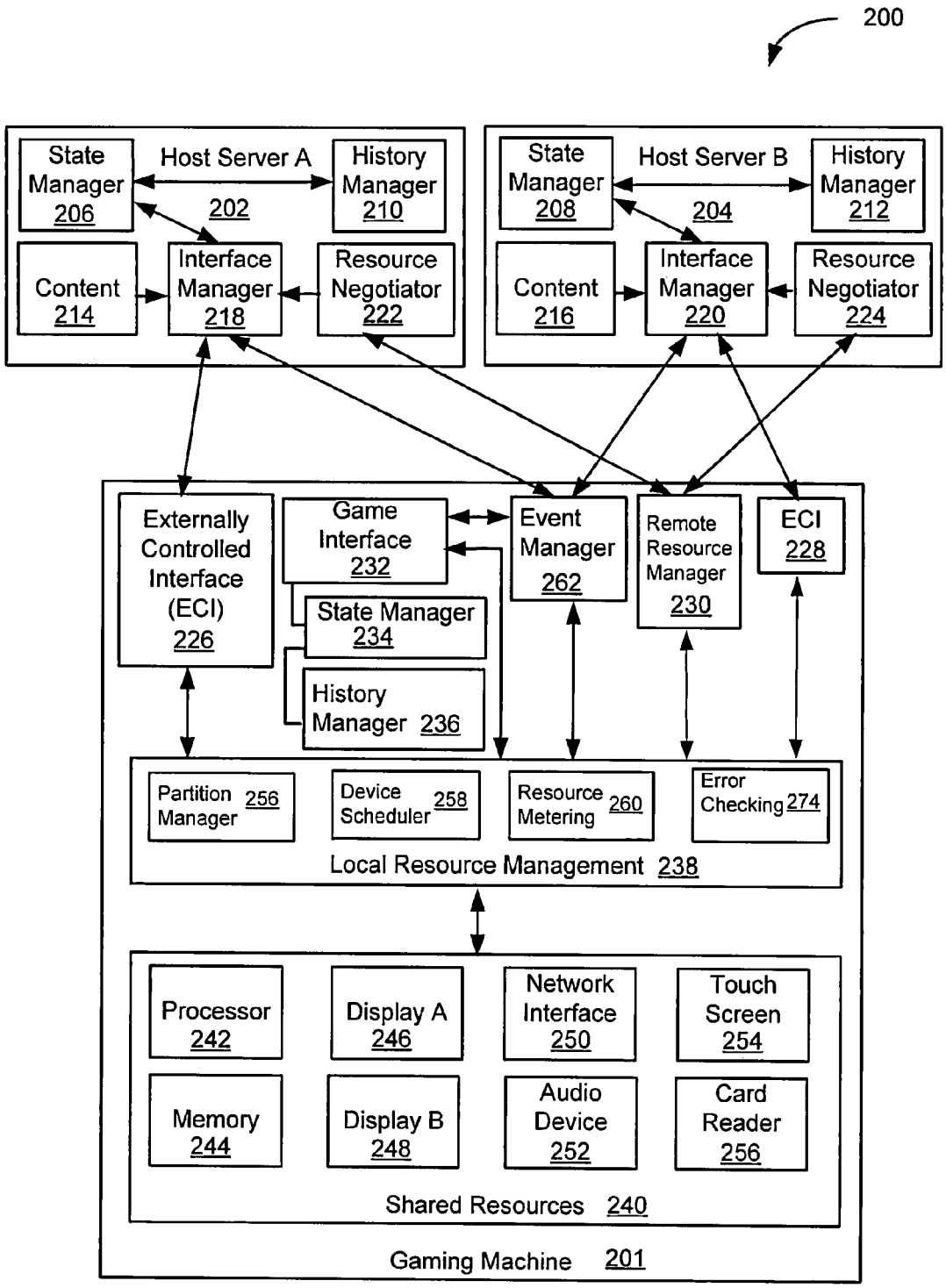
FIG. 7 is a block diagram illustrating an interaction between two hosts and a gaming machine for one embodiment of the present invention.

FIG. 7 is a block diagram illustrating an interaction between two hosts, 202 and 204, and a gaming machine 201 for one embodiment of the present invention. Each host controls an ECI on gaming machine 201. Host 202 controls ECI 226 and host 204 controls ECI 228. The hosts, 202 and 204, may control their respective ECIs, 226 and 228, in an independent or a dependent manner with respect to one another. In the independent case, events generated with respect to the execution of one ECI don't affect the execution of the other ECI. In the dependent case, one or both ECIs may generate events that affect one another. In one embodiment of the present invention, two remote hosts, such as 202 and 204, may share access to a single ECI and may alternately or simultaneously provide content for the ECI. Further, as previously described, the ECIs, such as 226 and 228, may directly share information without routing it through their respective hosts.

Each host includes a state manager, 206 and 208, content, 214 and 216, a history manager, 210 and 212, an interface manager, 218 and 220, and a resource negotiator, 222 and 224. The state manager may maintain a state of the ECI on the gaming machine. In the event of a malfunction on a) the gaming machine, b) the host or c) in the network between the host and the gaming machine. The state manager may be designed to store information that enables the remote host, if it chooses to restore an ECI on the gaming machine 201 to a state proximate to the state immediately prior to an occurrence of the malfunction. In one embodiment, the gaming machine maintains its own state via state manager 234 but not the state of any of the ECIs executing on the gaming machine 201. In other embodiments, the gaming machine may maintain some state information regarding the content displayed in the ECI. For example, the gaming machine may capture frames output to its display that include information from an ECI controlling a portion of the display.

The hosts, 202 and 204, may each provide content to ECIs executing simultaneously on a plurality of gaming machines. The gaming machine may include multi-layered displays as described with respect to FIGS. 1A-6. The content provided on each gaming machine may be different (e.g., the content may be personalized using information regarding the player at each machine or the hosts may be dynamically responding to events generated on each gaming machine and adjusting content accordingly) and the gaming machines served by each host may be different (e.g., host 202 may provide content to gaming machines A, B and C while host 204 is providing content to gaming machines B, C, D). For each gaming machine that the host provides content via an ECI, the hosts, 202 and 204, may maintain a state of the content. The content, as described above, may comprise data and/or instructions provided as application files that are run and/or parsed by the ECI. The application files may include information/data used by the ECI and commands/instructions for utilizing one or more functions of the ECI. For instance, an ECI may be operable to receive command/instructions in regards to utilizing vector graphic capabilities of the ECI. In addition, when vector graphics are applied, the ECI may be operable to apply edge smoothing the vector-based graphics.

In regards to vector graphics, computers may display graphics in two formats: vector and bitmap. Bitmaps are made up of discrete units called pixels. Each pixel contains a single color. When combined, the variations in pixel color create the patterns that make up an image. Bitmaps contain color information for each pixel in an image plus the dimensions for the image, and transmit images pixel by pixel. To change the size of a bitmap image, i.e., to fit into a display region with different dimensions than the original bitmap. The bitmap image has to be regenerated at the desired dimensions or the image has to be stretched, usually with undesirable results.

By comparison, vector graphics store a series of commands/instructions necessary to create an image using lines and curves. The commands, called vectors, dictate attributes of lines and curves such as thickness, direction, color, and position. A processor associated with the master gaming controller may be utilized to process the commands locally to generate a specified vector image. For instance, the master gaming controller may execute an ECI that is operable to parse vector graphic instructions and generate the image specified by the instructions.

Vector graphics allow for fine detail and may be easily be resized without losing definition. An image generated with vector graphics may be modified by changing the attributes of the lines and curves comprising the image. Vector graphics are best for displaying simple shapes with flat areas of color, such as icons, logos, and cartoon-style drawings. Both vector and bitmap graphics may be drawn on request, but vectors may generally use much smaller file sizes and can be drawn much more quickly. When downloaded, bitmaps are transmitted pixel by pixel, so file size and download time are proportional to an image's dimensions. Vector graphics transmit instructions, which are then carried out by your processor, so that file size and rendering speed are determined by the complexity of the instructions, not the size of the graphic. In various embodiments, various graphical techniques and data may be utilized for providing video content to an ECI including vector graphics, bit map images, movies, etc.

The state managers, 206 and 208, may each generate information that is sent to their history manager, 210 and 212, for dispute resolution and auditing purposes. In the event of a dispute, for example, a player may dispute an event that happened three games ago on the gaming machine when ECI 226 and ECI 228 were executing. The gaming machine 201 may include logic that enables the gaming machine to contact each host and request information regarding one or more states of the ECI it supported during the disputed game. The host may send the requested information to the gaming machine for display.

To enable for dispute resolution, the gaming machine 201 and the hosts 202 and 204 may exchange information, such as time stamps, game start time, game finish time, ECI start time, ECI finish time, event occurred at time A, etc., that enable content generated by each device and stored by the history manger to be recalled and correlated to one another. This information may be exchanged while the ECI is executing and then again later when requests for stored information are received by one of the hosts.

As an example of state history management and access, the gaming machine 201 may store a start and stop time for each game, whether one or more ECIs were executed during the game and when at least one ECI is executed during a particular game, information needed to contact the host that provided content for the ECI. Thus, the gaming machine 201 may be able to contact one of the remote host and request ECI states during a time period, which corresponds to a particular game. In response, the host may send the requested information to the gaming machine.

The gaming machine 201 may provide a number of shared resources 240 that may be utilized by an ECI, such as 226. For instance, in one embodiment, the gaming machine 240 may be operable to share a) processing resources from a processor, such as 240, b) memory 244 which may comprise volatile memory, such as RAM or non-volatile memory, such as flash memory or a hard drive, c) one or more displays, such as display A 246 or display B, 248, which may be stacked or layered displays, d) one or more communication interfaces, such as a network communication interface 250 or a wireless interface (not shown) that allows the gaming machine to communicate with wireless devices located proximate to the gaming machine 201, e) audio devices 252, such as speakers, amps and signal codecs for processing sound files, f) input/output devices, such as a touch screen 254 or card reader 256.

Prior to launching the ECI, a negotiation may take place between the gaming machines and one or more remote hosts in regards to the resources that may be utilized by the ECI while it is executed on the gaming machine. In one embodiment, when an ECI, such as 226, is shared or controlled by two or more hosts or where each host controls its own ECI but the ECIs share common resources and/or resource limitations based on the combined usage of resources used by the ECIs controlled by each host, a resource negotiation may take place between the two or more hosts to determine what resources are needed by each host. The host-to-host negotiation may allow the hosts to provide content/instructions to a shared ECI or to each of their ECIs in an integrated manner so that each host has enough resources to display their content/instructions on the shared ECI or each of their respective ECIs.

For example, if a first ECI controlled by a first host utilizes display 246 and a second ECI controlled by a second host utilizes display 246 each host may only need a portion of the display 246 rather than the whole display. If one or both hosts try to utilize the entire display then both hosts may not be able to have content displayed via their ECIs simultaneously. But, if the first and the second host agree to share the display by utilizing only a portion of it via a resource negotiation, then the first and second host may be able to display content via their ECIs on the display 246 at the same time. In general, the gaming machine may be the final arbiter of what resources are assigned to each ECI and the host-host negotiations may take place in the context of negotiations with the gaming machine.

In particular embodiments, the resource negotiators 222 and 224 may communicate with the remote resource manager 230 on the gaming machine 201 or each other to determine what resources are available for the ECI that each remote host controls, such as 226 or 228 or for an ECI which the remote hosts share. The one or more remote hosts may use this information to adjust the content that is sent to the gaming machine for its respective ECI. For instance, display 246 and display 248 may be of different sizes. Thus, at some times, a remote host may be provide access to display 246 and provide content to an ECI formatted to be compatible with the resolution of display 246 while at other times display 246 may not be available and the remote host may provide content formatted to be compatible with the resolution of display 248 (The content provided at different times to the displays 246 and 248 may be the same or different content). Further details of resource management are described with respect to at least FIG. 8.

In yet another embodiment, the remote hosts, 202 and 204, may compete for access to resources on the gaming machine. For example, remote host 202 may provide one advertising stream/content and remote host 204 may provide another advertising stream/content. The gaming machine may allow only one advertising stream/content at a time. Thus, the gaming machine 201 may initiate negotiations where access to its resources goes to the remote host, which is the highest bidder.

For streamed content using multi-layered displays, a remote host may provide multiple streams of video data designed to be displayed in simultaneous manner. The video streams may be output via an ECI process executed by the master gaming controller. For example, a remote host may provide a first stream of video data that may be designed to be displayed on a first layer of a multilayer display in a synchronized manner with a second stream of video data on first layer of multilayer display and a second layer of a multilayer display. In another example, the video streams may be generate to be displayed side-by-side on the same or different displays.

The gaming machine may be operable to buffer the multiple streams of video data and then check the contents of in the buffer to determine whether needed video data needed, such as for each layer of the multilayer display, has been received prior to allowing it to be output. In one embodiment, synchronized video content for multiple displays may be encapsulated when it is downloaded to ensure that a complete package of the synchronized video content is received prior to outputting the synchronized video content to two different layers of a multi-layered display.

The encapsulation may be performed to avoid a situation where video content or a first layer of a multilayered display is received and output prior to receiving corresponding video content for a second layer of a multilayered display. For example, a remote host may wish to control an output of video content to two layers of a multilayer display where the video content displayed on each layer is meant to be synchronized. The video content for each layer may be sent separately or may be sent as a combined package, e.g., an encapsulated package.

When the video content for each layer is sent separately, the video content for a first layer may be received correctly while the video content for a second layer may be sent incorrectly. For instance, the video content for the second layer may be corrupted during transfer. Thus, if the output of the video content for the first layer were to be initiated in this situation, the video content for the first and second layers would not be synchronized because the video content for the second layer was not received correctly.

The encapsulated package of the video content for both the first layer and second layer prevents the situation described in the previous paragraph because the gaming machine is configured to check whether the encapsulated package is received in its entirety or not. When the gaming machine checks and confirms that the encapsulated package has been received in its entirety, the synchronized video content needed for both layers of the display is available and may be instantiated on each layer of the video display devices. When the gaming machine checks and determines that the encapsulated package hasn't received the encapsulated package in its entirety, then the gaming machine may not allow the ECI to control all or a portion of the multilayered displays that are used to output the video content received from the remote host.

The display of synchronized video content is not limited to synchronizing two layers of a multilayer display. In some embodiment, a remote host may provide commands, instructions and/or data for video content that is meant to be synchronized with video content provide by another process, such as a gaming process executed by the master gaming controller that controls output of video content related to a play of a wager-based game. In some embodiments, when a particular game event occurs that results in specific video content being displayed on the gaming machine, the remote host may wish to provide commands, instructions and/or data that provide video content that is related to the specific video content associated with the game event.

As an example, when video content associated with a bonus award or an award amount above a certain value is displayed or is going to be displayed on the gaming machine, a remote host may wish to control a display of video content that is to be synchronized with the video content associated with the bonus award or the award amount above a certain value. In this example, the gaming machine may be operable to check to ensure that all of the needed commands, instructions and/or related to an output of the synchronized video content have been received from the remote host. In the instances when the gaming machine determines all of the information needed for the output for the synchronized video content has not been received, the gaming machine prevent an ECI process from outputting video content until all the needed information has been received.

Returning to FIG. 7, the gaming machine may notify potential hosts when resources become available and solicit bids for the resources from two or more hosts. In one embodiment, the gaming machine 201 while displaying content from one host may receive a bid for resources from another remote host and switch access to the gaming machine from a first remote host, such as 202, to a second remote host, such as 204, after receiving a better bid for resources from the second remote host 202.

In yet another embodiment, the gaming machine 201 may provide information regarding various resource packages with various costs to potential remote hosts. The cost of a resource package may affect the amount of resources and priority of access of resources afforded to a remote host providing an ECI. For instance, access to a larger portion of a display that is shared may cost more than access to a smaller portion of the display. As another example, access to a display where control of the display is not to be switched to another remote host provided ECI or taken over by the gaming machine for a particular time period may cost more than sharing access to the display with another remote host and allowing the gaming machine to intermittently use the display.

The interface managers, 218 and 220, may be responsible for determining what content to send each ECI and sending the content. Further, the interface managers may be designed to respond to events generated on the gaming machine. For example, when interface manager 218 receives information indicating a touch screen has been activated on the gaming machine via the event manger 262, the interface 218 manager may determine whether the touch screen is activated in a display area that it controls and whether content displayed on ECI 226 needs to be adjusted. As another example, when the interface managers, 218 or 220, receive information regarding the resolution of a particular display and visual content is to be displayed, the interface managers, may select content stored on their respective remote host that is closet to a needed resolution, reformat (if needed) the content, generate new content to fit the resolution of the particular display or locate and/or download needed content from another source, such as another remote host.

In particular embodiments, an ECI and/or remote host may not be granted access to all of the features of the shared resources. For example, when the card reader is operable to read/write data to a card, such as a smart card. The ECI may be allowed to receive data read from a card but not write data to the card. In one embodiment, during the negotiation phase, the gaming machine may provide a) a list of available shared resources, b) features of the shared resources that may be controlled by the remote host directly and/or via an ECI including commands and data formats that allow the features to be utilized, c) under what conditions the features may be utilized, etc.

In one embodiment, the data formats, commands and/or instructions that an ECI or remote host may utilize may be incorporated in a communication protocol that is utilized by both the ECI and/or remote host and gaming machine (or gaming device). In particular embodiment, the commands/instructions that the ECI and the remote host may communicate to the gaming machine, such as to control a device, may be high-level commands that are translated by the gaming machine to low-level instructions that are used to actually perform the operation that is requested. For instance, to spin a bonus wheel coupled to the gaming machine, a remote host and/or ECI may send a "spin wheel" command to the gaming machine. The gaming machine may translate the command to a number of low-level instructions that a stepper motor coupled to the gaming machine to be controlled. In another embodiment, the ECI and/or remote host may be operable to provide low-level instructions that allow a device to be directly controlled. For instance, the ECI and/or remote host may be able to send the low-level instructions for controlling the stepper motor directly to the bonus wheel without needing the gaming machine to translate.

In a particular embodiment, the communications between the gaming machine and the remote host may be separated into two parts. The first part of the communications may include information regarding gaming machine transactions, such as money handling, metering, game outcomes, random number generation, player identification information. In general, the first part of the communications may include information that is generated as a result of game play from a primary game of chance executed on the gaming machine. In one embodiment, the gaming machine transaction information may be communicated using the G2S protocol approved by the Gaming Standards Association (Fremont, Calif.). The second part of the communications between the gaming machine and the remote host may enable the communications between the remote host and the ECI, such as commands, instructions and/or data sent between the remote host and the ECI, which may include content for the ECI to output.

One advantage separating the communications in this manner is that the ECI may be isolated from game play information. When the ECI is isolated from game play information, it may result in a more secure system. The higher level of security is based on the assumption that if a process executing on the gaming machine is unaware of game play information, such as the state of a game, it will more difficult for the process to affect the game in unacceptable manner. It is noted that although the ECI may not be aware of game play information, as described in the previous paragraph, the remote host may be aware of game play information.

The game play information described in the previous paragraph may be related to information generated as a result of play of a primary game of chance generated on the gaming machine. Further, in some embodiments, the ECI itself may provide the play of games separate from the primary game. Nevertheless, the ECI may not be aware that is providing the play of a game and may be still unaware of any game play information that is generated. From the perspective of the ECI, it is simply outputting content utilizing commands, instructions and data provided by a remote host where the ECI does not distinguish between game related content and non-game related content.

In particular embodiments, the ECI may be operable to process input generated as a result of the play of the game provided by the ECI but may not be operable to distinguish this input from other types of input, i.e., it may not be configured to determine the function associated with the input. For instance, the ECI may be instructed by the remote host to generate a bet button on a touch screen display for a game output utilizing the ECI. The ECI may be operable to receive input from the touch screen and determine that a particular button has been pressed. The ECI may forward this information to the remote host and the remote host may determine that this button corresponds to a bet button. The ECI may be unaware the button for a bet has been pressed or activated, i.e., it is unaware of the function of the button.

In particular embodiments, when an ECI and/or remote host is access or control is prohibited for one or more resources, such as utilizing a peripheral device or utilizing one of the features of the peripheral device coupled to the gaming machine, and the ECI and/or remote host generates an instruction that tries to utilize or control the resource, then the gaming machine may respond in various manners. For example, in one embodiment, if the device or device feature the ECI and/or remote host is trying to access or control is not critical, then the gaming machine may simply ignore the command or instruction and possibly notify the device that it is trying to perform a function that is not available to it. For instance, the ECI and/or remote host may send instructions to a gaming machine to flash lights when this function is not available to it, and the gaming machine may simply ignore the instructions.

In another embodiment, the ECI and/or remote host may try to access or control a critical device in a manner that is prohibited. For instance, ECI or remote host could try to send a command to a printer to print a cashless ticket of a particular value, which is not allowed. In some possible responses, the gaming machine may 1) log the event, 2) terminate the connection with the ECI, 3) enter a tilt state or 4) combinations thereof. Some details of tilt handling that may be utilized with various embodiments are described in U.S. Pat. No. 6,890,259, entitled, "Modular Tilt Handling," which is incorporated by reference and for all purposes.

In particular embodiments, the available resources that may be utilized by a remote host as part of an ECI may vary from gaming device to gaming device. For example, a casino-type gaming machine with random number generation capability may have more capabilities that may be utilized in an ECI than a portable hand-held device. Further, in other embodiments, the capabilities of a gaming device, such as gaming machine 201, that may be offered to a remote host for utilization may vary depending on the remote host. For example, some remote hosts may be more trusted than other remote hosts and thus may be afforded greater access to devices on the gaming machine than other remote hosts.

During operation of an ECI, the gaming machine may check the resources utilized by an ECI to determine whether the resources utilized by the ECI are in compliance with limits established for the ECI, such as during the negotiation phase. The gaming machine 201 may utilize its local resource management 238 including the partition manager 256, the device scheduler 258 and the resource metering 260 on the gaming machine 201 to check the resource utilization of one or more ECIs individually or a group of ECIs in combination against resource allocations for each individual ECI or the group of ECIs. When resource allocation for an ECI is exceeded, a number of remedial actions may be taken. For instance, when CPU resources are exceeded, the ECI may be denied further CPU cycles and the display characteristics of the ECI may slow down and become jerky. Further, the gaming machine may notify the ECI that it has it exceeded it resource requirements. As another example, when resources are exceeded, the gaming machine may terminate a session with the remote host and stop execution of the ECI on the gaming machine. The execution of the ECI may be stopped permanently or may be stopped temporarily until more resources become available on the gaming or until the remote host adjusts the content of the ECI.

As examples, an ECI may exceed its allocated resources because the gaining machine downwardly adjusted the resources available to the ECI after the start of an ECI session or because the remote host didn't correctly estimate an amount of resources it needed. In response to learning it is exceeding resources it has been allocated on the gaming machine, the remote host, such as 202 or 204, may adjust their content to consume less resources on the gaming machine. In particular embodiments, the remote hosts, such as 202 and 204, may be operable to dynamically adjust the content that is sent to the gaming machine for utilization by an ECI after a session has been initiated (at the start of the session an initial resource allocation may be specified) 1) to satisfy changing resource allocations on the gaming machine, which may change, and thus, to prevent it from exceeding its resource allocation.

Since the manner in which an ECI and/or remote host may be allowed to access or utilize a gaming machine may vary, such as from one remote host to another, from one time to another and different gaming machine may have different capabilities (e.g., a gaming machine may have different capabilities than a portable), the gaming machine may include logic for checking instructions and/or data received from an ECI and/or remote host to comply with their access privileges. For example for illustrative purposes only as a communication protocol doesn't have to be utilized, when the instructions and/or data are codified in a communication protocol, the gaming machine may first check to see whether the instructions and/or data is a recognized part of the protocol. Then, even if the instructions and/or data is part of the protocol, the gaming machine may not offer the capability requested, thus compatibility of instructions and/or data with the gaming machine capabilities may be checked (At the negotiation phase, the instructions and/or data that the gaming machine is capable of utilizing, which may be a subset of the instructions and/or data that may be communicated as part of the communication protocol may be established.) Then, the instructions and/or data may be checked against the access privileges for the particular ECI and/or remote host. For each remote host and its associated ECI, information regarding resource access privileges may be stored (The information may have been generated at the negotiation phase or at some other time). The privilege and/or error checking may be performed by the privilege checking logic 274 in the local resource management 238.

Figure 8:
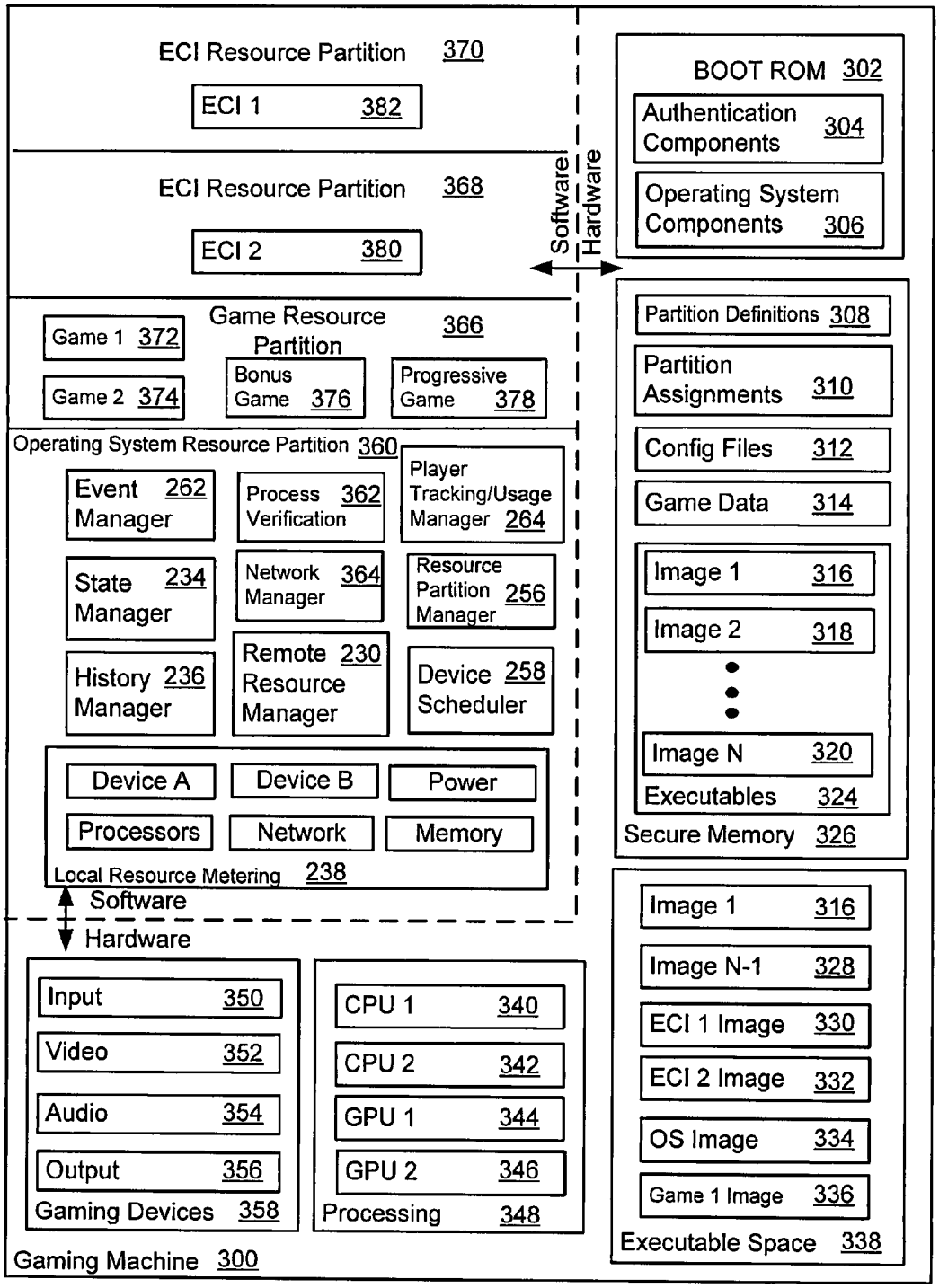
FIG. 8 is a block diagram showing hardware and software components and their interactions on a gaming machine for embodiments of the present invention.

FIG. 8 is a block diagram showing hardware and software components and their interactions on a gaming machine for embodiments of the present invention. In embodiments of the present invention, the operating system may maintain "resource partitions." A resource partition may be logical abstraction implemented in the operating system logic that enables the operating system to monitor and limit the resources used by all of the process or process threads executing in each resource partition. At any given time, a resource partition may include one or more member processes or member process threads. For example, in one embodiment of the present invention, a QNX operating system (Ottawa, Canada) may be employed. With QNX, each thread of execution may be individually assigned to a different resource partition. Thus, one process may have several threads each running in different partitions. In general, the operating system may be a POSIX compliant operating system, such as Unix and Linux variants, Windows™ NT, 2000, XP, Vista, etc.

Resource partitioning is one example or aspect of virtualization. Virtualization is the process of presenting a logical grouping or subset of computing resources so that they can be accessed in ways that give benefits over the original configuration. In particular, virtualization may provide techniques for hiding the physical characteristics of computing resources from the way in which other systems, applications, or end users interact with those resources. These techniques may include making a single physical resource (such as a server, an operating system, an application, or storage device) appear to function as multiple logical resources; or it can include making multiple physical resources (such as storage devices or servers) appear as a single logical resource. Virtualization may refer to the abstraction of resources in many different aspects of computing and may include virtual machines and systems management software. Thus, the examples of resource partitioning and other virtualization examples are provided for illustrative purposes only and are not intended to limit the invention to virtualizations providing only resource partitioning or the other examples of virtualization mentioned herein.

As noted above, threads may be assigned to different partitions in some embodiments of the present invention. A thread may be short for a thread of execution. Threads are a way for a program to split itself into two or more simultaneously (or pseudo-simultaneously) running tasks. Threads and processes differ from one operating system to another, but in general, the way that a thread is created and shares its resources may be different from the way a process does.

Multiple threads may be executed in parallel on many computer systems. This multithreading may be provided by time slicing, where a single processor switches between different threads, in which case the processing is not literally simultaneous, for the single processor is only really doing one thing at a time. This switching can happen so fast as to give the illusion of simultaneity to an end user. For instance, a typical computing device may contain only one processor, but multiple programs can be run at once, such as an ECI for player tracking alongside an a game program; though the user experiences these things as simultaneous, in truth, the processor may be quickly switching back and forth between these separate threads. On a multiprocessor system, threading can be achieved via multiprocessing, wherein different threads can run literally simultaneously on different processors.

In embodiments of the present invention, multiprocessor systems with multiple CPUs may be used in conjunction with multiprocessing. For example, an ECI process or ECI thread may be executed on one or more CPUs while a game is executed on one or more different CPUs. In a particular embodiment, in a multiprocessor system, CPU accessibility may be limited according to the application. For instance, ECIs may be only executed on certain processors and games on other processors. The ECIs may be prevented from utilizing processors dedicated to executing games or other applications.

Threads are distinguished from traditional multi-tasking operating system processes in that processes are typically independent, carry considerable state information, have separate address spaces, and interact only through system-provided inter-process communication mechanisms. Multiple threads, on the other hand, typically share the state information of a single process, and share memory and other resources directly. Although, as noted above, threads of the same process may be assigned to different resource partitions. Context switching between threads in the same process may be typically faster than context switching between processes.

In general, the term, "process" refers to a manipulation of data on a device, such as a computer. The data may be "processed" in a number of manners, such as by using logical instructions instantiated in hardware, by executing programming logic using a processor, or combinations thereof. Thus, a "process" for the purposes of this specification may describe one or more logical components instantiated as hardware, software or combinations thereof that may be utilized to allow data to be manipulated in some manner. Therefore, the terms "process" and "process thread" as described are provided for the purposes of clarity only and are not meant to be limiting.

Four resource partitions, 360, 366, 368 and 370 are illustrated in FIG. 8. An operating system resource partition 360 that includes processes (or process threads) executed by the operating system. A game resource partition 366 from which game processes (or process threads) are executed. An ECI resource partition 382 from which a first ECI process 382 (or ECI process thread) may be executed and an ECI resource partition 368 from which a second ECI process 380 (or ECI process thread) may be executed. As noted above, resource partitioning may be performed at the process level, the process thread level or combinations thereof.

In one embodiment, resource partition definitions 308, such as resources allocated to each resource partition and processes that are enabled to execute in each partition (e.g. partition assignments 310) may be stored in the secure memory 326. Data stored in the secure memory may have been authenticated using the authentication components 304 stored on the Boot ROM 302. When a process is launched by the operating system, it may check to see which resource partition to assign the process using the partition assignments 310, which may include a list of processes that may be executed in each partition. In one embodiment, some processes may be assigned to more than one resource partition. Thus, when the resources associated with a first resource partition are being fully utilized, the process may be executed from a second resource partition with available resources.

In another embodiment, the partition assignment information may be stored with each executable image, such as images, 316, 318 and 320. When a process or process thread is launched, the operating system may determine which partition to assign the process or the process thread (In general, each process will have at least one process thread). With this method, new executable images may be downloaded to the gaming machine from a remote device that are not listed in the partition assignments 310 and still be assigned to a resource partition.

In a particular embodiment, the operating system may only allow one ECI process or ECI process thread to execute in a partition at one time. In other embodiments, a plurality of ECI processes may be executed from a single partition at one time. When only a single ECI process is allowed to execute from a partition at one time, the amount of resources available to the ECI process occupying the partition may be more predictable. This type of architecture may be valuable when ECIs are provided from two or more different hosts simultaneously where each remote host doesn't necessarily know the resource requirements utilized by an ECI from another remote host. When two or more ECIs are allowed to occupy a single partition and execute simultaneously, the resources provide to each ECI, respectively, may be more vary more if each respective ECI is competing for a limited amount of resources.

The resource competition may be become more acute when the resources needed by two or more ECIs are near or greater than one or more resources (e.g., CPU cycles or memory) provided in a partition. In some embodiments, the gaming machine may prioritize resource utilization by each ECI process. For instance, an execution priority may be assigned to each ECI process executing in a resource partition such that based on the priority one ECI process is favored over another ECI process when they are both competing for resources.

The priority assigned to each ECI process may be based on other factors. A priority to resources may be assigned to an ECI process based upon its function. For instance, an ECI for providing a bonus interface may be given a higher priority to resources than an ECI for providing advertising. In another embodiment, a priority may be assigned to an ECI process in accordance with a price paid to allow the ECI process and its content to be presented on the gaming device. In general, prioritization for utilizing resources is another way of providing virtualization on a gaming device.

Resources that may be monitored and limited for each partition include but are not limited CPU usage, memory usage, such as RAM usage, NV-RAM usage, disk memory usage, etc., GPU (graphics processing usage), network bandwidth, sound card usage and access to gaming devices, such as displays, audio devices, card readers, bill validators (e.g., as described with respect to FIG. 7, for some resource partitions, for security purposes, access to certain devices, such as bill validators and cashless devices, or device features may not be available). Resources that may be monitored on the gaming machine 300 include the executable space 338, the processing devices 348, the gaming devices 358 and the secure memory 326. The local resource metering process 238 may monitor resource usage for each partition. In FIG. 8, the local resource metering process 238 is shown monitoring, device A, device B, network bandwidth usage, processor usage of processors, 340 and 342, power usage, and memory usage.

The local resource metering process 238 may report information to the resource partition manager 256. In particular embodiments, based upon limits placed on each resource partition, the resource partition manager 256 may prevent new processes from executing in a particular resource partition or may even terminate certain processes to free up resources processes executing in other partitions. For example, if the output of the game on the gaming machine 300 is less than optimal because of the resources utilized by the ECI 380 or ECI 382, the gaming machine may suspend execution or terminate execution of one or both of the ECI 380 or ECI 382.

In particular embodiments of the present invention, prior to enabling a remote host to control an ECI on the gaming machine 300 and based on its resource partitioning system, the gaming machine 300 may notify the remote host of information regarding the resources it may have available to use while the ECI it wishes to control is executing on the gaming machine 300. In one embodiment, the remote resource manager 230 may report this information to the remote host. In another embodiment, the gaming machine may broadcast its available resources to a plurality of remote hosts that may control an ECI on the gaming machine 300. These messages may be broadcast at regular intervals and change depending on a current resource utilization on the gaming machine.

The resource information may include information regarding an upper limit of resources that may be available (e.g., a maximum of 10% CPU usage, 100 MB of RAM), a lower limit of resources that may be available (e.g., a minimum of 5% CPU usage, 50 MB of RAM, no audio capabilities), a prediction of a range of resources that may be available over time (e.g., at least 400×300 pixel window with periodic access to a 1600×1200 pixel window and at least 4 channels of 32 channel sound card with periodic access to all channels), a prediction of platform performance based on the available resources (e.g., an output frame rate of 25 frames per second at 60 Hz screen refresh rate using 16 bits of color). An upper and lower limit of resources may be provided because the resources available on the gaming machine may change with time while an ECI is executing.

Additional partitioning information may include a display mode, such as a translucent overlay of the game screen or a display location (e.g., left third of the display screen). Further, information sent to the remote host may include game theme, graphics and sound information currently executing on the gaming machine 300. The remote host may utilize this information to customize content for an ECI executing on the gaming machine 300 that is thematically consistent with a game executing on the gaming machine 300.

In addition, the gaming machine may send file information to the remote host information regarding files, such as application files executed by an ECI, stored in the resource partitions. The files may have been previously downloaded from the remote host or a different remote host at an earlier. One or more files or information/data/commands within the one or more files may be of use to the remote host and thus, the remote host may structure a download based on the file information. For instance, the remote host may download files/data/content that is only needed in addition to the files/data/content already stored on the gaming machine.

In response to the resource information it receives from the gaming machine, the remote host may determine whether the resources are adequate to output the content it wishes to present on the gaming machine via the ECI. In some embodiments, the remote host may adjust the content to output via the ECI to account for the available resources. For instance, when resources are limited, pre-rendered images, 2-D graphics or vector-based graphics may be used instead of dynamically rendered 3-D graphics. As another example, if network traffic is high, such that the network bandwidth is limited, the remote host may reduce the amount of data sent to gaming machine. Details of graphical related apparatus and methods that may be utilized in embodiments of the present invention are described with respect to U.S. Pat. No. 6,887,157, filed Aug. 9, 2001, by LeMay, et al., and entitled, "Virtual Cameras and 3-D gaming environments in a gaming machine," which is incorporated herein and for all purposes.

In a particular embodiment, the remote host may request additional resources than the gaming machine 300 has said are available. In response, the gaming machine 300 may temporarily create a resource partition, such as 370 or 368, or another type of virtualization (e.g., a virtual machine) that enables the remote host to access the additional requested resources while the ECI is executed. In other embodiments, the resources available on the gaming machine may not be suitable for the content that the remote host has available and the remote host may decide not to control an ECI, such as 382 or 380.

One advantage of using a virtualization, such as resource partitions, may be that a remote host in control of an ECI on a gaming machine may be enabled to control of resources while guaranteeing adequate game performance. A gaming machine operator always wants a game player to be presented with a quality game experience including presentations with desirable graphics and sounds. If providing access to gaming machine resources via an ECI results in an excessive degradation of the game experience (e.g., the graphics become jagged or jumpy), then sharing of gaming resources using an ECI would not be desirable. New gaming machine are becoming increasingly powerful in their capabilities. The use of ECIs in combination with resource partitioning enables under utilized gaming machine resources to be used in an effective manner while insuring that a quality game experience is always is provided to a game player.

Another advantage of using a virtualization, such as resource partitions, may be that testing requirements related to the development of game software and ECI software may be simplified. One method of ensuring a quality game experience is maintained on a gaming device while a game process for generating a game is executing on the gaming device while one or more ECI processes are executing is to extensively test the one or more ECI processes and game process under a variety of conditions. Testing every possible ECI process in combination with one or more possible ECI process in conjunction with every different game variation quickly becomes very unattractive in terms of both cost and time.

Using virtualization, where the maximum resources allowed to be utilized by one or more ECI processes are prevented from exceeding a set limit, the gaming software for generating a game on the gaming machine may be tested where a maximum resource utilization allowed for the one or more ECI processes is simulated while the game is being executed. The game may be tested under a variety of operational conditions, such as when it is using a maximum number of CPU cycles or graphic processor cycles, to ensure that the generated game is adequate at the maximum resource utilization condition allowed for the one or more ECI processes. After the testing, it may be concluded that the game performance will be adequate for any combination of one or more ECI processes using up to the maximum allowable resources for the ECIs. Thus, new ECI processes may be developed after the game is released without having to test the performance of the game in combination with each new ECI.

In addition, each ECI process may be tested to determine whether they perform adequately under various resource conditions up to the maximum resources allowed for a single ECI on a gaming device. This process may allow ECI developers to develop and test ECIs and associated content that are appropriate for different resource ranges up to the maximum allowed resources without needing to test them in combination with each possible game. Further, the developer may develop multiple ECIs and associated content to perform a particular function using different amount of resources with the knowledge that each ECI will perform adequately after testing. For example, a first ECI may use vector graphics to provide an animation, which requires less memory and allows for a faster download time, as compared to a second ECI that uses pre-rendered bitmaps to provide the animation where the function of the first and second ECI are the same.

As described above, in regards to virtualization, the present invention is not limited to resource partitioning. Other examples of virtualization that may be employed in embodiments of the present invention are described as follows. Via Intel's Virtualization Technology (or the corresponding AMD technology), these microprocessor vendors have introduced features in their micro-architectures that may improve the processor's ability to run multiple operating systems and applications as independent virtual machines. Using this virtualization technology, one computer system can appear to be multiple "virtual" systems. Thus, in various embodiments, a gaming environment utilizing virtual gaming machines where the operating systems may vary from virtual gaming machine to virtual gaming machine may be employed. In a particular embodiment, a virtual gaming machine may use a core of a multi-core processor.

A virtual gaming machine may use a virtual machine monitor (VMM) A virtual machine monitor may be a host program that allows a single computer to support multiple, identical execution environments. All the users may see their systems as self-contained computers isolated from other users, even though every user is served by the same machine. In this context, a virtual machine may be an operating system (OS) that may be managed by an underlying control program.

Low interrupt latency, direct access to specialized I/O, and the assurance that a VMM won't "time slice away" the determinism and priority of real-time tasks may be important for a real-time virtual gaming machine used in a gaming environment. In one embodiment of the present invention, the combination of multi-core CPUs and Intel VT or a related technology may be used to build a real-time hypervisor based on dynamic virtualization.

A real-time hypervisor may be a VMM that uses hardware virtualization technology to isolate and simultaneously host general-purpose operating systems and real-time operating systems. Unlike a static virtualization, the dynamic virtualization implemented by a real-time hypervisor may use an "early start" technique, to take control of the hardware platform. Thus, operating systems may only be allowed to "boot" only after the real-time hypervisor has constructed a virtual machine for them. The guest operating system may be associated with a particular game provided by a software provider. Thus, in the present invention, a gaming platform may support games provided by multiple software vendors where different games may be compatible with different operating systems.

In the processors that include Intel VT an overarching operating-mode has been added, called VMX root, where a hypervisor executes with final control of the CPU hardware. A hypervisor that uses Intel VT may intercept key supervisor-mode operations executed by any software operating outside of VMX root without requiring a prior knowledge of the guest OS binaries or internals. Using this Intel VT hardware assist for virtualization, one may build a hypervisor VMM that hosts protected-mode operating systems executing in ring 0 without giving up control of key CPU resources. Also, Intel VT provides a way for the VMM to implement virtual interrupts.

In the present invention, static and dynamic virtualization may be used. Nevertheless, two advantages to building a multi-OS real-time system by using dynamic virtualization rather than static virtualization may be: first, a wide range of operating systems, both general-purpose and real-time, may be supported and, second, the boot sequence for each guest OS may be under the control of the hypervisor. The second advantage means it may possible, in embodiments of the present invention, to restart one guest OS while other guest operating systems continue to run without interruption.

TenAsys provides an example of a hypervisor that may be used in embodiments of the present invention. The hypervisor may be capable of supporting the demands of a Real-time operating system (RTOS) while simultaneously hosting a general-purpose operating system (GPOS), like Windows or Linux. The hypervisor may enhance real-time application responsiveness and reliability in a "multi-OS, single-platform" environment, by providing control over interrupt latency and partitioning of I/O resources between multiple guest operating systems.

In various embodiments, the hypervisor may be used to distinguish between resources that may be multiplexed by the VMM and those that are exclusive to a virtual machine. For example, when user interface I/O is not associated with time-critical events, input devices like the keyboard, mouse, console, disk, and an enterprise Ethernet interface may be multiplexed and shared between all virtual machines. However, hardware that is specific to a real-time control application, such as a video capture card, fieldbus interface, or an Ethernet NIC designated for communication with real-time I/O devices, may not be multiplexed between virtual machines. Using the hypervisor, specialized real-time I/O may be dedicated to its real-time virtual machine, so the RTOS and application using that I/O can maintain real-time determinism and control.

In one embodiment of a VMM some or all of the memory in each virtual machine may be swapped to disk, in order to more efficiently allocate limited physical RAM among multiple virtual machines. In another embodiment, a real-time hypervisor may be used to guarantee that each real-time virtual machine is locked into physical RAM, and is never swapped to disk. This approach may be used to insure that every real-time event is serviced consistently, with deterministic timing. In yet another embodiment, the hypervisor may used to dedicate a core in a multi-core processor to a virtual machine, such as a virtual gaming machine.

Figure 9A:
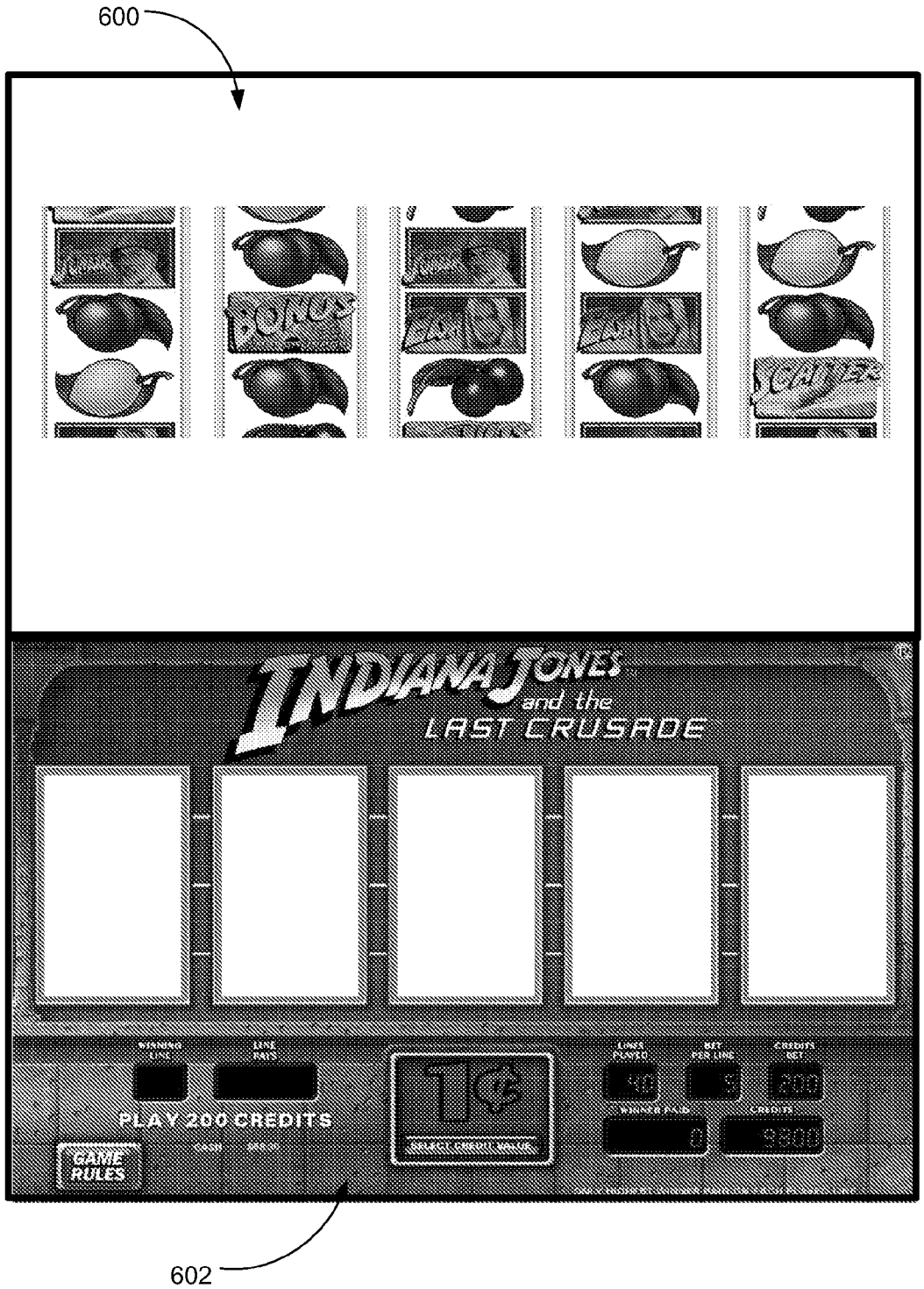
FIGS. 9A-N are examples of video content for multi-layer displays, with and without an externally controlled interfaces, for various embodiments of the present invention.
Figure 9B:
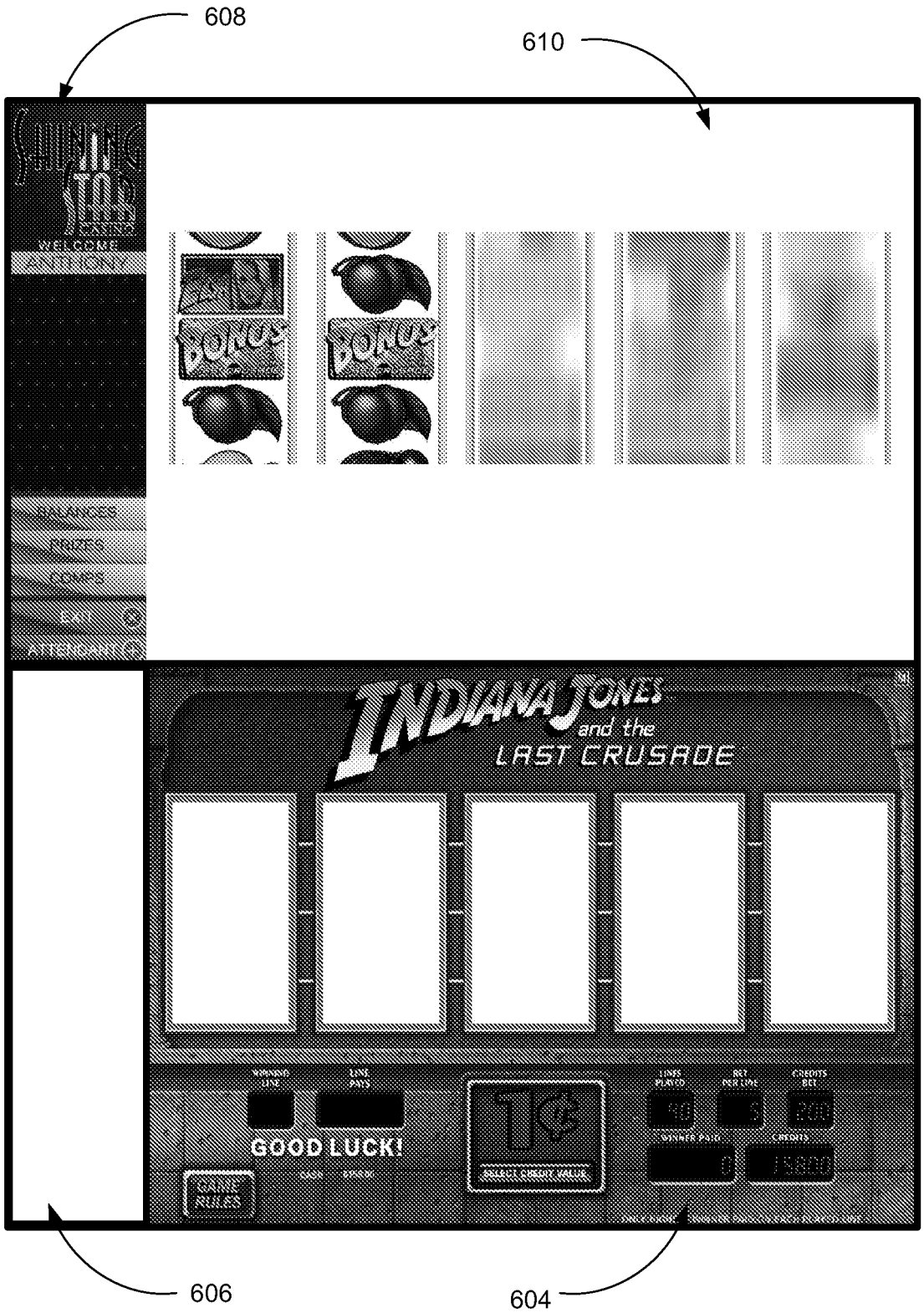
Figure 9C:
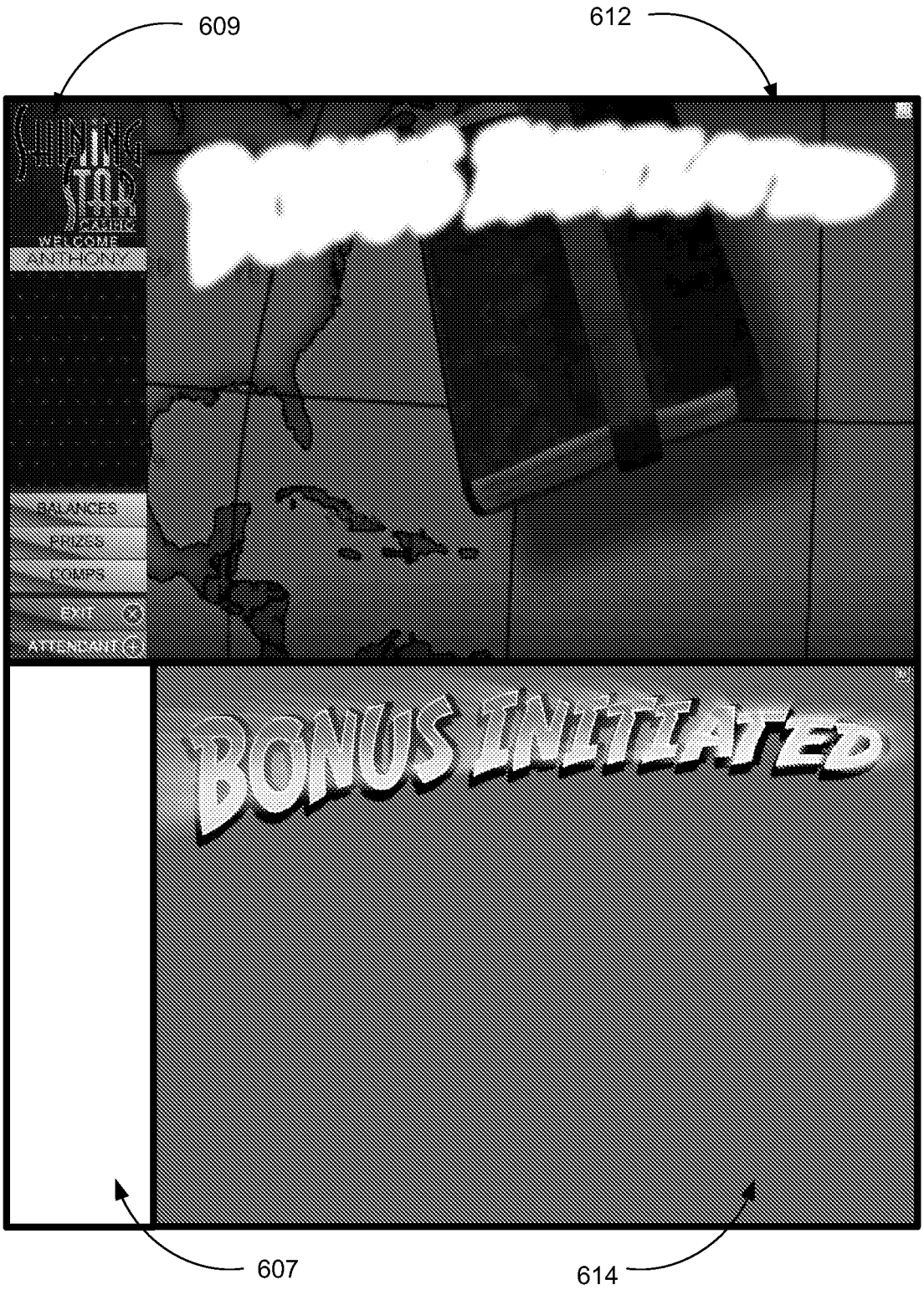
Figure 9D:
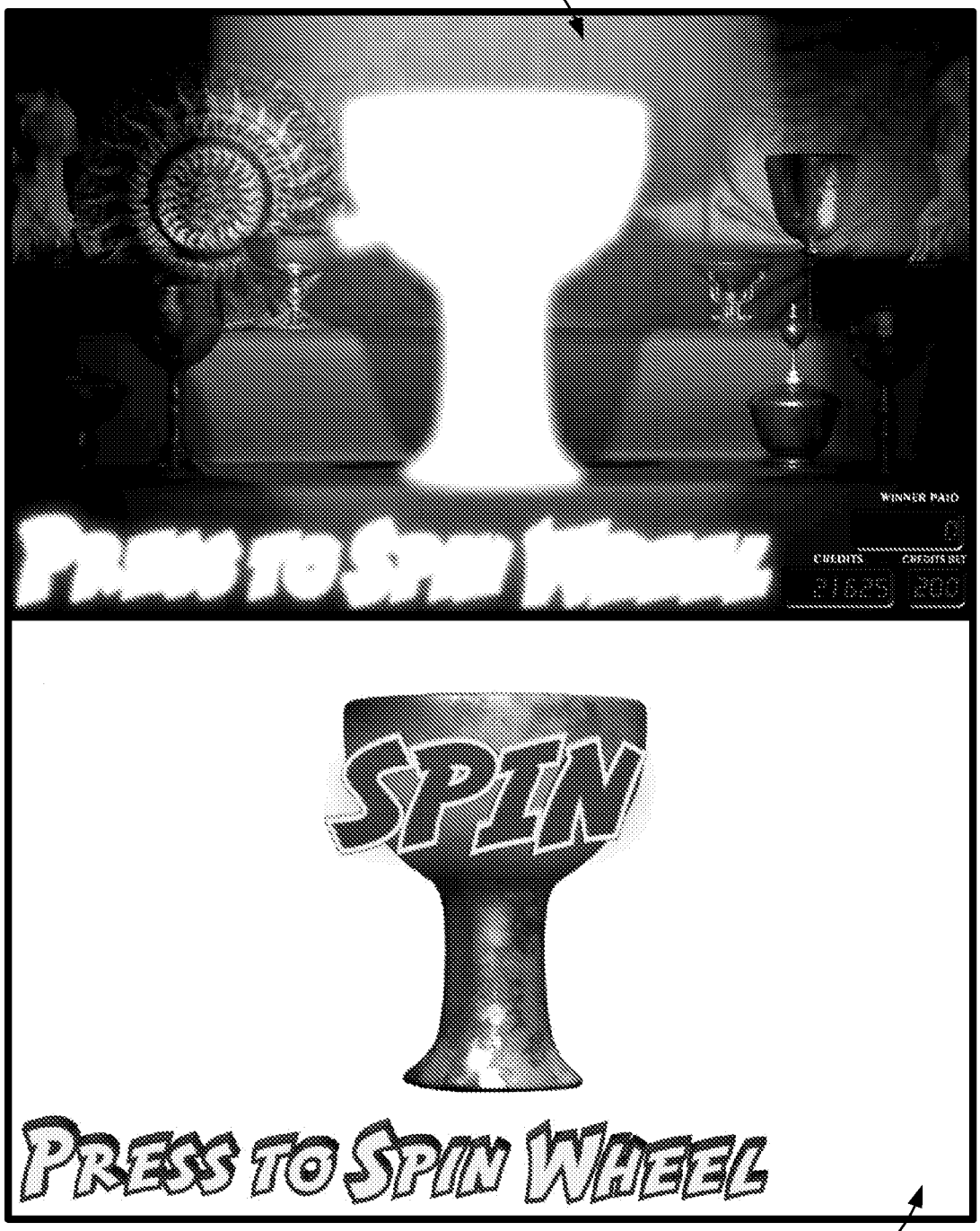
Figure 9E:
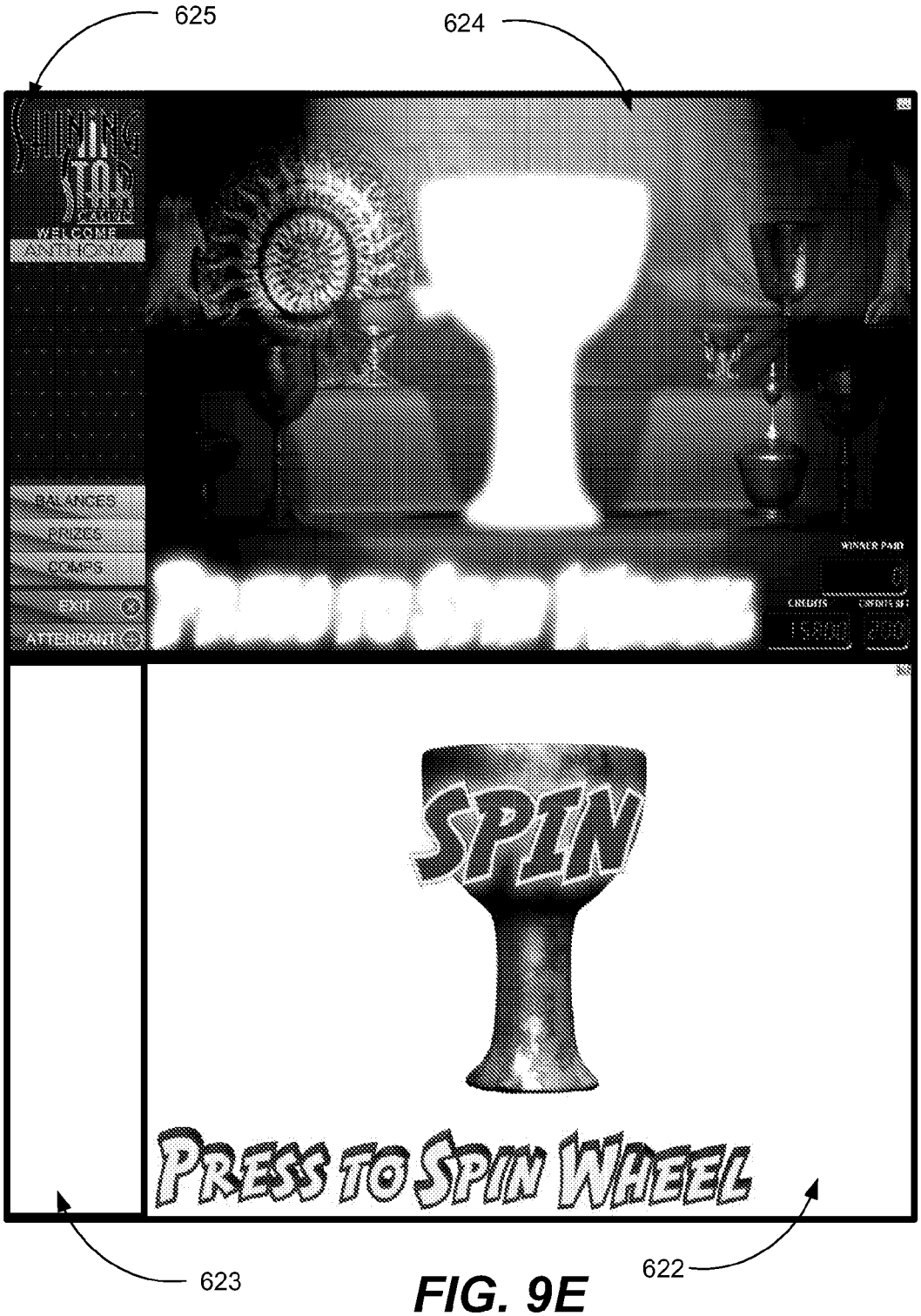
Figure 9F:
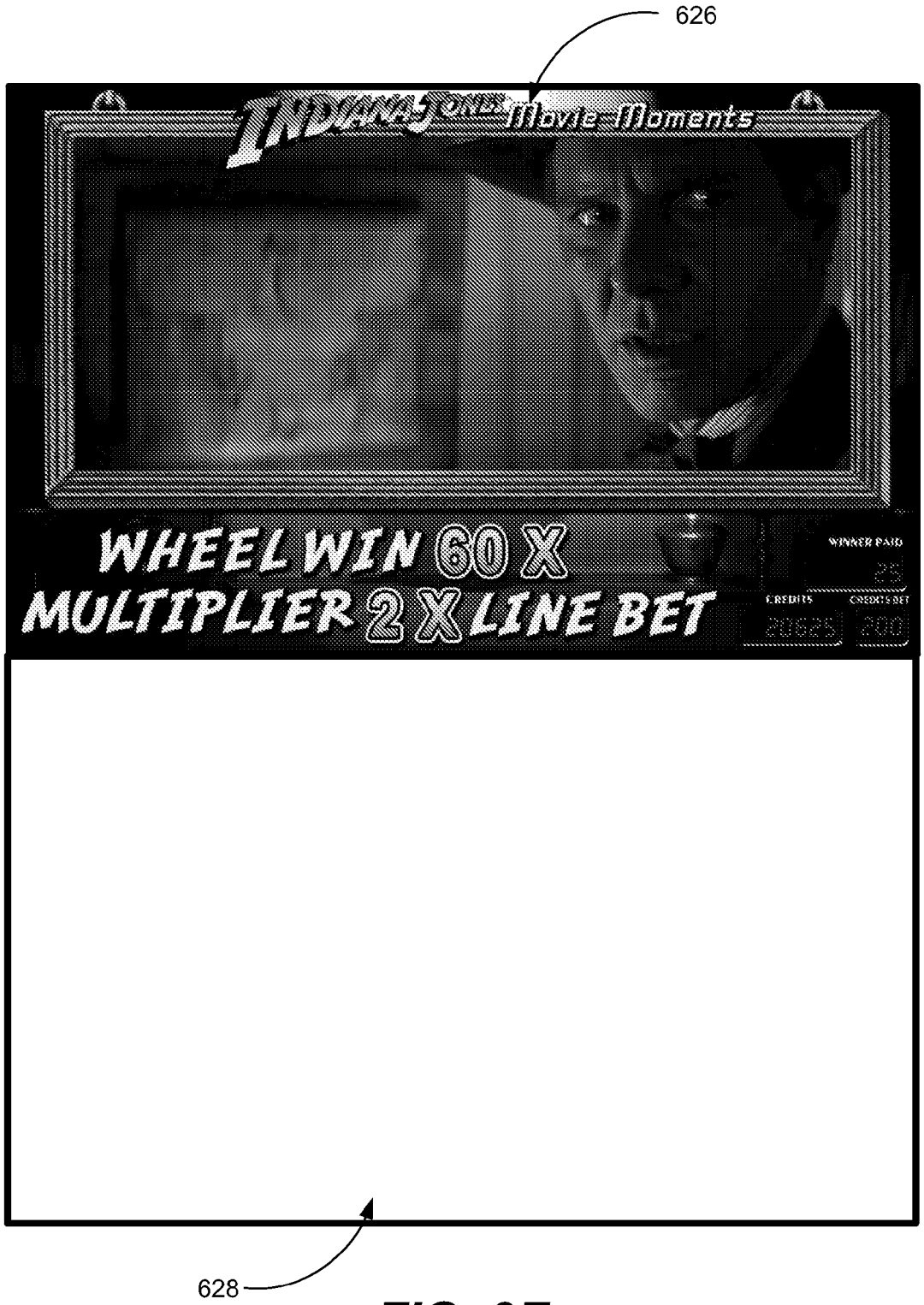
Figure 9G:
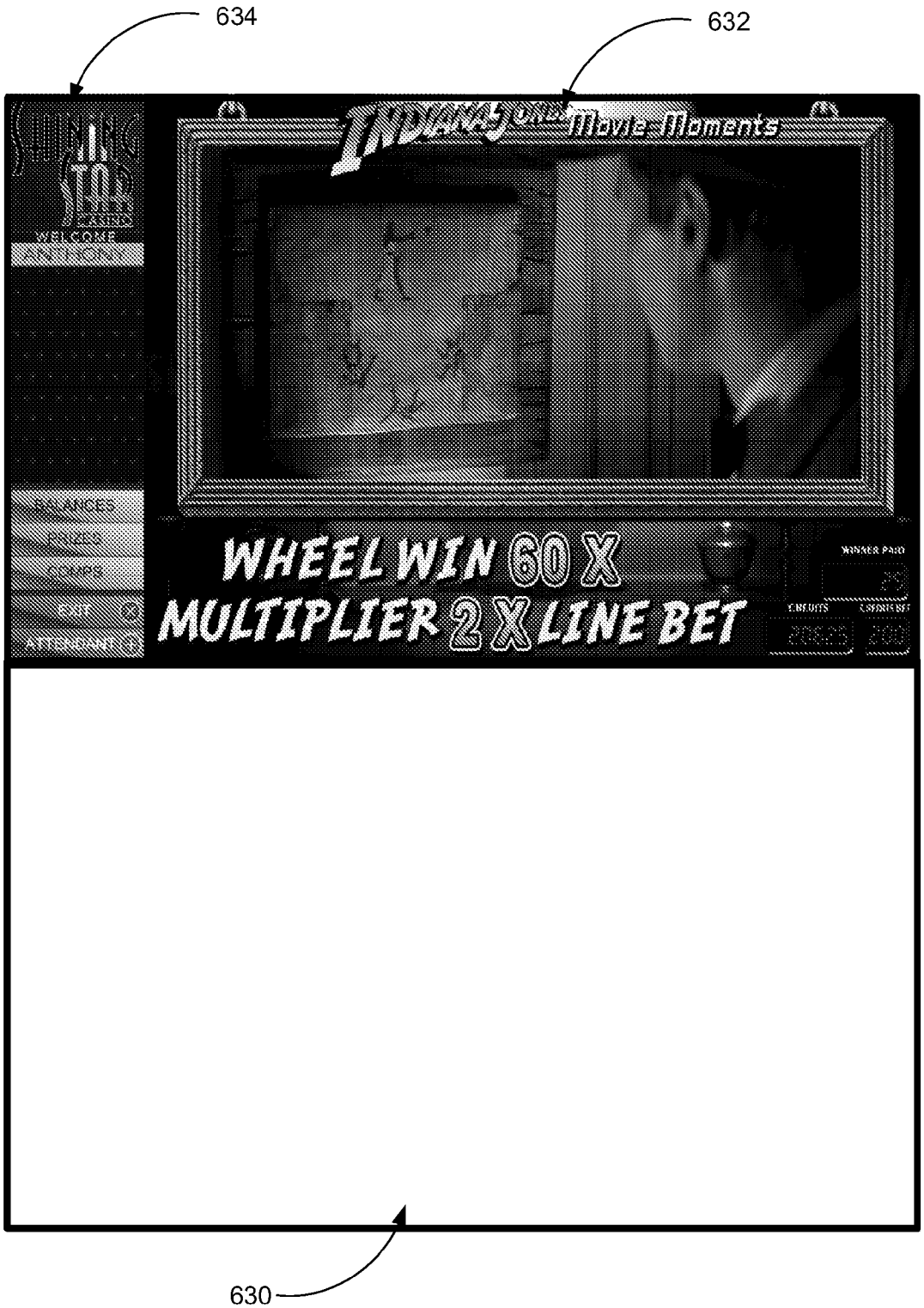
Figure 9H:
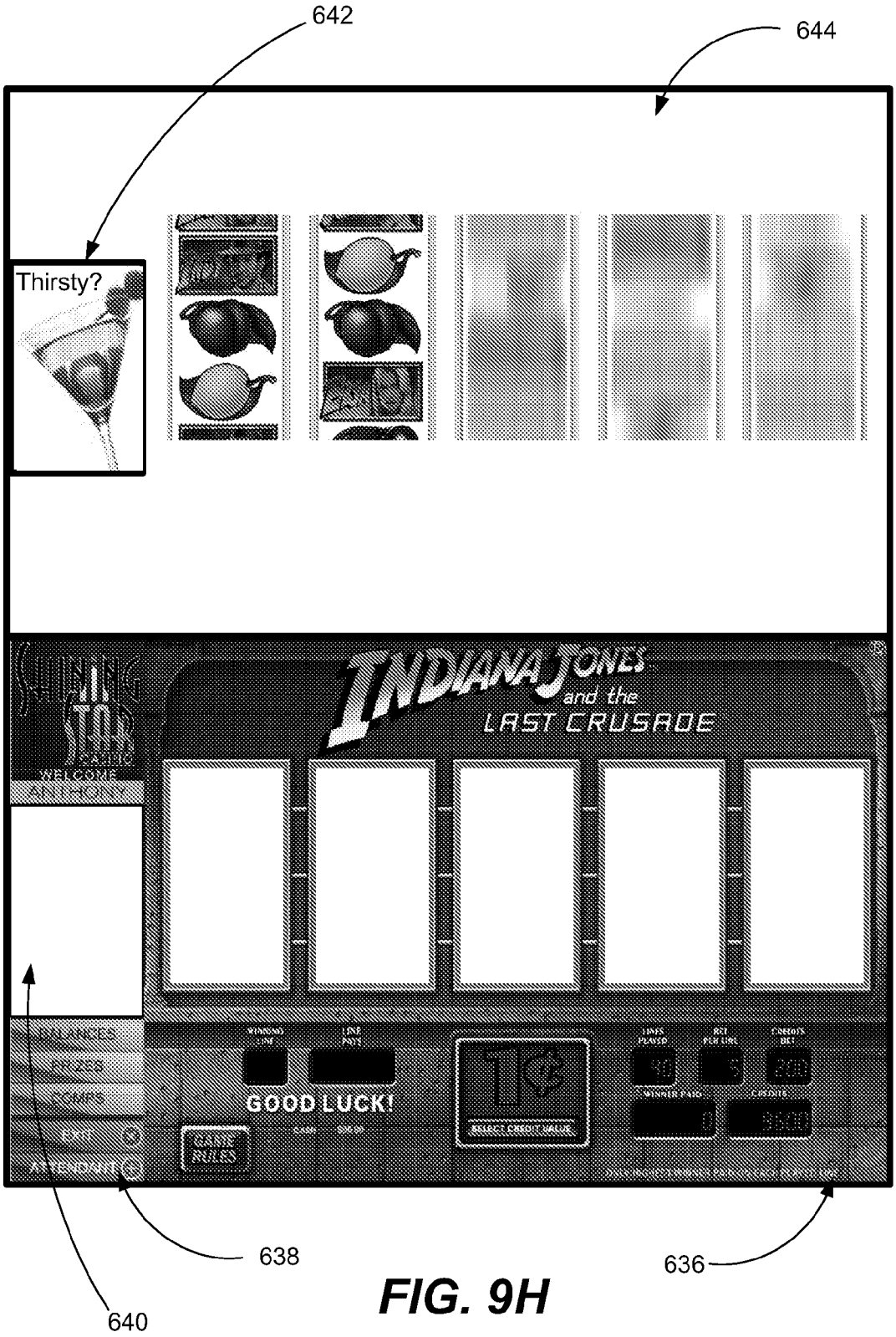
Figure 9I:
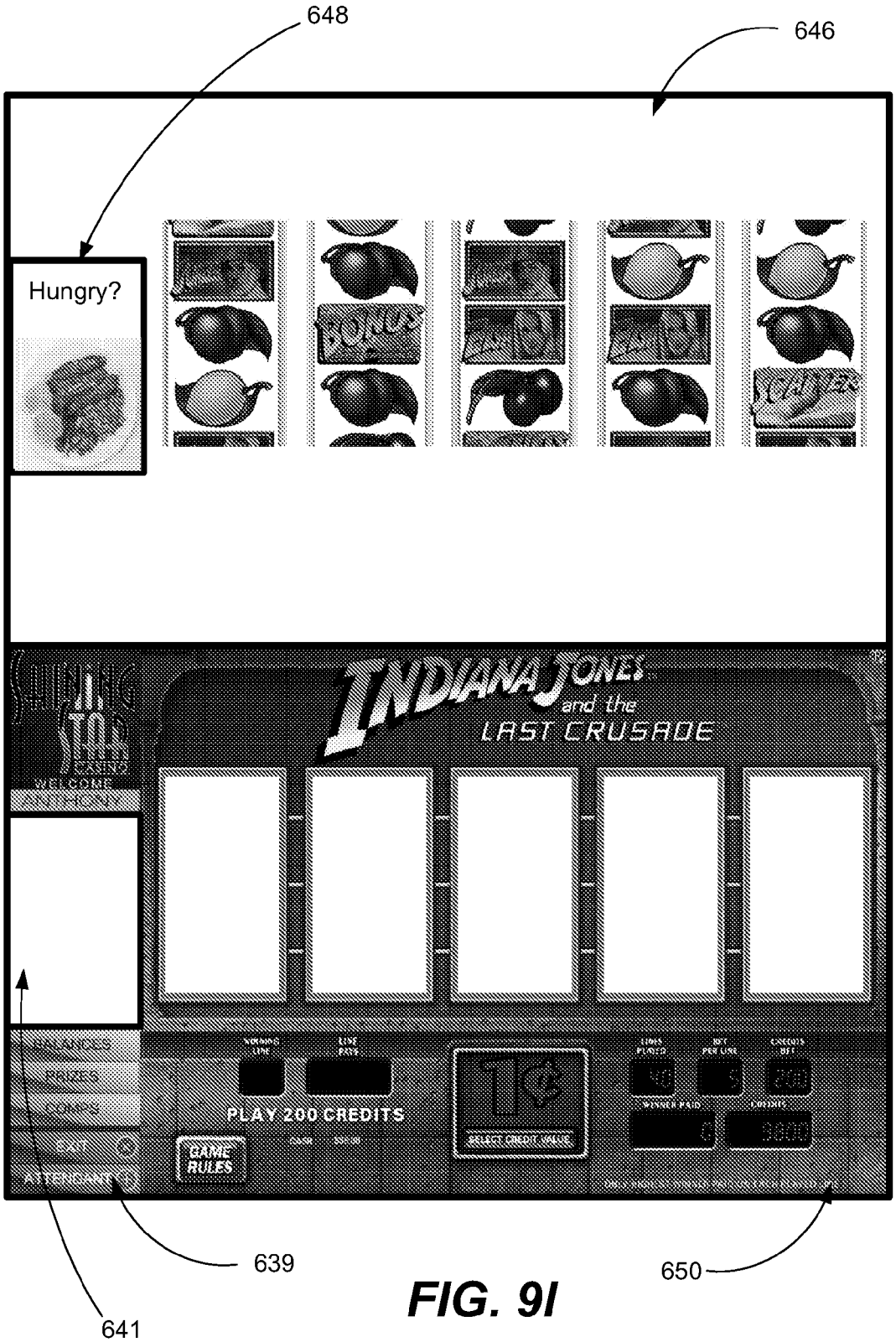
Figure 9J:
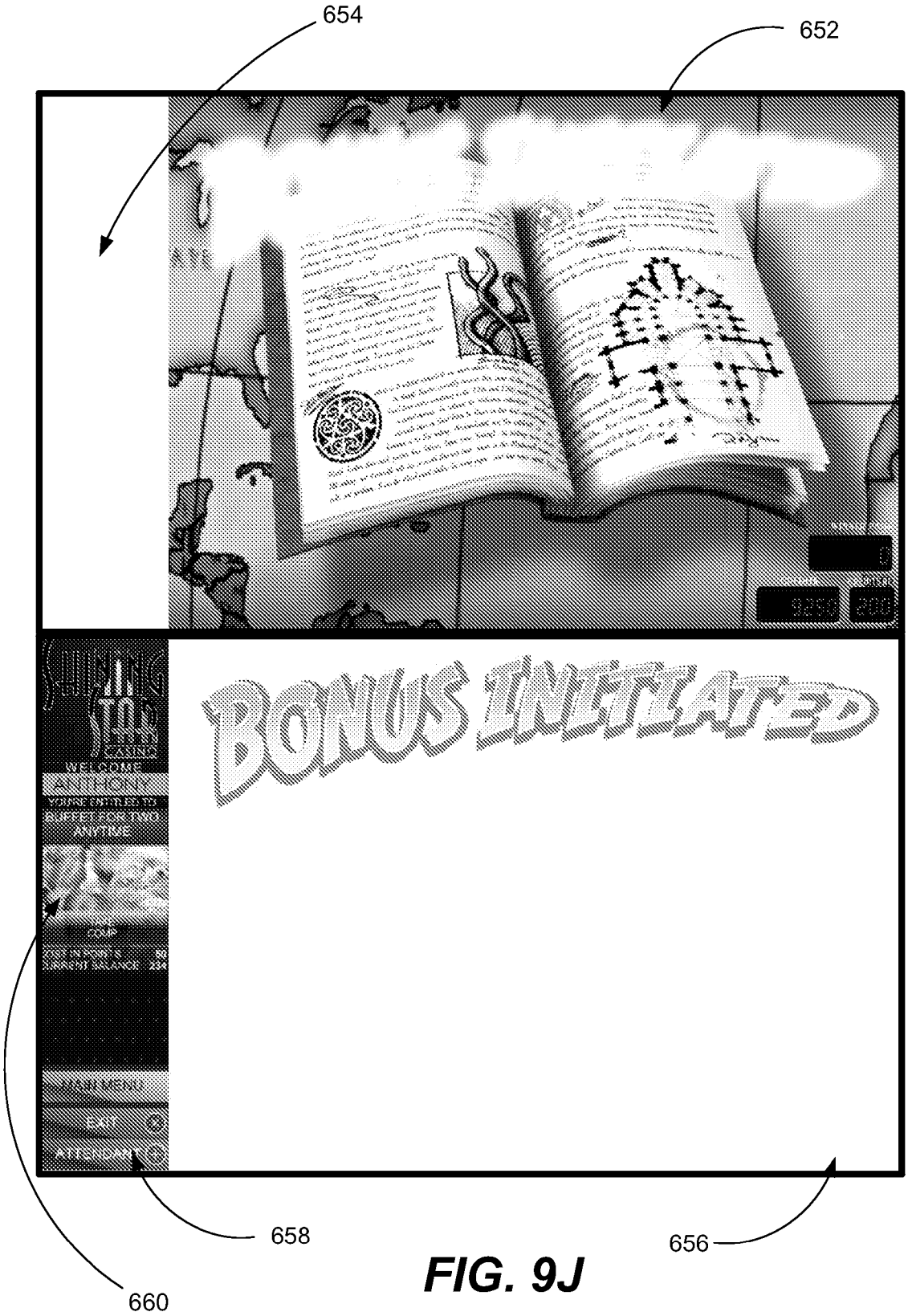
Figure 9K:
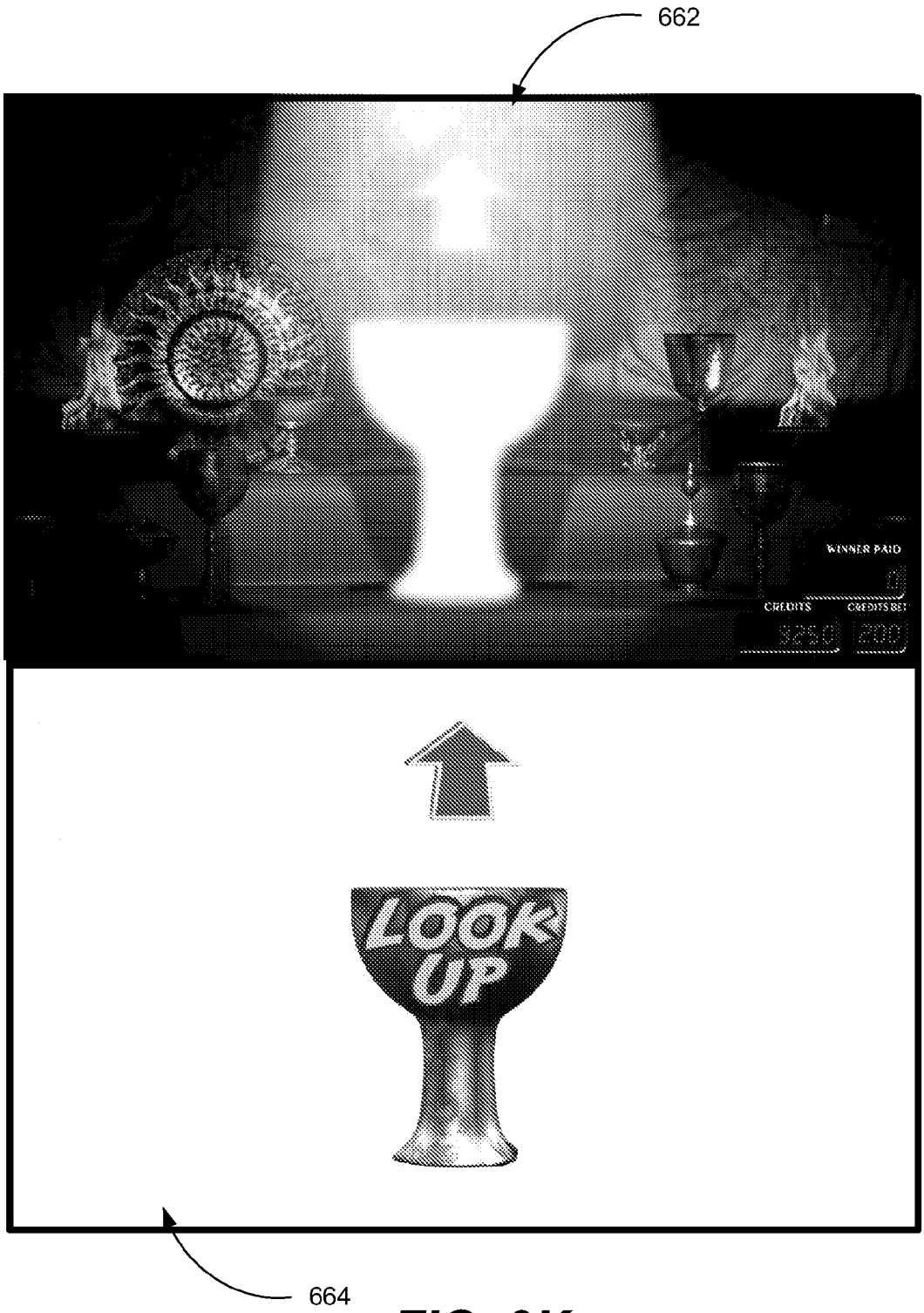
Figure 9L:
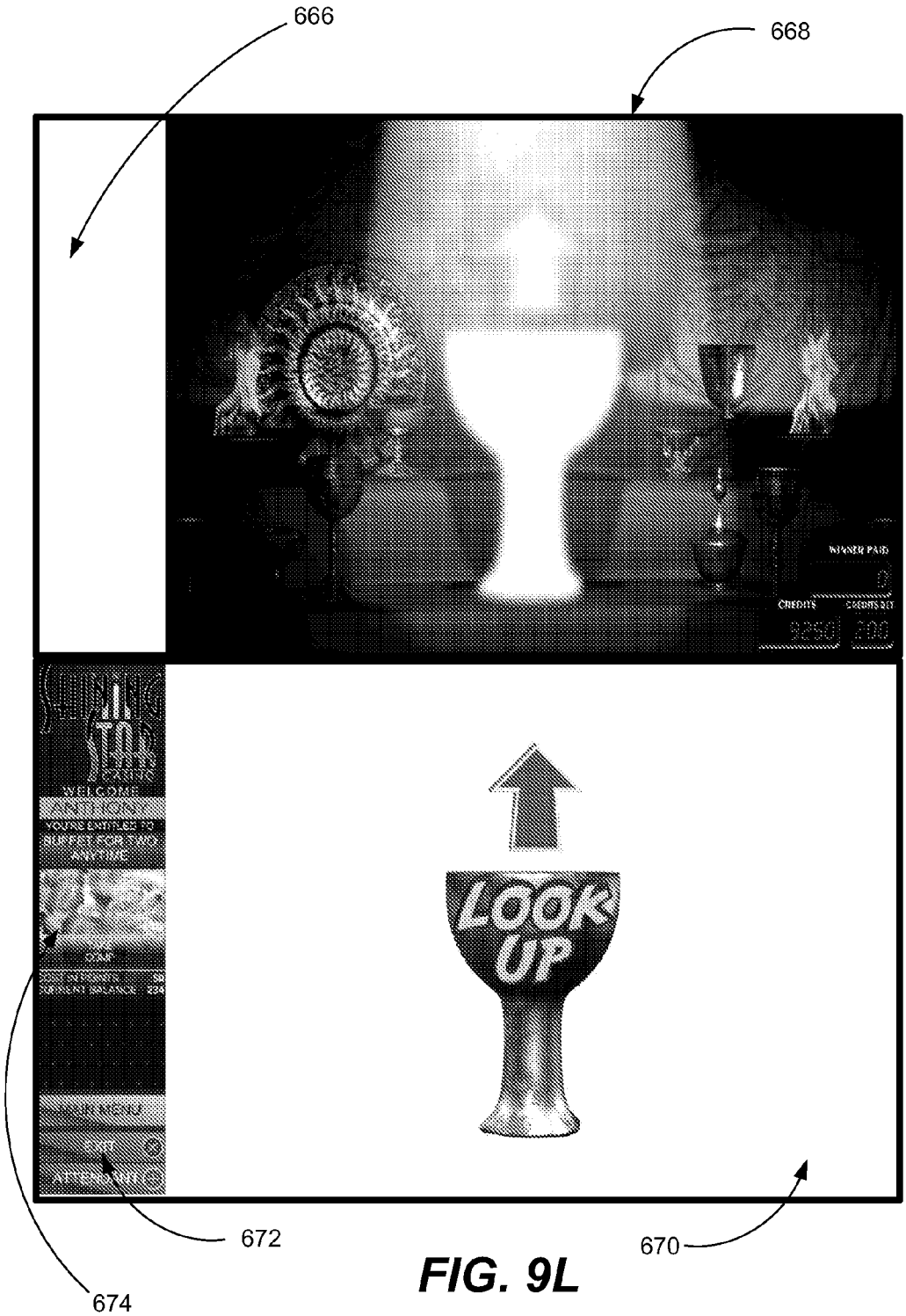
Figure 9M:
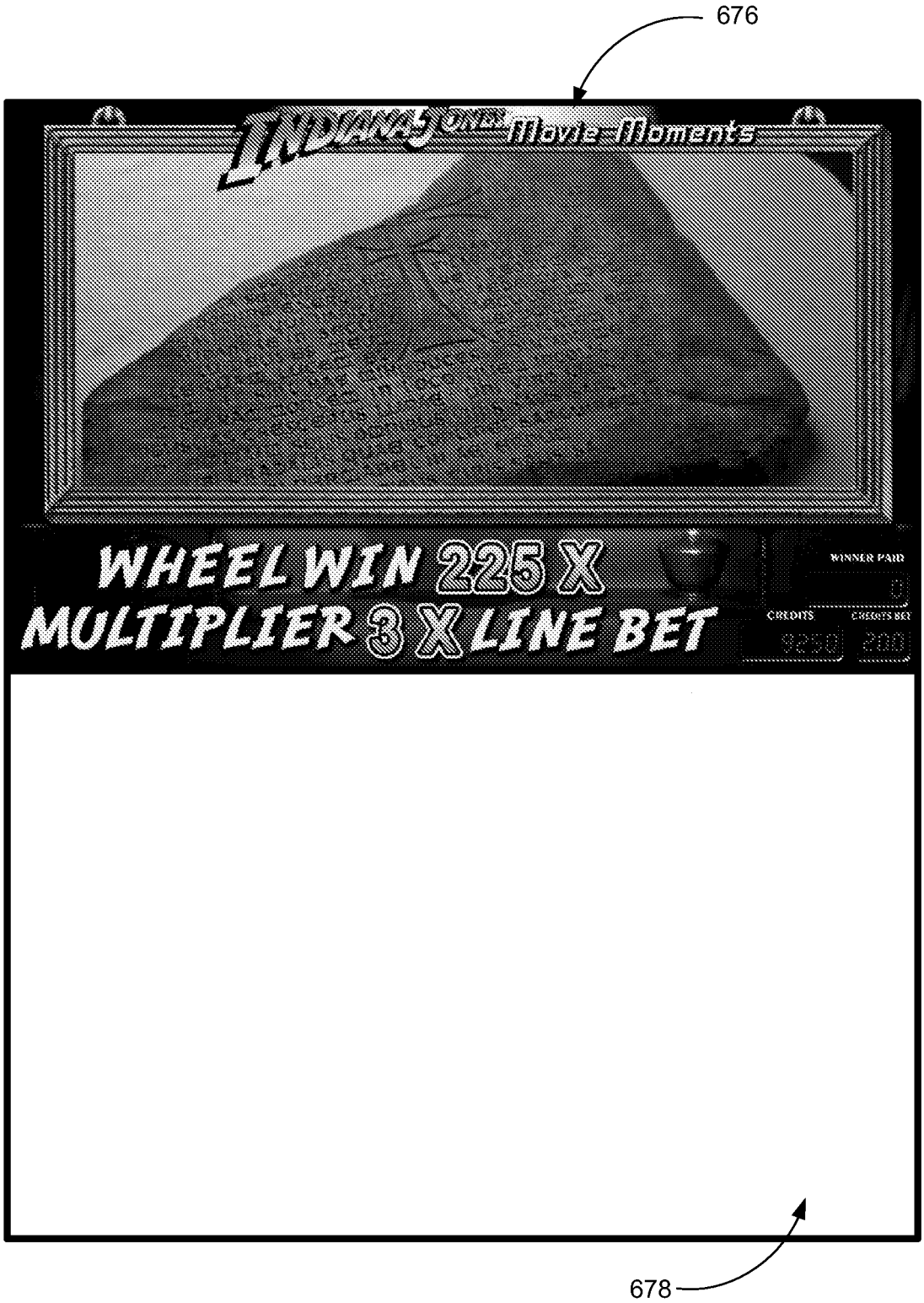
Figure 9N:
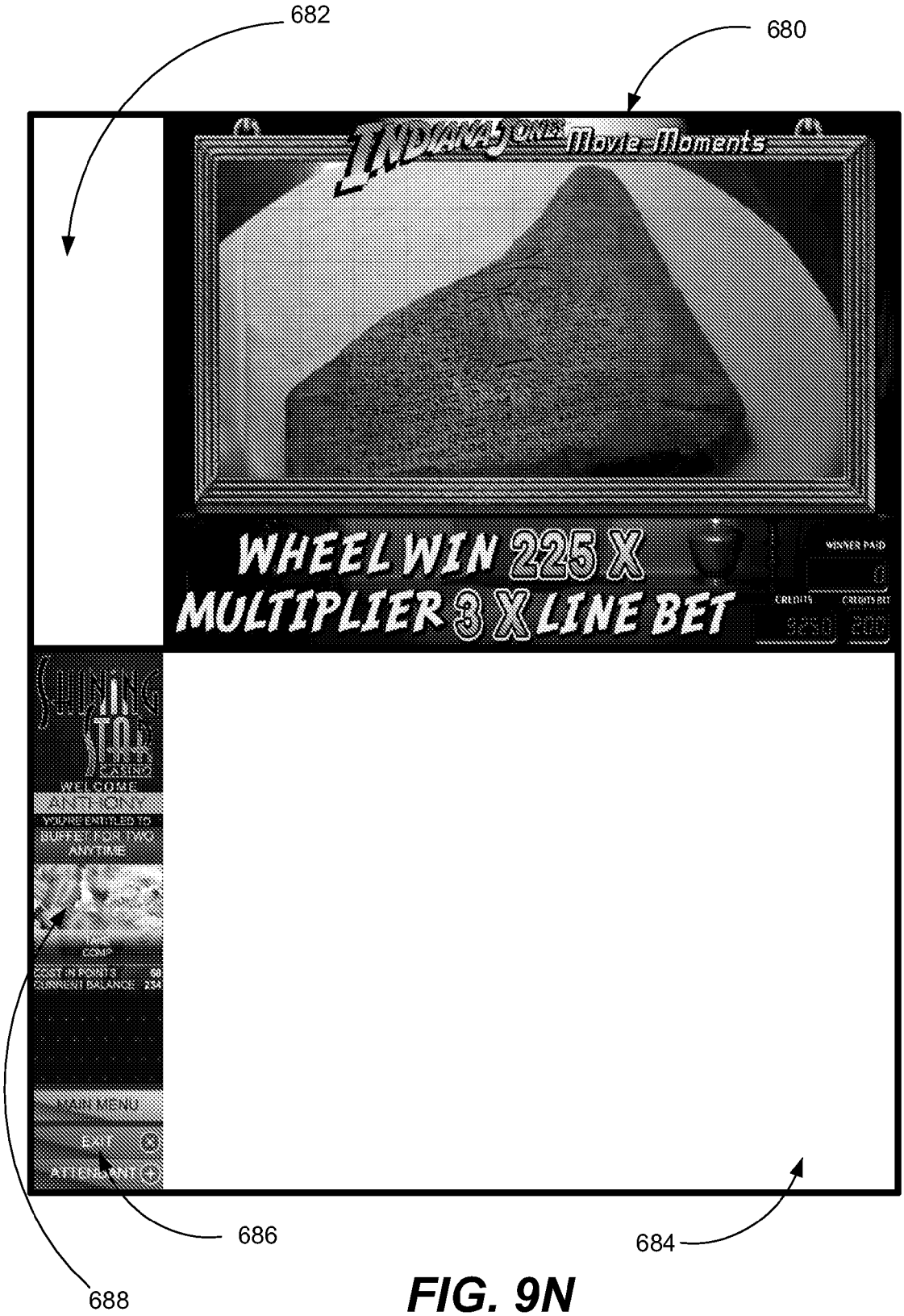

FIGS. 9A-N are examples of video content for multi-layer displays, with and without an externally controlled interfaces, for various embodiments of the present invention. The figures include composite images with two parts. A top half of each composite image is derived from video data that is designed to be displayed on a back layer of a multilayer display and a lower half of the image is derived from video data designed to be displayed on a front layer of a multilayer display. The top half and the bottom half of each composite image are designed to be displayed at the same time on a back layer and a front layer of a multilayer display.

For the purposes of illustration, the composite images may be related to different game states that can occur during a play of a wager-based game on a gaming machine including a multilayer display. The composite images generally include a primary game state or a secondary game state that may be generated by a master gaming controller on the gaming machine. In particular, the primary game state and the secondary game state may be controlled by one or more processes executed by the master gaming controller in response to input received at the gaming machine. Interspersed with the primary game state and second game state images generated by the master gaming controller are images derived from video content that may be generated using commands, instructions and/or data provided by a remote host.

Using a process executed by the master gaming controller, such as an ECI process, the remote host may control output of video content on one or more layers of the multilayer display while the master gaming controller controls output of video content on the one or more layers of the multilayer display related to a primary or secondary game state. In other embodiments, a remote device, such as a game server, may control output of the video content related to the primary game state and the secondary game state. For instance, first remote host may use a first ECI process to control video content related to the primary game states, the secondary game states or combinations thereof, while a second remote host may use a second ECI process to control video content related to the player specific functions illustrated in the figures. As discussed with respect to at least FIG. 8, the master gaming controller may execute one or more processes that allow a remote host to access and to control output of video content on all or portion of one or more layers of a multilayer display.

In FIGS. 9A-9N, examples are provided where a remote host via an ECI is allowed to access and control output of video content at various times on a portion of one or more layers of the multilayer display of a first size and location. These examples are not meant to be limiting as a remote host may be allowed to access and control output of video content on portions of the multilayer display of different sizes, at different locations, with different shapes and using different display screen resolutions. Further, a remote host via an ECI may be allowed to control video output on an entire screen of a layer of a multilayer display device and not just a portion of the screen of the video display device.

In FIG. 9A, video data for a slot game is depicted for the purposes of illustrations only as other games may also be generated on the multilayered display devices described herein. Video content 600 for a back layer of a multilayer display includes depictions of slot reels. Video content 602 for a front layer of a multilayer display includes 5 transparent portions that allow the slot reels to be viewed through the front display and includes non-transparent portions that provide game information, such as credits, lines played, denomination, award amount, etc. The output of the video data 600 and 602 may be controlled by the master gaming controller on the gaming machine.

In FIG. 9B, video content 608 controlled by a remote host is depicted on a portion of the back layer. The video content 606 on the front layer is a transparent portion which allows the video content 608 on the back layer to be viewed. The video content 608 is associated with a player interface that allows a player to access balances, prizes, comps, navigate a menu and request and attendant. The remote host may control output of the video content 608 using an ECI as previously described.

The remote host may be allowed to control output of the video content 608 while a wager-based game is being played. In FIG. 9B, an on-going wager-based game is depicted as reels spinning in 610. The front layer of the video content associated with the wager-based game is comparable to the depiction in FIG. 9A, which may represent a state of the gaming machine between games.

In particular embodiments, the master gaming controller may be operable to render video images at different sizes, at different locations and using different display screen resolutions to allow a remote host to control output of video content on a portion of one or more layers of a multilayer display while the master gaming controller controls output of video content on remaining portions of the one or more layers of the multilayer display. Thus, a difference between FIGS. 9A and 9B is that the reels depicted on the back layer in 610 occupy a smaller portion of the back layer display than in 600 and the associated frame that provides game information in 604 is smaller than in 602. The video data associated with the primary game state may be rendered in a portion of the front and back layers of the multilayer displays to allow the video content output under control of the remote host 608 to be viewed.

In FIG. 9C, a back layer and a front layer of a multilayer display comprises video content 609 for the player interface and a transparent portion 607 output under the control of a remote host and video content 612 and 614 associated with a secondary game state, i.e., an initiation of a bonus game state, output under the control of a master gaming controller. In FIG. 9D, a bonus game state is depicted on the front and back layers of multilayer display via video content 616 and 618 that are output under control of the master gaming controller.

In the example, in FIG. 9D, the video content 616 and 618 utilizes the front and back layers of the multilayer display in their entirety. In some instances, during certain game states, a remote host may not be allowed to access one or more layers of the multilayer display and thus, video content associated with an ECI may not be visible as depicted in FIG. 9D during the bonus game presentation. In other embodiments, the ECI may be instantiated or closed under player control and thus, may or may not be open at different times during game play and hence not visible. In yet other embodiments, as is shown in FIG. 9E, the video content associated with an ECI, 625 and 623, may be visible during a bonus game depicted by video content 622 and 623.

In FIG. 9F, video content associated with a bonus game state including a movie is output under control of the master gaming controller in 626 and 628. In this example, the movie is only displayed on back layer of the multilayer display and the front layer of the multilayer display is entirely transparent. In FIG. 9G, the video content 632 associated with the movie in FIG. 9F is rendered at a different size on the back layer of the multilayer display whereas the front layer is entirely transparent. The video content 632 including the movie is rendered with a different size to accommodate video content associated with a player interface 634, output under control of a remote host, to be depicted on the back layer of the multilayer display. In particular embodiments, a remote host may control output of a video data including a movie using an ECI instantiated on the gaming machine.

In FIG. 9H, under control of the master gaming controller, video content 636 and 644 associated with a play of wager-based game including slot reels is depicted on a respective portions of a front layer and a back layer of the multilayer display. Under control of the remote host, video content 638 and 642 is output to a portion of the front layer and a back layer of the multilayer display. The video content on the front layer includes the player interface 638 and a transparent portion that allows the video content 642, which is an image of drink, to be viewed on the back layer. The remote host may be control output of still images or moving images. For example, video content 642 may be a video frame from a series of images showing the drink being made.

In FIG. 9I, like in FIG. 9H, under control of the remote host, video content 639 and 642 is output to a portion of the front layer and a back layer of the multilayer display where the video content 639 includes a transparent portion 641 that allows video content 642 to be viewed through the front display. The video content 648 is associated with food. The video content 650 and 646 may be associated with a game state between games. In other embodiments, the video content depicted in FIGS. 9H and 9I, as well as any of the previous FIGS. 9A-9G may represent a series of game states in a play of a wager-based game. The order of the game states may be different than order in which the figures were presented. For instance, FIG. 9I may come before FIG. 9H followed by FIG. 9B and then FIG. 9A in regards to depicting a sequence of game states.

In FIG. 9J, video content 652 and 656 associated with initiation of bonus and under control of the master gaming controller is depicted. Video content 658 and 654 associated with the player interface under control of the remote host is also depicted on the front and back layers of the multilayer display. In particular, the video content 658 for the player interface, which is only on the front display, includes video content 660 related to an offer for a buffet meal. In FIG. 9K, video content for the bonus state 668 and 670 is displayed on the front and back layers of the multilayer display and the video content associated with remote host is not visible as the front and back layers in their entirety are used to display the video content for the bonus state. In FIG. 9L, the video content 668 and 670 for the bonus state is rendered using a different display screen resolution under control of the master gaming controller and the video content 666, 672 and 674 is rendered on only the front video display device of the multilayer video display device.

In particular embodiments, via an ECI, the remote host may be allowed to only control a portion of a front layer of the multilayer display or a portion of the back layer of the multilayer display. For example, in FIG. 9L, the remote host may only be allowed to control the portion of the multilayer display in the front including video content 672 and 674 and may not be allowed to control the back layer. Since controlling both a front layer and back layer of a multilayer display may require video content for both layers to be downloaded from a remote host, in some instances, such as during periods of high network utilization, a remote host may be granted limited access to the layers of the multilayer display, such as one layer only, which may be a front layer or a back layer.

In FIG. 9M, video content 676 including a movie is displayed on the back layer 676 only. In FIG. 9N, video content 680 related to the movie depicted in FIG. 9M is depicted at a different size on the video display of the back layer. The different size of the video content 680 allows video content controlled by a remote host 686 and 688 to be rendered on the front layer of the multilayer display and not block a display of the video images on the back layer.

Although the foregoing invention has been described in some detail for purposes of clarity of understanding, it will be apparent that certain changes and modifications may be practiced within the scope of the appended claims. Therefore, the present examples are to be considered as illustrative and not restrictive, and the invention is not to be limited to the details given herein, but may be modified within the scope of the appended claims.

What is claimed is:

1. A gaming machine comprising:

a cabinet defining an interior region of the gaming machine, the cabinet adapted to house a plurality of gaming machine components within or about the interior region;

a first video display device, disposed within or about the interior region, configured to output a visual image in response to a control signal including a first display screen;

a second video display device arranged inside the interior region relative to the first video display device including a second display screen; and a communication interface for communicating with a remote host;

a master gaming controller designed or configured to:

a) communicate with the remote host, the first video display and the second video display device, b) control output of video data for multiple video reels on the second video display device, c) control output of video data on the first video display device that includes multiple transparent video windows and a non-transparent video portion that separates each pair of adjacent transparent video windows, where a common line of sight passes through each transparent window on the first video display device to a video reel displayed on the second video display device, d) generate a first process operable to output first video data to the first video display device and to output second video data to the second video display device wherein content of the first video data and content of the second video data over time is controlled by the remote host, e) receive commands, instructions, data or combinations thereof from the remote host that allow the first process to output the first video data, the second video data or combinations thereof, f) generate a second process operable to generate an outcome to a play of a wager-based reel game of chance that uses the multiple video reels output to the second video display device, g) generate a third process operable to control access of the first process to the first video display device and the second video display device and operable to control access of the second process to the first video display device and the second video display device wherein the third process is operable to allow the first process to utilize one of a first portion of the first video display device, a second portion of the second video display device or combinations thereof while the multiple video reels are displayed on the second video display device, and h) monitor at least one gaming machine resource utilized by the first process and to prevent the first process from utilizing more than a limited amount of the at least one gaming machine resource; and an input mechanism for receiving cash or an indicia of credit for making wagers on the wager-based reel game of chance; and an output mechanism for outputting cash or an indicia of credit.

2. The gaming machine of claim 1 wherein a display panel for the first video display device and a display panel for the second video display device are about parallel.

3. The gaming machine of claim 2 wherein the first video display device and the second video display device include a set distance between the display panel for the first video display device and the display panel for the second video display device, and the set distance is less than about 10 centimeters.

4. The gaming machine of claim 1 wherein the video data displayed on the second video display device includes video data for five video reels on the second video display device, and the video data displayed on the first video display device includes five transparent windows, each in front of a video reel included in the five video reels.

5. The gaming machine of claim 1, wherein the master gaming controller is further designed or configured to control output of the video data for the multiple reels using two or more different display screen resolutions on the second video display device and to control output of the video data that includes the multiple transparent video windows and the non-transparent video portion that separates each pair of adjacent transparent video windows using two or more different display screen resolutions on the first video display device wherein a pair of screen resolutions for the first video display device and the second video display device are selected to maintain the common line of sight that passes through each transparent window on the first video display device to the video reel displayed on the second video display device.

6. The gaming machine of claim 5, wherein the master gaming controller is further designed or configured to select the pair of screen resolutions to allow the video data for the multiple reels to be displayed on a portion of a display screen of the second video display device and to allow the video data that includes the multiple transparent video windows and the non-transparent video portion that separates each pair of adjacent transparent video windows to be displayed on a portion of a display screen of the first video display device.

7. The gaming of claim 6, wherein the pair of screen resolutions is selected in response to the third process allowing the first process to utilize one of the first portion of the first video display device, the second portion of the second video display device or the combinations thereof.

8. The gaming machine of claim 1, wherein the master gaming controller is further designed to control output of video data comprising gaming content on the second video display device and to control output of video data comprising at least one transparent portion and at least one non-transparent portion on the first video display device wherein the video data comprising the gaming content on the second display device is viewable through the transparent portion on the first display device.

9. The gaming machine of claim 8, wherein the gaming content is related to play of a bonus game on the gaming machine.

10. The gaming machine of claim 8, wherein the master gaming controller is further designed or configured to control output of the video data comprising gaming content using two or more different display screen resolutions on the second video display device and to control output of the video data comprising the at least one transparent portion and the at least one non-transparent portion using two or more different display screen resolutions on the first video display device wherein a pair of screen resolutions for the first display device and the second display device are selected so that the video data comprising the gaming content on the second display device is viewable through the transparent portion of the first display device.

11. The gaming machine of claim 10, wherein pair of screen resolutions is selected in response to the third process allowing the first process to utilize one of the first portion of the first video display device, the second portion of the second video display device or the combinations thereof.

12. The gaming machine of claim 1, wherein the content of the first video data and the content of the second video data is downloaded from the remote host.

13. The gaming machine of claim 1, wherein the content of the first video data and the content of the second video data is downloaded from a remote device separate from the remote host.

14. The gaming machine of claim 1, wherein the master gaming controller is further designed or configured to 1) allow the first process to output only the first video data to the first portion of the first video display device wherein the content of the first video data is controlled by the remote host and 2) in response, adjust the video data displayed for the multiple video reels on the second video display device and the video data displayed on the first video display device that includes multiple transparent video windows and the non-transparent video portion that separates each pair of adjacent transparent video windows.

15. The gaming machine of claim 1, wherein the master gaming controller is further designed or configured to 1) allow the first process to output only the second video data to the second portion of the second video display device wherein the content of the second video data is controlled by the remote host and 2) in response, adjust the video data displayed for the multiple video reels on the second video display device and the video data displayed on the first video display device that includes multiple transparent video windows and the non-transparent video portion that separates each pair of adjacent transparent video windows including adding a first non-transparent portion displayed on the first video display device that allows the content of the second video data controlled by the remote host to be viewed through the first video display device.

16. The gaming machine of claim 1, wherein the master gaming controller is further designed or configured to receive from a remote device at least a portion of the content of the first video data and at least a portion of the content of the second video data wherein the first video data and the second video data are configured for simultaneous output on the first video display device and second video display device.

17. The gaming machine of claim 16, wherein the master gaming controller is further designed or configured to check whether the portion of the content of the first video data and the portion of the content of the second video data are both completely received before allowing the first video data including the portion of the content and the second video data including the portion of the content to be output.

18. The gaming machine of claim 16, wherein the remote device is the remote host.

19. The gaming machine of claim 1, wherein the master gaming controller is further designed or configured to receive from a remote device a stream of the first video data and a stream of the second video data meant for synchronized display on the first video display device and the second video display device, respectively.

20. The gaming machine of claim 19, wherein the master gaming controller is further designed or configured to check that the stream of the first video data and the stream of the second video data are synchronized.

21. The gaming machine of claim 19, a memory for providing a buffer of both the stream of the first video data and the stream of the second video data.

22. The gaming machine of claim 1, where the at least one gaming machine resource is selected from the group consisting of CPU usage, memory usage, graphics processing usage, network bandwidth usage, sound card usage, video card usage, power usage and peripheral device usage.

23. The gaming machine of claim 1, wherein the master gaming controller is further operable to send information to the remote host indicating an amount of one or more gaming machine resources that the first process is allowed to utilize while the first process is generated on the gaming device.

24. The gaming machine of claim 1, wherein the master gaming controller is further designed or configured to receive a download of the commands, the instructions, the data or the combinations thereof while the wager-based reel game of chance is being played and wherein the download changes one or more of the content of the first video data, the content of the second video data or combinations thereof.

25. The gaming machine of claim 1, wherein the master gaming controller is further designed or configured to receive a download of the commands, the instructions, the data or the combinations thereof while the wager-based reel game of chance is being played and wherein the download changes only the content of the first video data.

* * * * *

UNITED STATES PATENT AND TRADEMARK OFFICE

CERTIFICATE OF CORRECTION

PATENT NO. : 8,512,139 B2
APPLICATION NO. : 11/983770
DATED : August 20, 2013
INVENTOR(S) : David C. Williams et al.

It is certified that error appears in the above-identified patent and that said Letters Patent is hereby corrected as shown below:

IN THE CLAIMS

Claim 1, Column 44, Line 13, between “signal” and “including” insert --and--.
Claim 1, Column 44, Line 16, between “device” and “including” insert --and--.
Claim 1, Column 44, Line 17, delete “and”.
Claim 1, Column 44, Line 22, between the first instance of “display” and “and” insert --device--.
Claim 1, Column 44, Line 30, between “transparent” and “window” insert --video--.
Claim 1, Column 44, Line 59, delete “to”.
Claim 1, Column 44, Line 61, delete “and”.
Claim 1, Column 44, Line 65, replace “an” with --the--.
Claim 5, Column 45, Lines 18 and 19, between “control” and “output” insert --the--.
Claim 5, Column 45, Line 19, between “multiple” and “reels” insert --video--.
Claim 5, Column 45, Line 21, between “control” and “output” insert --the--.
Claim 6, Column 45, Line 34, between “multiple” and “reels” insert --video--.
Claim 8, Column 45, Line 51, between “second” and “display” insert --video--.
Claim 8, Column 45, Lines 52 and 53, between “first” and “display” insert --video--.
Claim 10, Column 45, Lines 58 and 59, between “control” and “output” insert --the--.
Claim 10, Column 45, Line 59, between “comprising” and “gaming” insert --the--.
Claim 10, Column 45, Line 61, between “control” and “output” insert --the--.
Claim 10, Column 45, Line 65, between “first” and “display” insert --video--.
Claim 10, Column 45, Line 66, between “second” and “display” insert --video--.
Claim 10, Column 46, Line 1, between “second” and “display” insert --video--.
Claim 10, Column 46, Lines 1 and 2, between “first” and “display” insert --video--.
Claim 11, Column 46, Line 4, between “wherein” and “pair” insert --the--.
Claim 14, Column 46, Line 24, between “includes” and “multiple” insert --the--.
Claim 15, Column 46, Line 35, between “includes” and “multiple” insert --the--.
Claim 21, Column 47, Line 1, between “,” and “a” insert --which includes--.
Claim 23, Column 47, Line 13, replace “device” with --machine--.

Signed and Sealed this
Eighth Day of July, 2014

Michelle K. Lee

Michelle K. Lee
*Deputy Director of the United States Patent and Trademark Office*